US007479591B2

(12) United States Patent
Wheeler et al.

(10) Patent No.: US 7,479,591 B2
(45) Date of Patent: Jan. 20, 2009

(54) MOBILE MUSIC ENTERTAINMENT SYSTEMS

(76) Inventors: Ray L. Wheeler, 1336 E. Morton, Phoenix, AZ (US) 85020; Walter E. Wilson, 1336 E. Morton, Phoenix, AZ (US) 85020

( * ) Notice: Subject to any disclaimer, the term of this patent is extended or adjusted under 35 U.S.C. 154(b) by 26 days.

(21) Appl. No.: 11/847,236

(22) Filed: Aug. 29, 2007

(65) Prior Publication Data

US 2008/0053287 A1 Mar. 6, 2008

Related U.S. Application Data

(60) Provisional application No. 60/862,028, filed on Oct. 18, 2006, provisional application No. 60/841,345, filed on Aug. 30, 2006.

(51) Int. Cl.
*G10C 3/02* (2006.01)

(52) U.S. Cl. ..... 84/177; 312/351.3

(58) Field of Classification Search ..... 84/177; 312/351.3
See application file for complete search history.

(56) References Cited

U.S. PATENT DOCUMENTS

| | | | | | |
|---|---|---|---|---|---|
| 1,028,767 | A | | 6/1912 | Mooney | |
| 1,084,088 | A | * | 1/1914 | Hopphan | 84/176 |
| 1,231,041 | A | | 6/1917 | Martin | |
| 1,593,489 | A | | 3/1926 | Faiman | |
| 1,722,643 | A | * | 7/1929 | Trenor | 84/177 |
| 1,915,177 | A | * | 6/1933 | Berghane | 369/12 |
| 2,174,671 | A | * | 10/1939 | Sauerland | 84/177 |
| 2,505,804 | A | | 5/1950 | Stein | |
| 2,505,805 | A | * | 5/1950 | Stein | 84/174 |
| 2,530,251 | A | * | 11/1950 | Luberoff | 84/743 |
| 3,100,415 | A | * | 8/1963 | Andersen | 84/177 |
| 3,643,000 | A | * | 2/1972 | Andersen | 84/600 |
| 3,695,138 | A | * | 10/1972 | Andersen | 84/470 R |
| 3,744,368 | A | * | 7/1973 | Lady | 84/470 R |
| 4,082,029 | A | * | 4/1978 | Rumer et al. | 84/484 |
| 4,254,684 | A | | 3/1981 | Helpinstill, III | |
| 4,331,062 | A | * | 5/1982 | Rogers | 84/478 |
| 4,334,453 | A | * | 6/1982 | Kumano | 84/177 |
| 4,641,565 | A | * | 2/1987 | Tachida et al. | 84/437 |

(Continued)

FOREIGN PATENT DOCUMENTS

WO WO 0193261 A1 12/2001

OTHER PUBLICATIONS http://www.duelingpianos2go.com/RedSlamGrandPhotos.htm, Slam Grand Pianos, date of publication unknown, 3 pages, Internet. viewed via site listed.

(Continued)

*Primary Examiner*—Walter Benson
*Assistant Examiner*—Robert W Horn
(74) *Attorney, Agent, or Firm*—Stoneman Volk Patent Group; Martin L. Stoneman; Michael D. Volk, Jr.

(57) ABSTRACT

A system relating to improving the usefulness of one or more electronic pianos by providing a multifunctional outer housing. Such outer housing is assembled substantially from modular components, preferably adapted for rapid set-up and breakdown. The housings are designed to generally resemble traditional acoustic pianos. The system incorporates a number of hardware components including an onboard computer device adapted to query and display information contained within a music-related database. A method of commercial distribution is also disclosed.

43 Claims, 33 Drawing Sheets

U.S. PATENT DOCUMENTS

| | | | | | |
|---|---|---|---|---|---|
| 4,656,913 | A | * | 4/1987 | Yoshikawa | 84/177 |
| D294,438 | S | * | 3/1988 | Page | D6/397 |
| D310,232 | S | * | 8/1990 | Dong | D17/8 |
| 4,988,150 | A | * | 1/1991 | Lindow et al. | 312/351.3 |
| D322,089 | S | * | 12/1991 | Orris | D17/8 |
| 5,174,639 | A | * | 12/1992 | Wong | 312/351.3 |
| 5,746,333 | A | * | 5/1998 | Wuertemberger | 211/189 |
| 5,789,693 | A | * | 8/1998 | Lawson | 84/744 |
| 5,864,078 | A | * | 1/1999 | Koevering | 84/478 |
| 5,876,050 | A | * | 3/1999 | Berger | 280/79.2 |
| 5,918,295 | A | * | 6/1999 | Mueth | 84/177 |
| 6,084,167 | A | * | 7/2000 | Akimoto et al. | 84/477 R |
| 6,145,197 | A | * | 11/2000 | Kitashima et al. | 29/896.22 |
| 6,215,055 | B1 | | 4/2001 | Saravis | |
| 6,559,369 | B1 | * | 5/2003 | Gilmore | 84/455 |
| 7,009,095 | B2 | * | 3/2006 | Ichikawa et al. | 84/177 |
| 7,078,611 | B2 | * | 7/2006 | Izumi et al. | 84/743 |
| 7,119,269 | B2 | * | 10/2006 | Furuhashi | 84/744 |
| 7,332,669 | B2 | * | 2/2008 | Shadd | 84/742 |
| 7,348,477 | B2 | * | 3/2008 | Ishihara et al. | 84/177 |
| 2002/0046638 | A1 | * | 4/2002 | Wright et al. | 84/477 R |
| 2004/0085716 | A1 | * | 5/2004 | Uke | 361/680 |
| 2005/0150363 | A1 | | 7/2005 | Shibukawa et al. | |
| 2005/0204908 | A1 | | 9/2005 | Uehara | |
| 2008/0037205 | A1 | * | 2/2008 | Arisaka et al. | 361/680 |
| 2008/0053287 | A1 | * | 3/2008 | Wheeler et al. | 84/174 |

OTHER PUBLICATIONS http://www.yamaha.com/yamahavgn/CDA/ContentDetail/PressReleaseDetail/0,,CNTID%... , Yamaha Clavinova CVP300 Series, date of publication unknown, 5 pages, Internet. viewed related site of the instrument.

http://www.yamaha.com/yamahavgn/CDA/ContentDetail/PressReleaseDetail/0,,CNTID%... , Yamaha Mark IV Disklavier, date of publication unknown, 3 pages, Internet. viewed viat site listed.

* cited by examiner

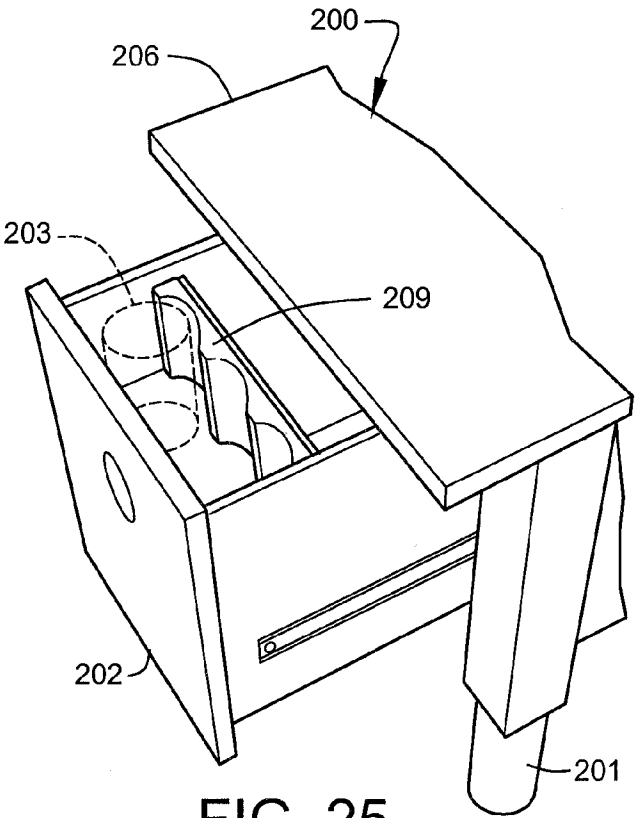
FIG. 25
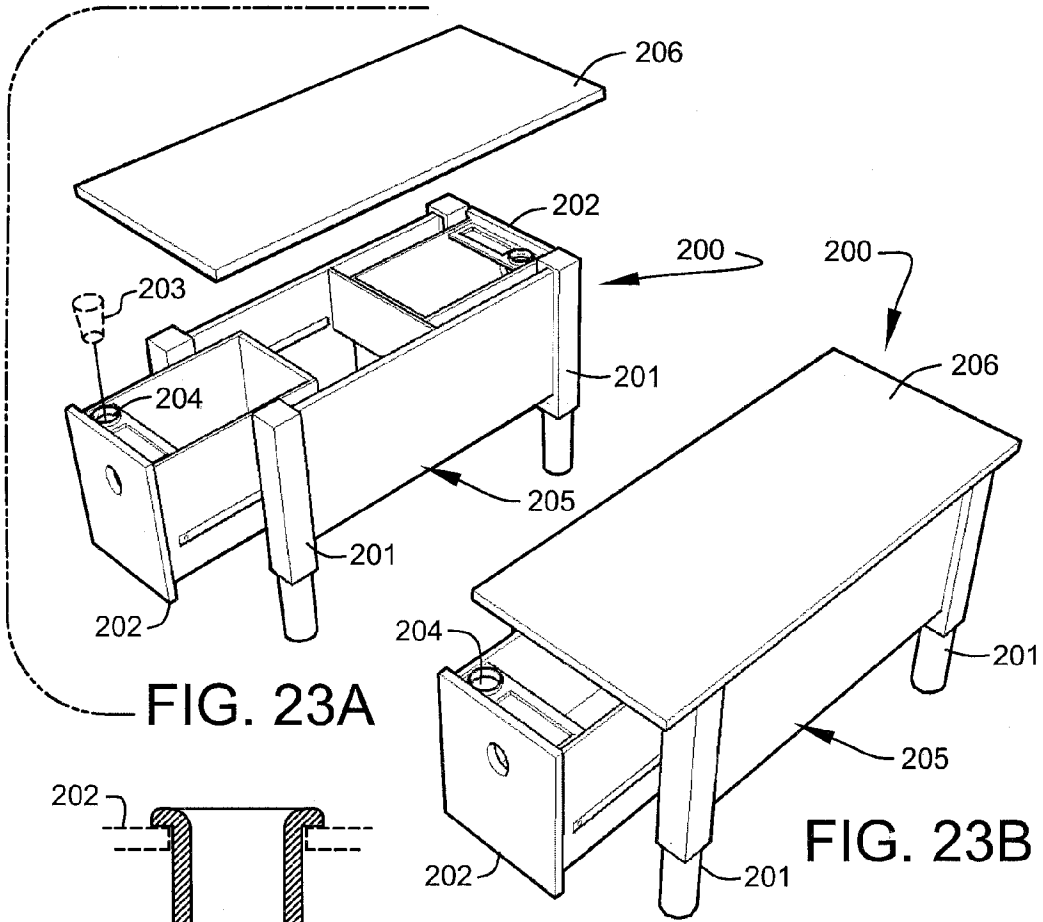
FIG. 23A
FIG. 23B
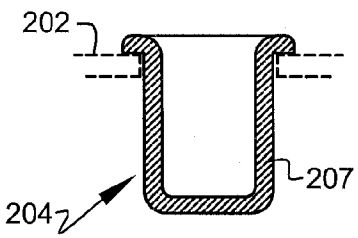
FIG. 24

MOBILE MUSIC ENTERTAINMENT SYSTEMS

CROSS-REFERENCE TO RELATED APPLICATION

The present application is related to and claims priority from prior provisional application Ser. No. 60/862,028, filed Oct. 18, 2006, entitled "MUSIC ENTERTAINMENT SYSTEMS", and is related to and claims priority from prior provisional application Ser. No. 60/841,345, filed Aug. 30, 2006, entitled "MUSIC ENTERTAINMENT SYSTEMS", the contents of both of which are incorporated herein by this reference and are not admitted to be prior art with respect to the present invention by the mention in this cross-reference section.

BACKGROUND

This invention relates to providing mobile music entertainment systems. More particularly, this invention relates to improving the usefulness of one or more electronic pianos by providing a multifunctional outer housing constructed substantially from modular components adapted for rapid set-up and breakdown.

Historically, pianos have been difficult to transport between performance venues. The development of lightweight electronic pianos in the last century resulted in improvements in portability, unfortunately, electronic pianos lack the physical drama associated with traditional acoustic (string-containing) pianos.

The piano has been used to produce music within a wide range of music performance genres ranging from classical to rock-and-roll. "Dueling pianos" is a popular form of musical performance usually performed on stage using two grand pianos. In this unique type of performance, humor and audience participation are essential components of the act. Typically, each piano is played by a professional musician who may also sing or dance as part of the performance. Dueling piano performers tend to be highly theatrical and often utilize special-effect sounds, lights, and props. For example, a performer may throw on a prop hat, jump to the top surface of the piano, and lead the audience in a song. Performances are frequently structured around audience song requests. A successful performer must therefore possess the skill to recall quickly and perform many hundreds of songs and song arrangements. Furthermore, typical dueling-piano performers must frequently move their instruments, props, and related equipment between venue sites with minimum cost and effort.

From the above discussion it is clear that needs exists for piano systems that are highly portable and assist performers in staging highly theatrical musical shows and in home applications.

OBJECTS AND FEATURES OF THE INVENTION

A primary object and feature of the present invention is to provide music entertainment systems that address the above-described problems. Another object and feature of the present invention is to provide multifunctional outer housings, for one or more electronic pianos, such housings being constructed from modular components adapted for rapid set-up and breakdown. A further object and feature of the present invention is to aesthetically enhance the appearance of the above-mentioned electric piano by housing the device within an assembled shell simulating the outer appearance of an acoustic piano.

An additional object and feature of the present invention is to provide control systems for the control of the electric piano and the operation of at least one additional device used during a musical performance. Another object and feature of the present invention is to reduce damage to the electronic piano by at least one liquid spilled adjacent the keyboard portion of the device. An additional object and feature of the present invention is to provide at least one embodiment enabling a method related to quickly supplying user-customized piano housings from ready stocks of modular components of the embodiment. It is a supplementary object and feature of the present invention to provide a means for restraining the movement of an electronic sustain pedal of the above-mentioned electronic piano during a performance.

A further primary object and feature of the present invention is to provide such a system that is efficient, inexpensive, and durable. Other objects and features of this invention will become apparent with reference to the following descriptions.

SUMMARY OF THE INVENTION

In accordance with a preferred embodiment hereof, this invention provides a system related to enhancing the usefulness of at least one electronic piano, such system comprising: at least one appearance simulator structured and arranged to generally simulate the outer appearance of at least one stringed-acoustic grand piano; wherein such at least one appearance simulator comprises at least one housing structured and arranged to removably house the at least one electronic piano in at least one playable position; wherein such at least one housing comprises at least one assembly of mountable elements, each such mountable element structured and arranged to be repeatably demountable from such at least one housing; wherein such at least one assembly of mountable elements comprises at least one outer side-panel structured and arranged to generally resemble at least one outer rim of the at least one stringed-acoustic grand piano; wherein such at least one outer side-panel is sufficiently flexible to repeatably form at least one compound curve; and wherein such at least one outer side-panel is sufficiently flexible to repeatably form a substantially flat plane after such demounting from such at least one appearance simulator.

Moreover, it provides such a system wherein such at least one assembly of mountable elements further comprises: at least one lower support panel structured and arranged to provide lower load-bearing support, at least one upper support panel structured and arranged to provide upper load-bearing support, and at least one non-peripheral support member structured and arranged to provide centralized structural support of substantially the entire such at least one upper support panel; wherein such at least one upper support panel is structured and arranged to generally resemble at least one upper lid of the least one stringed-acoustic grand piano; wherein such at least one upper support panel is maintained in at least one substantially horizontal orientation during such structural support by such at least one non-peripheral support; and wherein such at least one non-peripheral support member is structured and arranged to be supported substantially by such at least one lower support panel. Additionally, it provides such a system wherein such at least one lower support panel is structured and arranged to support the at least one electronic piano in the at least one playable position.

Also, it provides such a system wherein such at least one upper support panel is structured and arranged to provide load-bearing support at least about equal to an amount required to support at least one adult human player. In addition, it provides such a system wherein such at least one assembly of mountable elements further comprises at least one leg assembly structured and arranged to support such at least one lower support panel above at least one supporting floor surface. And, it provides such a system wherein such at least one non-peripheral support is structured and arranged to resist at least two non-parallel directions of shear force developed within such at least one appearance simulator.

Further, it provides such a system wherein such at least one non-peripheral support comprises at least one generally cross-shaped member. Even further, it provides such a system wherein such at least one non-peripheral support is located substantially within at least one perimeter boundary formed by such at least one outer side-panel. Moreover, it provides such a system wherein such at least one housing comprises at least one interior compartment formed substantially within such at least one lower support panel, such at least one upper support panel, and such at least one outer side-panel.

Additionally, it provides such a system further comprising: at least one left cheek-panel structured and arranged to generally resemble at least one left cheek-portion of the at least one stringed-acoustic piano; and at least one right cheek-panel structured and arranged to generally resemble at least one right cheek-portion of the at least one stringed-acoustic piano. Also, it provides such a system wherein such at least one assembly of mountable elements further comprises: at least one front-panel assembly structured and arranged to provide at least partial front-panel closure of such at least one interior compartment; wherein such front-panel assembly comprises at least one front closure-panel structured and arranged to provide at least partial front closure of such at least one interior compartment, and at least one front support-bar structured and arranged to support such at least one front closure-panel in at least one operable position; wherein such one front support-bar is structured and arranged to span in at least one substantially horizontal orientation essentially from such at least one left cheek-panel to such at least one right cheek-panel; and wherein such at least one front support-bar is structured and arranged to reside over at least one upper surface of the at least one electronic piano supported by such at least one lower support panel in the at least one playable position.

In addition, it provides such a system wherein the positions of such at least one front closure-panel and such at least one front support-bar are vertically adjustable relative to the at least one upper surface of the at least one electronic piano. And, it provides such a system wherein such at least one front support-bar comprises at least one channel structured and arranged to collect at least one spilled liquid. Further, it provides such a system wherein such at least one channel comprises at least one slope structured and arranged to assist in draining the at least one spilled liquid from such at least one channel to at least one location away from the at least one electronic piano. Even further, it provides such a system wherein: at least one of such at least one left cheek-panel and such at least one right cheek-panel comprises at least one passage structured and arranged to pass the at least one spilled liquid to at least one location beyond such at least one appearance simulator; and wherein such at least one channel is structured and arranged to drain to such at least one passage.

Moreover, it provides such a system wherein such at least one front closure-panel comprises at least one transparent panel-portion structured and arranged to assist viewing of at least one internal visual display by the at least one player. Additionally, it provides such a system wherein such at least one front closure-panel further comprises at least one loudspeaker structured and arranged to produce at least one audible sound wave.

Also, it provides such a system wherein such at least one lower support panel comprises: at least one first lower-support-panel portion; at least one second lower-support-panel portion; and at least one pivot structured and arranged to provide pivotal rotation of such at least one first lower-support-panel portion relative to such at least one second lower-support-panel portion. In addition, it provides such a system further comprising: at least one secondary support-member structured and arranged to support both such at least one first lower-support-panel portion and such at least one second lower-support-panel portion from the at least one supporting floor surface; wherein such at least one secondary support-member comprises at least one foot-actuated switch assembly structured and arranged to provide foot-actuated electrical control of at least one electrically-operated hardware device, and wherein such at least one foot actuated switch assembly comprises at least one first switch pedal structured and arranged to simulate at least one una corda piano pedal, at least one second switch pedal structured and arranged to simulate at least one sostenuto piano pedal, at least one third switch pedal structured and arranged to simulate at least one sustain piano pedal, at least one pedal box structured and arranged to supportively position such at least one first switch pedal, such at least one second switch pedal, and such at least one third switch pedal, at least one vertical support member structured and arranged to support such at least on pedal box, such at least one first lower-support-panel portion, and such at least one second lower-support-panel portion, and at least one mount structured and arranged to removably mount such at least one vertical support member to such at least one first lower support-panel portion and such at least one second lower-support panel portion; and wherein such at least one vertical support member is structured and arranged to generally resemble at least one piano lyre.

And, it provides such a system wherein: such at least one third switch pedal is structured and arranged to assist musical control of the at least one electronic piano; and wherein such at least one first switch pedal and such at least one second switch pedal are each structured and arranged to provide at least one trigger signal usable to trigger the at least one electrically-operated hardware device. Further, it provides such a system wherein: such at least one first lower-support-panel portion comprises at least one lower peripheral profile; such at least one upper support panel comprises at least one upper peripheral profile; and such at least one lower peripheral profile and such at least one upper peripheral profile are substantially identical. Even further, it provides such a system wherein such at least one lower peripheral profile and such at least one upper peripheral profile are each structured and arranged to generally resemble at least one peripheral spine portion, at least one peripheral tail portion, and at least one peripheral bentside portion of the at least one outer rim of the at least one stringed-acoustic grand piano. Moreover, it provides such a system further comprising: at least one data processor structured and arranged to process music-related data of at least one database; at least one visual display structured and arranged to visually display at least one output of such music-related data by such at least one data processor; and at least one player input system structured and arranged to assist player-generated inputs to such at least one data processor.

Additionally, it provides such a system wherein such at least one player input system comprises at least one member selected from the group consisting essentially of: at least one computer keyboard at least one touch-sensitive input device at least one voice-recognition device at least one mouse at least one light pen at least one trackball at least one motion-sensing device at least one hand-actuated switch at least one foot-actuated switch. Also, it provides such a system further comprising: at least one network connection structured and arranged to connect such at least one data processor to at least one communication network comprising at least one remote server comprising the at least one database, and wherein such at least one network connection is structured and arranged to support at least one client-server process supporting at least one transfer of the music-related data between such at least one database processor and such at least one remote server. In addition, it provides such a system further comprising at least one onboard data-storage device structured and arranged to provide onboard storage of the at least one database. And, it provides such a system further comprising: such at least one database comprising music-related data; wherein such at least one database comprises at least one searchable index structured and arranged to be searchable by such at least one data processor. Further, it provides such a system wherein such at least one data processor comprises at least one onboard personal computer.

Even further, it provides such a system further comprising: at least one hardware-control system structured and arranged to control at least one electrically-operated hardware device; wherein such at least one hardware-control system comprises at least one input port structured and arranged to receive at least one trigger signal; at least one output port structured and arranged to output at least one control signal usable to control the electrically-operated hardware device, and at least one signal processor structured and arranged to control at least one operational relationship between the receiving of such at least one trigger signal at such at least one input port and the output of such at least one control signal supplied at such at least one output port. Moreover, it provides such a system wherein: such at least one hardware-control system comprises at least four output ports each structured and arranged to output at least one control signal on receiving such at least one trigger signal at such at least one input port; and each at least four output ports comprise at least one selectable enabler structured and arranged to allow independently selectable enablement of each one of such at least four output ports.

Additionally, it provides such a system wherein such at least one hardware control system is structured and arranged to interoperate with at least one foot-actuated switch. Also, it provides such a system further comprising: such at least one at least one electrically-operated hardware device; wherein such at least one at least one electrically-operated hardware device comprises at least one device mount structured and arranged to mount such at least one electrically-operated hardware device within such at least one appearance simulator. In addition, it provides such a system wherein such at least one at least one electrically-operated hardware device comprises at least one illumination device. And, it provides such a system wherein such at least one illumination device comprises at least one at least one strobe light. Further, it provides such a system wherein such at least one illumination device comprises at least one at least one spinning-light effect. Even further, it provides such a system wherein such at least one illumination device comprises at least one at least one color-changing effect.

Moreover, it provides such a system wherein such at least one illumination device comprises at least one at least one laser projector. Additionally, it provides such a system wherein such at least one at least one electrically-operated hardware device comprises at least one fog-generation device. Also, it provides such a system wherein such at least one at least one electrically-operated hardware device comprises at least one confetti-launching device. In addition, it provides such a system wherein such at least one hardware control system is structured and arranged to interoperate with at least one personal computer. And, it provides such a system further comprising at least one onboard audio controller structured and arranged to control at least one audio input and at least one audio output of such system. Further, it provides such a system wherein such at least one onboard audio controller comprises: at least one audio input structured and arranged to receive at least one first electronic audio signal; at least one audio divider circuit structured and arranged to divide the at least one first electronic audio signal to produce at least one second electronic audio signal; at least one pass-through audio output structured and arranged to output the at least one first electronic audio signal substantially without signal processing; at least one first audio-processor circuit structured and arranged to process the at least one second electronic audio signal to produce at least one third electronic audio signal; and at least one second audio output structured and arranged to output the at least one third electronic audio signal. Even further, it provides such a system wherein such at least one first audio-processor circuit comprises at least one frequency adjuster structured and arranged to adjust at least one signal level within at least one frequency range of the at least one second electronic audio signal.

Moreover, it provides such a system further comprising: at least six audio inputs structured and arranged to receive at least six independent electronic audio signals; at least one divider circuit structured and arranged to divide the at least six electronic audio signals to produce at least six secondary electronic audio signals; at least six pass-through audio outputs structured and arranged to output the at least six independent electronic audio signals substantially without signal processing; at least one audio-processor circuit structured and arranged to process each one of the at least six secondary electronic audio signals to produce at least six post-processed electronic audio signals; at least one signal-combining circuit structured and arranged to combine at least two of the at least six post-processed electronic audio signals to produce at least one composite multi-channel audio signal; and at least one composite audio output structured and arranged to output the at least one composite multi-channel electronic audio signal. Additionally, it provides such a system wherein: such at least one audio processor circuit comprises at least one frequency-band adjuster structured and arranged to adjust at least one signal level within at least one frequency band within each of the at least six secondary electronic audio signals, and at least one first signal-level adjuster structured and arranged to adjust at least one overall signal level of each one of the at least six secondary electronic audio signals; wherein at least one signal-combining circuit comprises at least one second signal-level adjuster structured and arranged to contemporaneously adjust at least one signal level of at least one first audio channel and at least one second audio channel of the at least one composite multi-channel electronic audio signal; and wherein during such contemporaneous signal-level adjustment, the sum of the signal levels of the at least one first audio channel and the at least one second audio channel is held substantially constant.

Also, it provides such a system further comprising: at least one first frequency-divider structured and arranged to divide the at least one composite multi-channel electronic audio signal into at least one upper-frequency signal and at least one low-frequency signal; and at least one low-frequency signal-level adjuster structured and arranged to adjust the overall signal level of the at least one lower-frequency signal. In addition, it provides such a system further comprising: at least one first powered amplifier structured and arranged to amplify the at least one lower-frequency signal; and at least one low-frequency loudspeaker structured and arranged to convert the at least one lower-frequency signal to at least one audible sound wave. And, it provides such a system further comprising: at least one second powered amplifier structured and arranged to amplify the at least one upper-frequency signal; at least one second frequency-divider structured and arranged to divide the at least one upper-frequency signal into at least one upper-frequency band and at least one lower-frequency band; at least one tweeter-type loudspeaker structured and arranged to convert the at least one upper-frequency band to at least one audible sound wave; and at least one mid-range loudspeaker structured and arranged to convert the at least one lower-frequency band to at least one audible sound wave.

Further, it provides such a system further comprising: at least one onboard air purifier structured and arranged to remove impurities from air adjacent the at least one player; wherein such at least one onboard air filter comprises at least one air intake structured and arranged to intake air adjacent such system; at least one air filter structured and arranged to filter the impurities from the air; and at least one air outlet structured and arranged to output purified air in at least one area adjacent the at least one player. Even further, it provides such a system further comprising: at least one loudspeaker structured and arranged to produce at least one audible sound wave; wherein such at least one loudspeaker comprises at least one vent structured and arranged to vent the purified air generated by such at least one onboard air purifier; and at least one air conduit structured and arranged to conduct the purified air between such at least one air outlet and such at least one loudspeaker. Moreover, it provides such a system wherein such at least one outer side-panel comprises at least one translucent portion structured and arranged to pass visible light.

In accordance with another preferred embodiment hereof, this invention provides a system related to enhancing the usefulness of at least one electronic piano, the at least one electronic piano comprising at least one keyboard portion and at least one non-keyboard portion, the at least one non-keyboard portion comprising at least one outer physical size, such system comprising: at least one housing structured and arranged to generally simulate the outer appearance of at least one stringed-acoustic piano; wherein such at least one housing comprises at least one assembly of mountable elements, each such mountable element structured and arranged to be repeatably demountable from such at least one housing to assist compact stowage; wherein such at least one assembly of mountable elements comprises at least one support structured and arranged to removably support the at least one electronic piano in at least one playable position, and at least one concealer structured and arranged to substantially conceal the at least one non-keyboard portion of the at least one electronic piano during the support in the at least one playable position; wherein such at least one concealer comprises at least one conformer structured and arranged to conform such at least one appearance simulator to the at least one outer physical size of the at least one non-keyboard portion; and wherein such at least one conformer comprises at least one self-adjuster structured and arranged to self adjust such at least one conformer to the at least one outer physical size of the at least one non-keyboard portion. Additionally, it provides such a system wherein such at least one housing further comprises: at least one left cheek-panel structured and arranged to generally resemble at least one left cheek-portion of the at least one stringed-acoustic piano; and at least one right cheek-panel structured and arranged to generally resemble at least one right cheek-portion of the at least one stringed-acoustic piano.

Also, it provides such a system wherein such at least one concealer comprises: at least one front-panel assembly structured and arranged to provide at least partial front-panel closure of such at least one housing; wherein such front-panel assembly comprises at least one front closure-panel structured and arranged to provide at least partial front closure of such at least one housing, and at least one front support-bar structured and arranged to support such at least one front closure-panel in at least one operable position; and wherein such one front support-bar is structured and arranged to span in at least one substantially horizontal orientation essentially from such at least one left cheek-panel to such at least one right cheek-panel. In addition, it provides such a system wherein: such at least one conformer comprises such at least one front closure-panel and such at least one front support-bar; the positions of such at least one front closure-panel and such at least one front support-bar are vertically adjustable relative to at least one upper surface of the at least one electronic piano; such at least one front closure-panel and such at least one front support-bar are structured and arranged to conform to the at least one outer physical size of the at least one non-keyboard portion by adjustably resting on the at least one upper surface; and such at least one self-adjuster operates substantially by the downward force of gravity. And, it provides such a system wherein such at least one front support-bar comprises at least one channel structured and arranged to collect at least one spilled liquid. Further, it provides such a system wherein such at least one channel comprises at least one slope structured and arranged to assist in draining the at least one spilled liquid from such at least one channel to at least one location away from the at least one electronic piano. Even further, it provides such a system wherein: at least one of such at least one left cheek-panel and such at least one right cheek-panel comprises at least one passage structured and arranged to pass the at least one spilled liquid to at least one location beyond such at least one appearance simulator; and wherein such at least one channel is structured and arranged to drain to such at least one passage. Even further, it provides such a system wherein such at least one front closure-panel comprises at least one transparent panel-portion structured and arranged to assist viewing of at least one internal visual display by the at least one player. Even further, it provides such a system wherein such at least one front closure-panel further comprises at least one loudspeaker structured and arranged to produce at least one audible sound wave.

In accordance with another preferred embodiment hereof, this invention provides a system, related to enhancing the usefulness of at least one electronic piano, said system comprising: at least one cabinet, comprising at least one interior compartment, structured and arranged to house the at least one electronic piano therein; wherein said at least one cabinet comprises at least one access opening structured and arranged to provide access to said at least one interior compartment, and at least one support tray structured and arranged to support the at least one electronic piano within said at least one interior compartment; wherein said at least one support tray comprises at least one translational transporter structured and arranged to assist translational transport of said at least one support tray at least partially from within said at least one interior compartment; wherein said at least one support tray comprises at least one left cheek-panel structured and arranged to generally resemble at least one left cheek-portion of the at least one stringed-acoustic piano and at least one right cheek-panel structured and arranged to generally resemble at least one right cheek-portion of the at least one stringed-acoustic piano; and wherein said at least one access opening comprises at least one operable door structured and arranged to, when in a closed position, substantially conceal said at least one interior compartment.

In accordance with another preferred embodiment hereof, this invention provides a method related to the support of at least one at least one electronic piano within at least one piano-simulating assembly, the at least one piano-simulating assembly adapted to simulate the outer appearance of at least one upright stringed-acoustic piano, said method comprising the steps of: providing at least one cabinet, comprising at least one interior compartment, structured and arranged to house the at least one electronic piano therein; providing at least one lower body component structured and arranged to provide elevated support of the at least one cabinet; supportively stacking such at least one cabinet on such at least one lower body component; providing at least one upper body component structured and arranged to be supportable by such at least one cabinet; supportively stacking such at least one upper body component on such at least one cabinet; providing at least two leg members structured and arranged to visually simulate the leg members of the at least one upright stringed-acoustic piano; providing a plurality of mountable cover panels, each such mountable cover panel being structured and arranged to be repeatably demountable from at least one of such at least one cabinet, such at least one lower body component, and such at least one upper body component; mounting such plurality of mountable cover panels to such at least one cabinet, such at least one lower body component, and such at least one upper body component to produce such at least one piano-simulating assembly simulating the outer appearance of the at least one upright stringed-acoustic piano.

In accordance with another preferred embodiment hereof, this invention provides a system related to assisting at least one musician during the playing of at least one keyboard instrument supported within at least one piano-simulating housing, the at least one piano-simulating housing adapted to simulate the outer appearance of at least one stringed-acoustic piano, such system comprising: at least one foot actuated pedal assembly structured and arranged to provide foot actuated control of the at least one keyboard instrument; wherein such at least one foot actuated pedal assembly comprises at least one first pedal structured and arranged to simulate at least one una corda piano pedal, at least one second pedal structured and arranged to simulate at least one sostenuto piano pedal, at least one third pedal structured and arranged to simulate at least one sustain piano pedal, at least one pedal box structured and arranged to supportively position such at least one first pedal, such at least one second pedal, and such at least one third pedal, and at least one vertical support member structured and arranged to support such at least on pedal box; wherein such at least one vertical support member is structured and arranged to visually simulate at least one piano lyre; wherein such at least one vertical support member comprise at least mount structured and arranged to mount such at least one vertical support member to the at least one theatrical staging-apparatus; wherein such at least one third pedal is structured and arranged to assist musical interoperation with the at least one electronic piano; and wherein such at least one first pedal and such at least one second pedal each comprise at least one electrical trigger structured and arranged to provide at least one trigger signal usable to trigger the at least one electrically-operated hardware device.

In accordance with another preferred embodiment hereof, this invention provides a system related to reducing damage to at least one musical piano by at least one spilled liquid comprising: at least one piano-type case structured and arranged to encase at least one sound-generating device; wherein such at least one piano-type case comprises at least one music shelf and at least one cheek panel; wherein such at least one music-shelf comprises at least one channel structured and arranged to collect the at least one spilled liquid; wherein such at least one cheek panel comprises at least one passage structured and arranged to pass the at least one spilled liquid from such at least one channel to a location outside such at least one piano-type case; and wherein such at least one channel is further structured and arranged to assist in transferring the at least one spilled liquid to such at least one passage.

In accordance with another preferred embodiment hereof, this invention provides a system related to improving the comfort of at least one pianist comprising: at least one piano bench structured and arranged to support the at least one pianist in at least one seated position allowing playing of at least one piano; wherein such at least one piano bench comprises at least one storage compartment structured and arranged to store at least one storable item; and wherein such at least one storage compartment comprises at least beverage-holder structured and arranged to hold at least one beverage container. In addition it provides at least one piano bench structured and arranged to support at least one player of the at least one electronic piano in such seated position; wherein said at least one piano bench comprises at least one storage compartment; wherein said at least one storage compartment comprises at least one beverage-container holder structured and arranged to hold at least one beverage container; and wherein said at least one beverage-container holder comprises at least one refrigerant structured and arranged to assist in controlling the thermal temperature of at least one beverage contained within the at least one beverage container. Even further, it provides such a system wherein such at least one storage compartment comprises at least one operable drawer. Even further, it provides such a system wherein: such at least one piano bench comprises at least one support leg structured and arranged to support such at least one piano bench above at least one supporting floor surface; and such at least one support leg is vertically adjustable.

In accordance with another preferred embodiment hereof, this invention provides a system related to stabilization of at least one electronic foot-control pedal used to control at least one musical device, the at least one electronic foot-control pedal comprising at least one floor-supportable fixed portion and at least one foot-operable moving portion, such system comprising: at least one inertial mass structured and arranged to provide inertial mass; and at least one removable coupler structured and arranged to removably couple such at least one inertial mass to at least one upper external surface of the at least one floor-supportable fixed portion; wherein coupling of such at least one inertial mass to the at least one upper external surface increases the overall inertial mass of the at least one electronic foot-control pedal. Even further, it provides such a system wherein such at least one inertial mass comprises at least one removable engager structured and arranged to removably engage at least one carpet covering of at least one floor support surface. Even further, it provides such a system further comprising at least one friction-increasing material structured and arranged to increase surface friction between such at least one inertial mass and at least one non-carpet finish of at least one floor support surface.

In accordance with another preferred embodiment hereof, this invention provides a system related to theatrical staging-apparatus adapted to assist audience enjoyment during at least one musical performance utilizing at least one first electronic piano and at least one second electric piano, such system comprising: at least one appearance simulator structured and arranged to generally simulate the outer appearance of at least one stringed-acoustic piano; wherein such at least one appearance simulator comprises at least one first support structured and arranged to support the at least one first electronic piano in at least one first playable position, and at least one second support structured and arranged to support the at least one second electronic piano in at least one second playable position.

In accordance with another preferred embodiment hereof, this invention provides a system enabling a method related to providing at least one custom piano housing adapted to house at least one keyboard instrument, the at least one custom piano housing adapted to generally simulate the outer appearance of at least one stringed-acoustic piano, such method comprising the steps of: producing at least one stored inventory comprising groups of mountable elements, each such group usable to assemble the at least one custom piano housing; offering to sell such at least one custom piano to at least one customer by providing at least one custom ordering system allowing selection of at least one custom combination of mountable elements usable to produce at least one custom piano housing; providing for acceptance of at least one custom order and at least one payment from the at least one customer; and providing for shipping such at least one custom combination of mountable elements to the at least one customer. Even further, it provides such a system wherein: each such mountable element is structured and arranged to be repeatably demountable from such at least one custom piano housing; and at least one portion of such mountable elements comprise substantial modularity to assist interchangeability of such mountable elements between the groups of mountable elements. Even further, it provides such a system wherein such at least one custom ordering step is enabled by at least one Internet site operated in conjunction with at least one website server.

BRIEF DESCRIPTION OF THE DRAWINGS

FIG. 23A and FIG. 23B each show perspective views of a beverage and prop-storing bench of the portable piano assembly of FIG. 1.

FIG. 24 shows a sectional view through a cold beverage holder of the beverage and prop-storing bench of FIG. 23A and FIG. 23B.

FIG. 25 shows a partial perspective view of an alternate cold beverage holder of the beverage and prop-storing bench of FIG. 23A and FIG. 23B.

DETAILED DESCRIPTION OF THE BEST MODES AND PREFERRED EMBODIMENTS OF THE INVENTION

Figure 1:
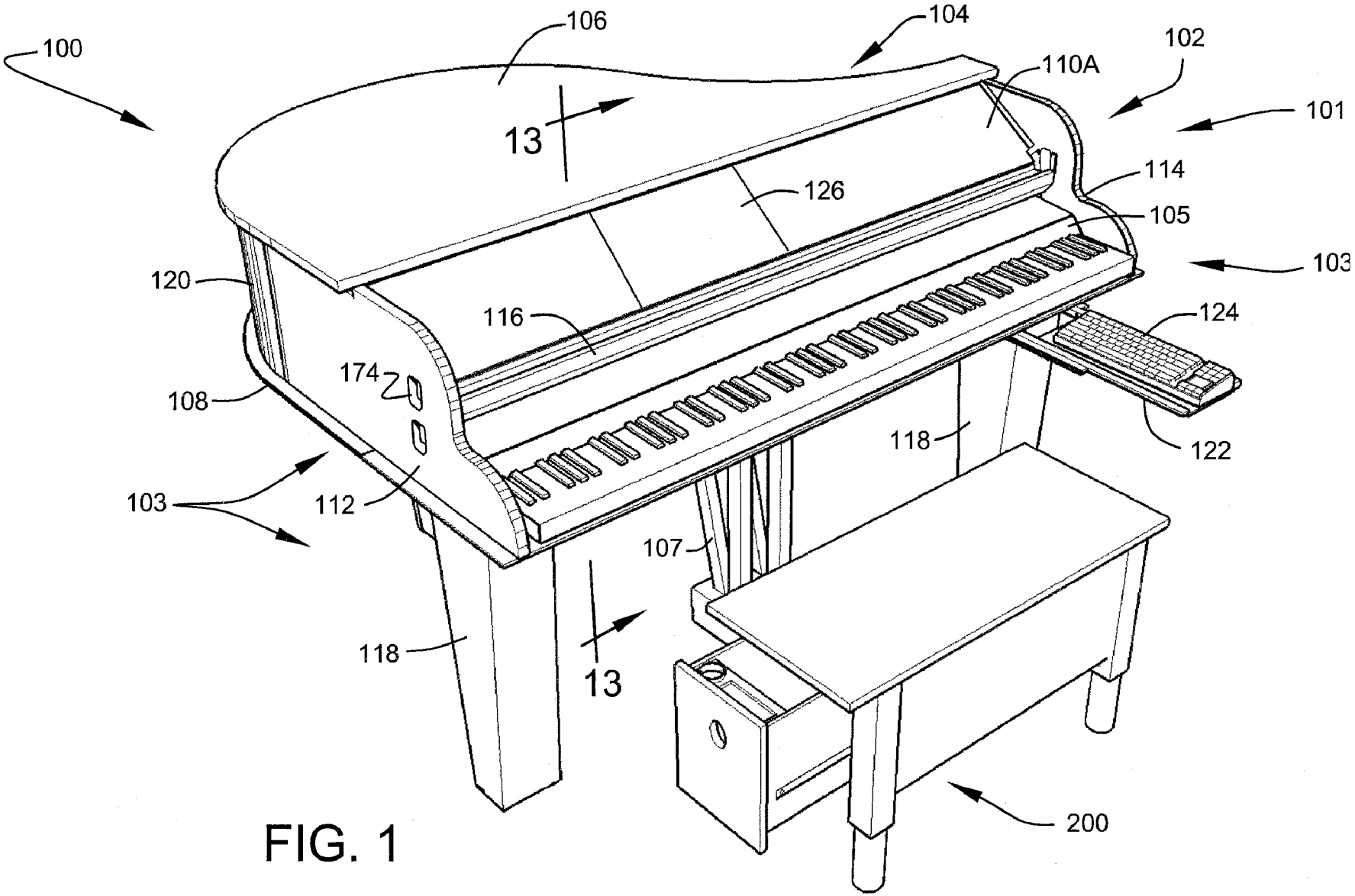
FIG. 1 shows a perspective view illustrating a modular piano assembly of a mobile music entertainment system according to a preferred embodiment of the present invention.

FIG. 1 shows a perspective view illustrating portable piano assembly 102 of mobile music entertainment system 100 according to a preferred embodiment of the present invention. Generally stated, mobile music entertainment system 100 is designed to enhance the usefulness of electronic piano device 105 by enveloping electronic piano device 105 within an organized array of functional accessories.

A principal preferred feature of mobile music entertainment system 100 is to provide an outer assembly 101 generally simulating the overall outer appearance of an acoustic (string-containing) piano. In the preferred embodiment of FIG. 1, outer assembly 101 generally simulates the outer appearance of a grand piano.

Preferably, outer assembly 101 comprises a piano-simulating case identified herein as modular shell 104, as shown. Preferably, modular shell 104 is adapted to removably house and support at least one electronic piano device 105 in a generally standard playing position as depicted in FIG. 1. Modular shell 104 is preferably designed to further assist in simulating an acoustic piano by closely engaging and surrounding the non-keyboard portions of electronic piano device 105, as shown.

Modular shell 104 is preferably assembled from a group of mountable components 103, as shown. Preferably, each such mountable component 103 is structured and arranged to be repeatably demountable from modular shell 104, as further described in FIG. 2. This preferred configuration allows for rapid set-up and breakdown of modular shell 104, greatly facilitating convenient storage and transport between performances. The preferred modularity and interchangeably within interrelated groups of mountable components 103 also allows unique component combinations to be selected and assembled to produce a piano apparatus tailored to specific performance requirements and/or purchase/rental price criteria.

Figure 13:
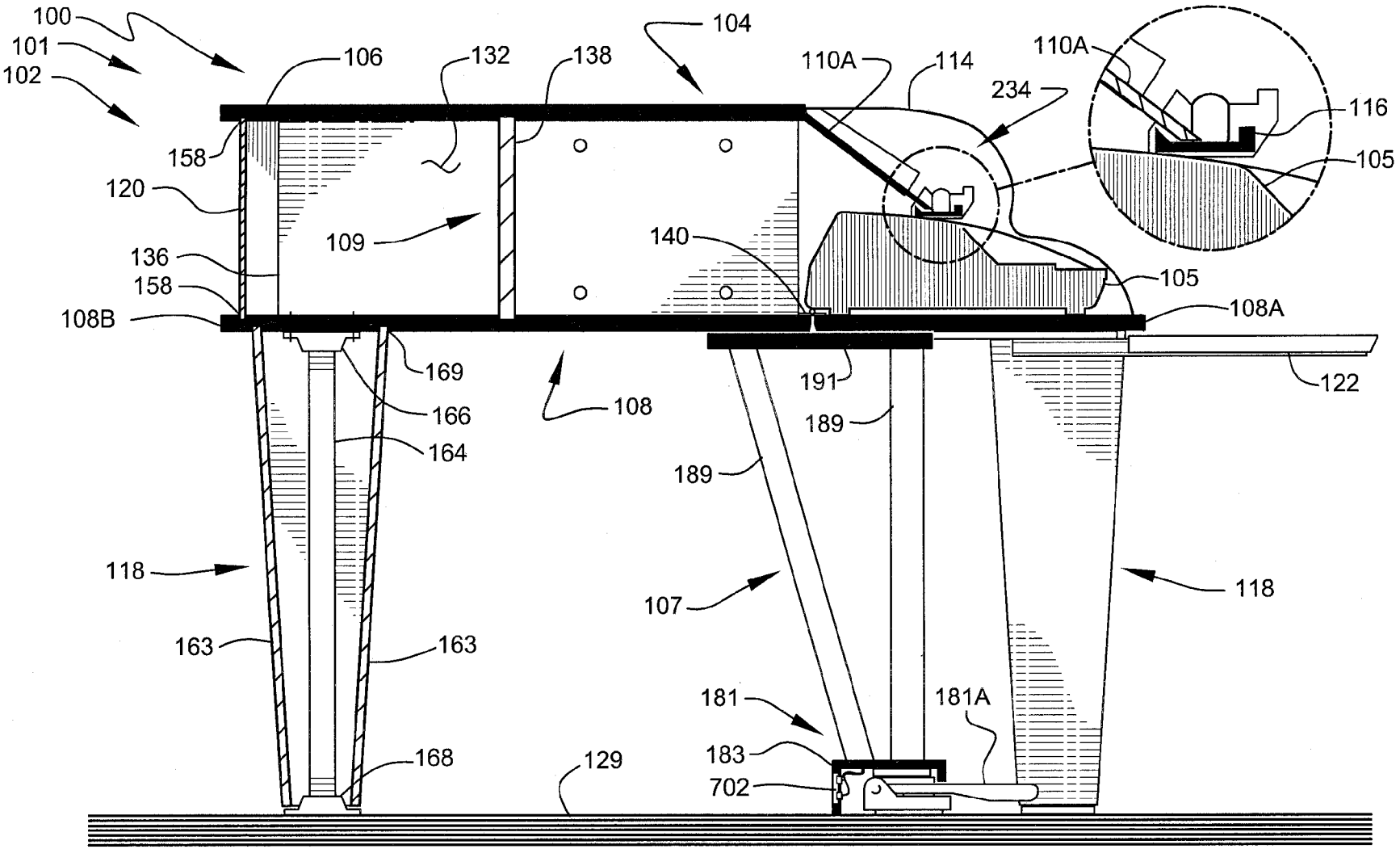
FIG. 13 shows a sectional view through the section 13-13 of FIG. 1.

Externally visible mountable components 103 of modular shell 104 include top panel 106, a two-part hinged bottom panel 108, front board 110A, first cheek-board 112, second cheek-board 114, channel bar 116, a set of leg assemblies 118, and a substantially flexible outer side-panel 120, as shown. Preferably, the assembly of top panel 106 with bottom panel 108, first cheek-board 112, second cheek-board 114, and outer side-panel 120 creates internal compartment 132, as best illustrated in FIG. 13.

Both first cheek-board 112 and second cheek-board 114 are configured to generally resemble the right and left cheek structures of an acoustic piano, as shown. Preferably, front board 110A comprises transparent panel 126 through which an on-board computer video-display is viewable. Preferably, a mountable foot-pedal assembly 107 provides one or more foot actuated controls usable by the player during a performance. Additionally, portable piano assembly 102 preferably comprises a unique prop-storing bench 200, as further described in FIG. 23, FIG. 24, and FIG. 25 below.

Figure 2:
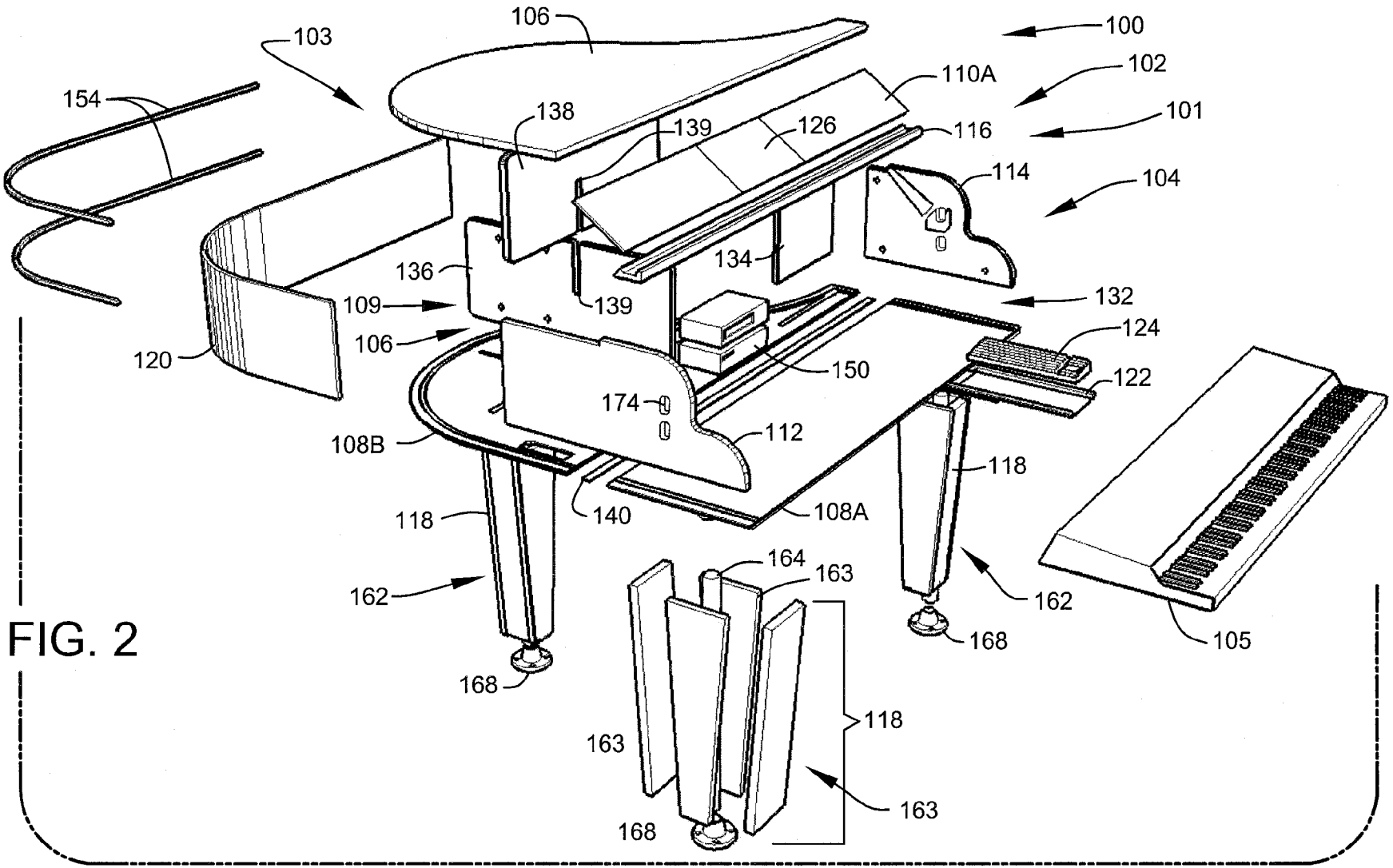
FIG. 2 shows an exploded perspective view of the modular piano assembly of FIG. 1.
Figure 3:
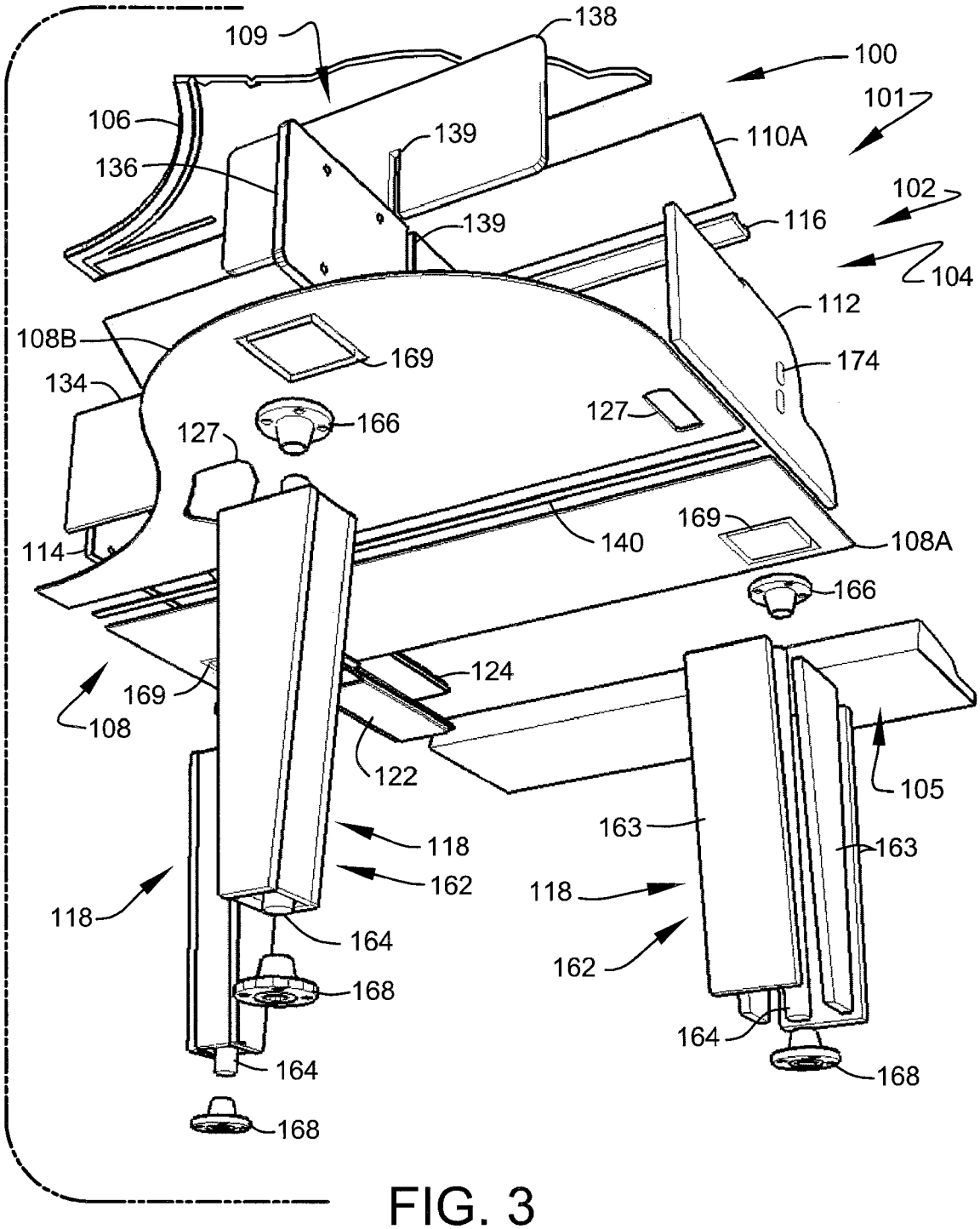
FIG. 3 shows an exploded perspective view illustrating a portion of the underside features of the modular piano assembly of FIG. 1.

FIG. 2 shows an exploded perspective view of portable piano assembly 102 of FIG. 1. FIG. 3 shows a partial exploded perspective view illustrating the underside features of the portable piano assembly 102 of FIG. 1.

A majority of the components of modular shell 104 comprise planar panels formed from lightweight sheet materials, as shown. Preferably, a majority of such "panelized" components of modular shell 104 are formed from either plywood or sheet plastic. The preferred use of relatively thin and lightweight sheet materials enables the disassembly of portable piano assembly 102 into a readily transportable stack of lightweight component panels.

To form the classic "harp-shaped" configuration associated with the curving side-rim of a grand piano, outer side-panel 120 is constructed from a substantially flexible sheet, preferably a sheet of sufficient flexibility to repeatedly form at least one compound curve, when assembled within modular shell 104, and to repeatably form a substantially flat sheet after demounting.

Despite the use of such relatively thin materials, modular shell 104 forms a stable weight-bearing structure when assembled. The strength of modular shell 104 is achieved, in part, by a novel system of centralized (non-peripheral) internal supports.

To understand the unique structural configuration of the depicted system, it is helpful to review the structural interactions between the individual components of modular shell 104. Preferably, bottom panel 108 is supported above a floor surface by three demountable leg assemblies 118, as shown. Preferably, bottom panel 108 is structured and arranged to provide a lower load-bearing support plane within the body of modular shell 104. Top panel 106 is structured and arranged to provide an upper load-bearing support plane, most preferably providing a level of load-bearing support at least about equal to an amount required to support at least one standing adult human. For preferred products and arrangements described herein, top panel 106 is preferably structured and arranged to provide an upper load-bearing capacity of at least about 300 pounds with a concentrated load capacity of about 50 pounds per square inch. This surprising level of load capacity provided by the relatively thin material of top panel 106 is achieved through the use of a non-peripheral "centralized" support structure 109 within the internal compartment 132 of modular shell 104. Preferably, centralized support structure 109 is adapted to structurally couple top panel 106 with bottom panel 108, thus developing a rigid composite assembly capable of transferring load forces between top and bottom panels (see also FIG. 13). Although top panel 106 closely resembles the hinged top lid of a grand piano, top panel 106 is firmly fixed in a substantially horizontal orientation by centralized support structure 109.

The non-peripheral centralized support structure 109 is preferably located substantially within the peripheral boundary defined by outer side-panel 120, as shown. Preferably, centralized support structure 109 is structured and arranged to structurally support substantially the entire top panel 106. This preferred support arrangement allows outer side-panel 120 to be thin, flexible, and non-structural.

Preferably, centralized support structure 109 comprises, in combination, an inner support panel 134 and two interlocking panels identified herein as cross support panel 136 and cross support panel 138, as shown. Preferably, cross support panel 136 and cross support panel 138 each comprise inter-engaging slots 139 adapted to interlink the cross support panels in a cruciform (cross-shaped) structure within internal compartment 132, as best shown in the assembled sectional view of FIG. 13. The use of the above-described centralized support has been found to be highly effective in stabilizing the overall structure of modular shell 104 by resisting internal shear forces in at least two non-parallel directions. For preferred products and arrangements described herein, centralized support structure 109 is preferably capable of resisting a horizontal force of at least about 50-pounds when applied to an outer edge of top panel 106. This force is approximately equal to an adult individual leaning against top panel 106. Preferred mounting hardware and methods for assembling the centralized support system is discussed in more detail within FIG. 7. An alternate preferred central support arrangement is shown and described in FIG. 33.

Preferably, bottom panel 108 is divided into bottom forward panel 108A and bottom rear panel 108B, preferably along a substantially continuous piano hinge 140, as shown. Continuous piano hinge 140 preferably allows bottom panel 108 to be folded into a smaller size format to further assist compact stowage (at least embodying herein wherein such at least one lower-support-panel comprises at least one first lower-support-panel portion, at least one second lower-support-panel portion, and at least one pivot structured and arranged to provide pivotal rotation of such at least one first lower-support-panel portion relative to such at least one second lower-support-panel portion).

Preferably, modular case 104 is supported above a floor surface by three demountable leg assemblies 118, as shown. Preferably, each leg assembly 118 comprises a removable structural support column 164 surrounded by four planar panels permanently joined to form a tapered leg box 162, as shown. Preferably, three recessed channels are formed in the underside of bottom panel 108, identified herein as leg receiving channels 169, as shown. Preferably, each leg receiving channel 169 is adapted to receive and position the upper end of a respective leg box 162. Preferred structures and arrangements of leg assemblies 118 are discussed further in FIG. 6.

Also illustrated in FIG. 2 are theatrical lighting effects hardware comprising a set of flexible light ropes 154 that are optionally installed on the exterior of outer side-panel 120. Light ropes 154 are a single representative example of several theatrical hardware enhancements provided within preferred "custom" embodiments of portable piano assembly 102.

Preferably, electronic piano device 105 is supported in a playable position by bottom panel 108, as shown. An example electronic piano device suitable for use within portable piano assembly 102 includes the P150 model of electric piano produced by Yamaha Corporation of America of Buena Park, Calif.

Sliding keyboard drawer 122 is adapted to support a qwerty-type computer keyboard 124 and is preferably mounted to the underside of bottom panel 108, as shown.

Figure 4:
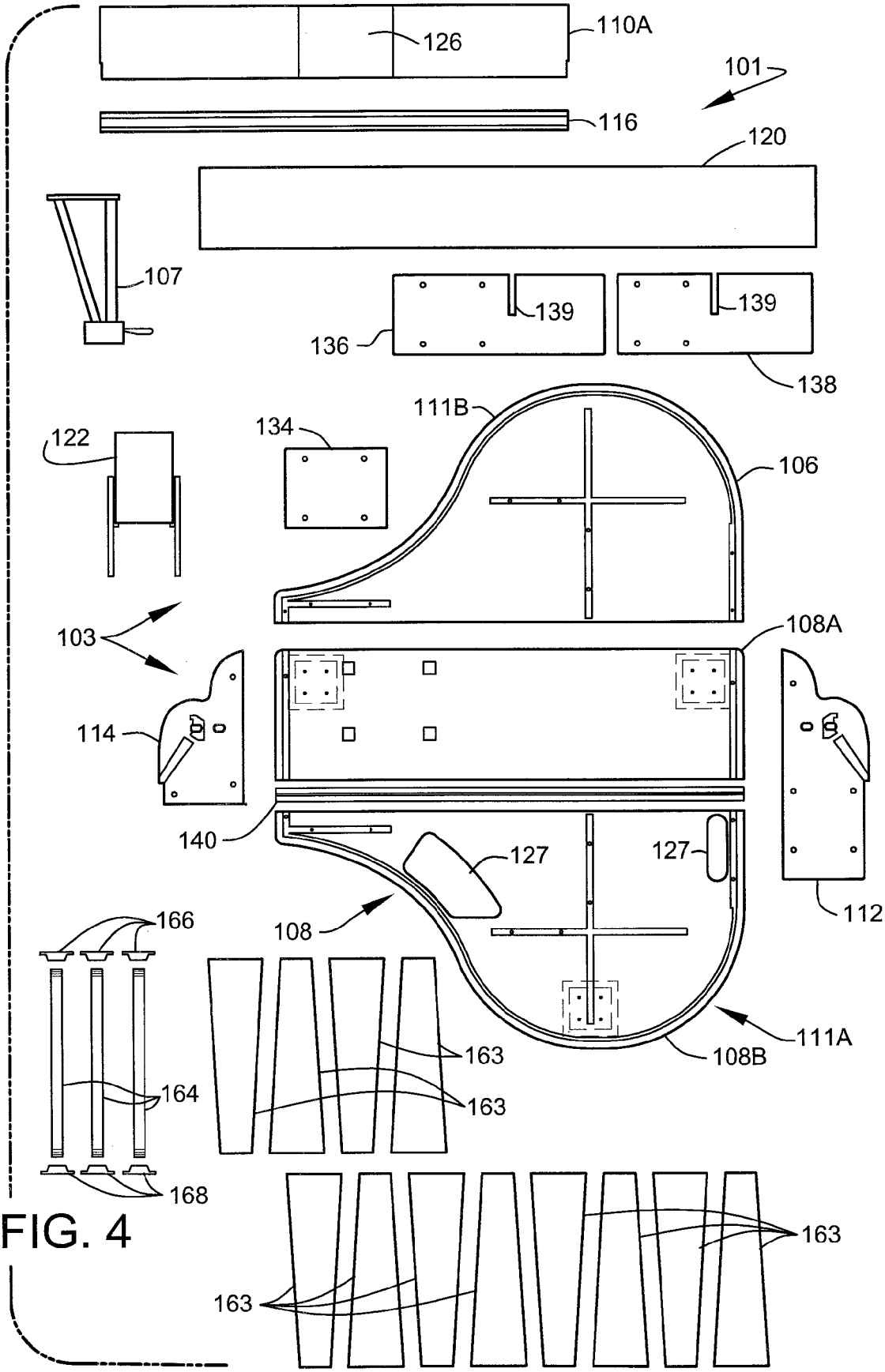
FIG. 4 shows a disassembled grouping of modular components used to construct the portable piano assembly of FIG. 1.

FIG. 4 shows a plan view illustrating a disassembled grouping of mountable components 103 used to construct a single basic outer assembly 101. These preferred mountable components include: front board 110A, channel bar 116, foot-pedal assembly 107, outer side-panel 120, cross support panel 136, cross support panel 138, keyboard drawer assembly 122, inner support panel 134, top panel 106, bottom panel 108 (in the present embodiment comprising bottom forward-panel 108A, bottom rear-panel 108B, pivotally joined by piano hinge 140), first cheek-board 112, second cheek-board 114, three leg support columns 164, three upper pipe flanges 166, three lower pipe flanges 168, and twelve tapered leg panels 163 sufficient to construct three (four-sided) leg boxes 162.

Substantially all of the illustrated mountable components are capable of disassembling for storage and transport, the preferred exceptions being the two-part bottom panel 108 and leg boxes 162 that are permanently assembled for convenience.

Preferably, both top panel 106 and bottom panel 108 comprise a system of dado channels 158 adapted to receive and perpendicularly position adjacent panels of modular case 104. In addition, a pair of handholds 127 is cut through bottom panel 108 to assist in handling during transport. Upon reading the teachings of this specification, those of ordinary skill in the art will now understand that, under appropriate circumstances, considering such issues as intended use, cost, etc., other handhold arrangements, such as, for example, providing complementary hand holds within the bottom forward panel to allow simultaneous grasping of both panels after folding, etc., may suffice.

Preferably, bottom forward-panel 108A and top panel 106 both share a substantially identical size and peripheral profile, as shown. More specifically, the lower peripheral profile 111A of bottom forward-panel 108A substantially matches the upper peripheral profile 111B of top panel 106, as shown. This preferred feature facilitates compact storage, efficient use of materials, as well as ease of manufacturing. Preferably, lower peripheral profile 111A and upper peripheral profile 111B are each structured and arranged to generally resemble a peripheral spine portion, a peripheral tail portion, and a peripheral bentside portion of the outer rim of a grand piano.

Figure 5:
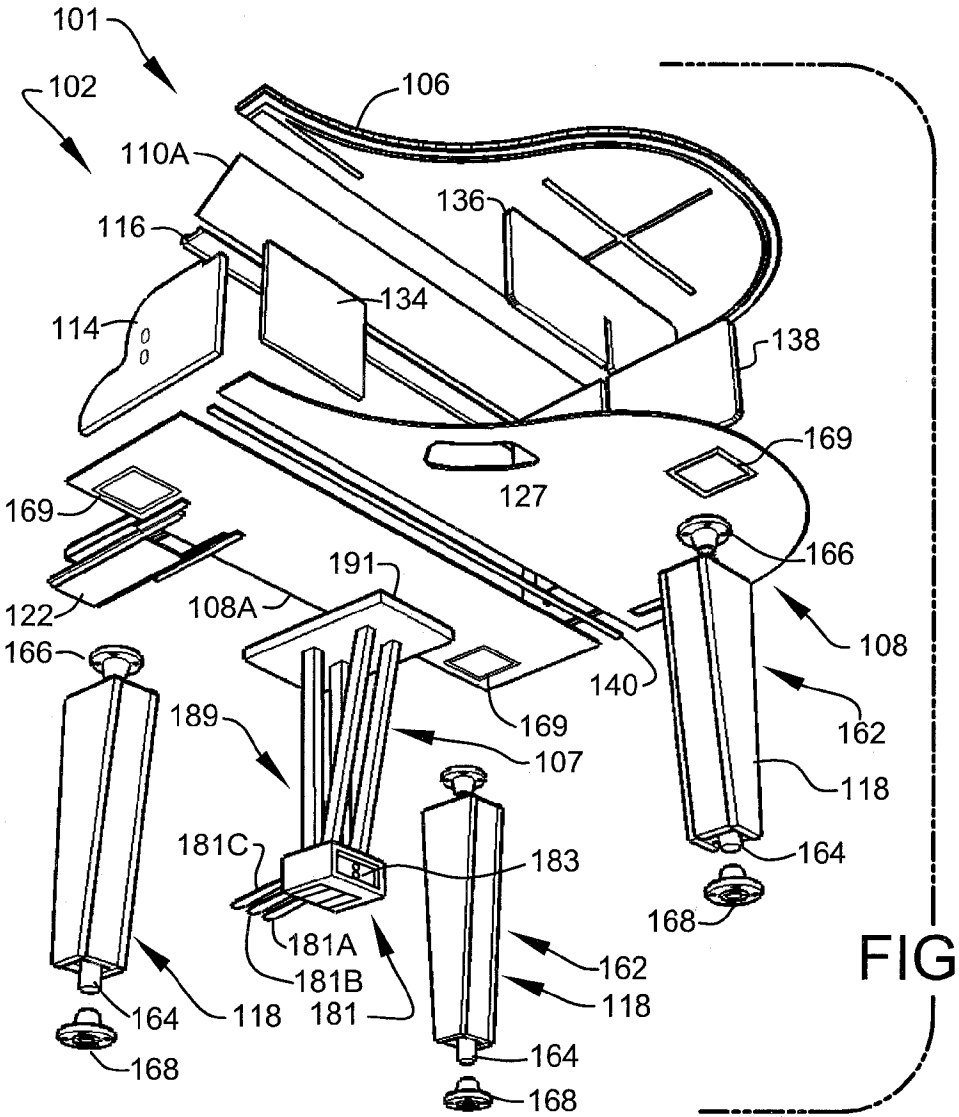
FIG. 5 shows an exploded perspective view illustrating the rear underside features of the portable piano assembly of FIG. 1.

FIG. 5 shows an exploded perspective view illustrating the rear underside features of portable piano assembly 102. Preferably, foot-pedal assembly 107 is adapted to removably mount to the underside of bottom panel 108, as shown. Preferably, foot-pedal assembly 107 comprises at least one foot-actuated switch assembly 181 providing foot-actuated electrical control of one or more electrically-operated hardware devices (lights, theatrical effects, etc.).

Preferably, foot-actuated switch assembly 181 comprises first switch pedal 181A (structured and arranged to simulate at least one una corda piano pedal), second switch pedal 181B (structured and arranged to simulate a sostenuto piano pedal), and a third switch pedal 181C (structured and arranged to simulate a sustain piano pedal), as shown. Preferably, foot-actuated switch assembly 181 is supported within pedal box 183, as shown. Preferably, pedal box 183 is adapted to rest on a supporting floor surface, as best illustrated in FIG. 13 and FIG. FIG. 20B. Preferably, a set of generally vertical support members 189 extend upwardly from pedal box 183 terminating at a generally planar mounting panel 191, as shown. Preferably, vertical support members 189 are structured and arranged to generally resemble at least one piano lyre of a grand piano, as shown.

In preferred embodiments utilizing a two-part foldable bottom panel 108, such as depicted in FIG. 5, foot-pedal assembly 107 is used as a secondary support-member to position and support both bottom forward panel 108A and bottom rear panel 108B from the adjacent floor surface (see also FIG. 13). Preferably, mounting panel 191 is mechanically fastened to bottom forward panel 108A and bottom rear panel 108B using removable fasteners. Support of the bottom panels by the adjacent floor surface is enabled by a distributed transfer of loads through mounting panel 191, vertical support members 189, and pedal box 183.

Figure 6:
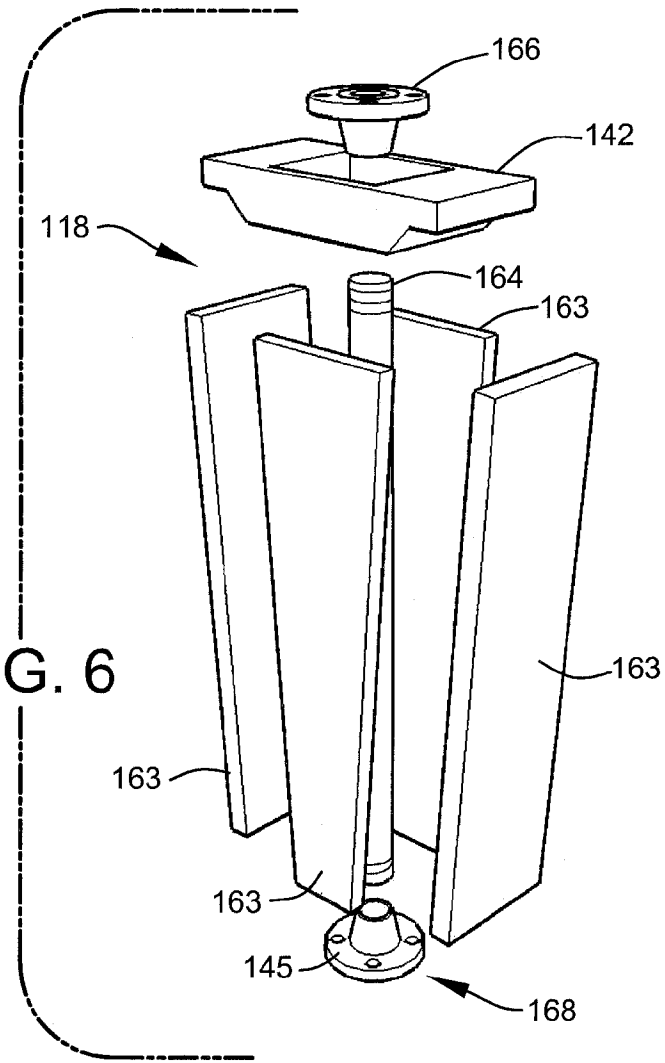
FIG. 6 shows an exploded perspective view illustrating a leg assembly of the portable piano assembly of FIG. 1.

FIG. 6 shows an exploded perspective view illustrating a single leg assembly 118 of portable piano assembly 102 of FIG. 1. Preferably, leg assembly 118 comprises four planar panels, preferably four tapered panels identified herein as tapered leg panels 163, as shown. Preferably, tapered leg panels 163 are permanently joined to form tapered leg box 162, as shown in FIG. 5. Preferably, leg box 162 is adapted to contain leg support column 164, most preferably a cylindrical pipe comprising threaded ends, as shown. Preferably, leg support column 164 is threadably joined with upper pipe flange 166, which is preferably mounted to the underside of modular piano case 104, as shown. Preferably, upper pipe flange 166 is centered within a boundary defined by leg receiving channel 169 and is permanently fastened to bottom panel 108 using appropriate mechanical fasteners.

In a preferred mounting of leg assembly 118 to modular case 104, a leg support column 164 is first threaded to upper pipe flange 166 until the column is firmly joined with the underside of bottom panel 108. Preferably, the internal cavity of a leg box 162 is then passed over leg support column 164 until the upper end of leg box 162 is engaged within leg receiving channel 169. Next, leg receiving channel 169 is threaded to the lower end of leg support column 164 until the flange portion 145 of lower pipe flange 168 is in firm contact with the lower end portion of leg box 162. Preferably, lower pipe flange 168 is adapted to compressively retain the upper portion of leg box 162 within receiving channel 169 when threaded to leg support column 164 (see also FIG. 13). Preferably, leg support column 164 is constructed from a substantially rigid and durable material, preferably a metallic material with the selection of an aluminum alloy being preferred for both cost and strength-to-weight characteristics.

In alternate preferred embodiments utilizing a single-piece bottom panel 108 (see concert grand assembly 102 of FIG. 9), a set of leg-receiving boxes 142 are substituted for the leg receiving channels 169, as shown. Preferably, leg-receiving box 142 is permanently mounted to the underside of bottom panel 108 and comprises an internal socket adapted to receive the upper end of leg box 162. Leg-receiving box 142 is preferably configured to resemble the decorative capital molding of a grand piano leg. Preferably, the steps of mounting leg support column 164, leg box 162, and lower pipe flange 168 to leg-receiving box 142 is substantially similar to the above-described method utilizing the leg receiving channels 169.

Upon reading the teachings of this specification, those of ordinary skill in the art will now understand that, under appropriate circumstances, considering such issues as intended use, location, uneven floor surfaces, etc., other leg assembly arrangements, such as, for example, leg assemblies that include height-adjustability and/or adjustable footers, etc., may suffice.

Figure 7:
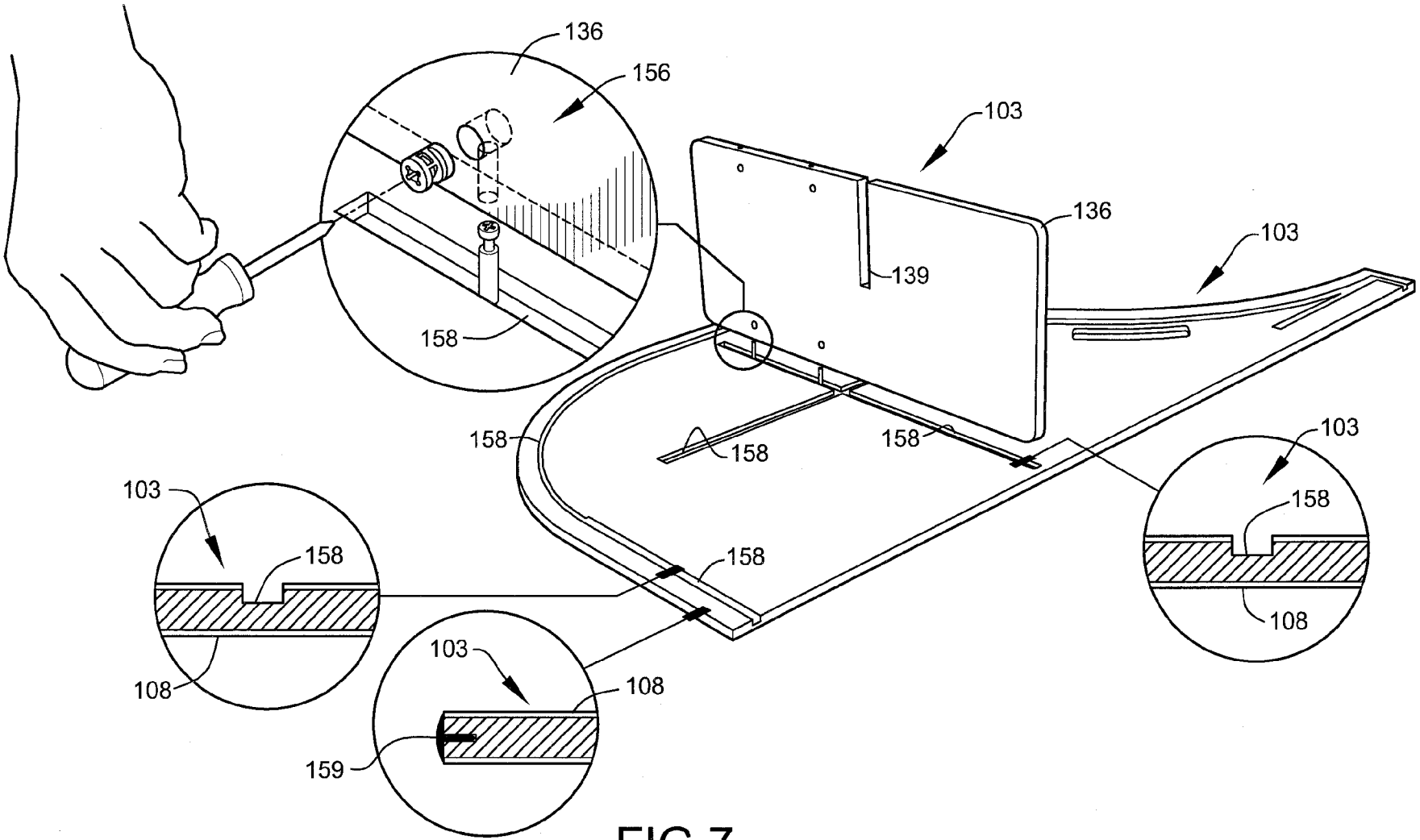
FIG. 7 shows an exploded view illustrating preferred assembly arrangements according to the preferred embodiment of FIG. 1.

FIG. 7 shows an exploded view illustrating preferred assembly arrangements according to the preferred embodiment of FIG. 1. In general, individual demountable panels of modular shell 104 are preferably joined by engagement within a system of recessed "dado" channels 158, as shown. Preferably, recessed dado channels 158 are machine routed within the panel faces, as shown. Preferably, the individual demountable panels are engaged within the recessed dado channels 158 at about a 90-degree orientation and are retained in position using a plurality of cam-and-post fastener assemblies 156, as shown. Cam-and-post fasteners suitable for use in cam-and-post fastener assemblies 156 include the "Minifix" line of fasteners produced by the Hafele Company of Archdale, N.C.

Preferably, surfaces of demountable components that are visibly exposed after assembly receive one or more decorative/protective finishes. Preferably, considering such issues as intended use, cost, etc., such decorative and or protective finishes may comprise plastic laminates, wood veneers, lacquered finishes, painted finishes, etc. T-molding 159 is preferably applied to exposed peripheral edges of exposed mountable components 103, as illustrated in the enlarged detail of FIG. 7. T-molding 159, so named because of its distinct T-shaped section, preferably comprises a continuous flexible trim material, most preferably a plastic. T-molding 159 is preferably retained within a continuous groove routed into the edge of the mountable component, as shown. T-molding suitable for use as T-molding 159 includes a range of commercially distributed products supplied through URL http://www.t-molding.com.

Figure 8:
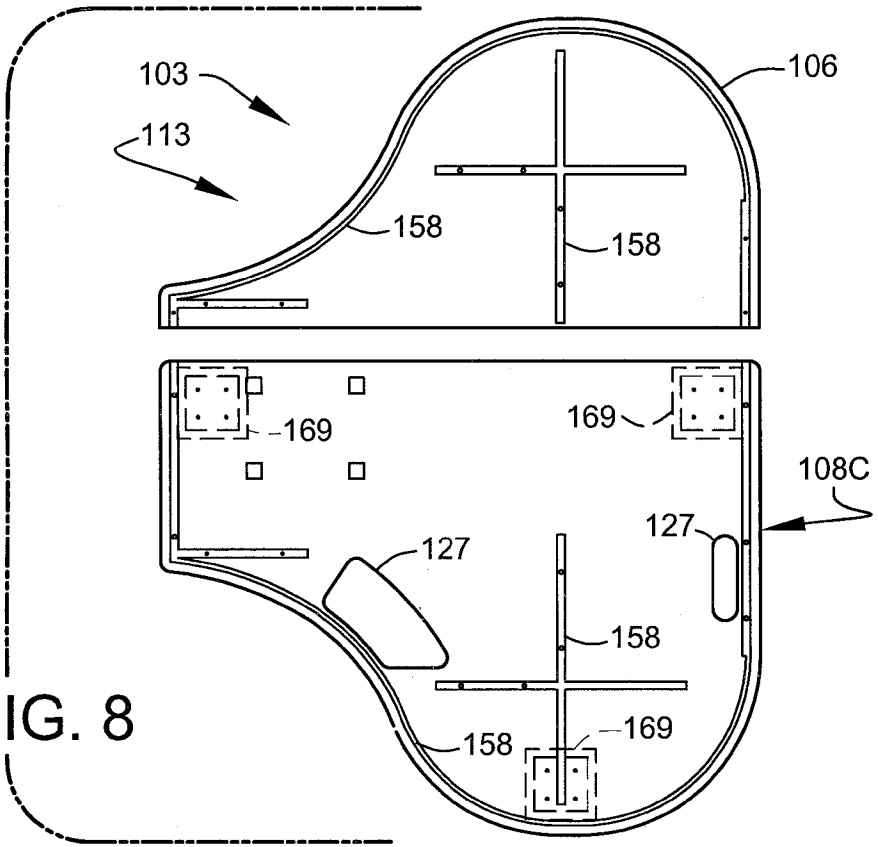
FIG. 8 shows a top view of a top panel and one-piece bottom panel used to construct a basic modular piano case according to an alternate preferred embodiment of the present invention.

FIG. 8 shows a top view of top panel 106 and a one-piece bottom panel 108C used to construct an alternate modular piano case 113 according to an alternate preferred embodiment of the present invention. To provide cost effective embodiments of mobile music entertainment system 100, it is sometimes preferred to supply the bottom panel as a one-piece unit, as shown. This allows a less costly modular piano case 113 to be produced utilizing the illustrated alternate bottom panel, in combination with substantially all of the remaining mountable components 103 described in the previous embodiment. Modular piano case 113 is especially useful to musical performers who require less frequent disassembly and transports of the system.

Figure 9:
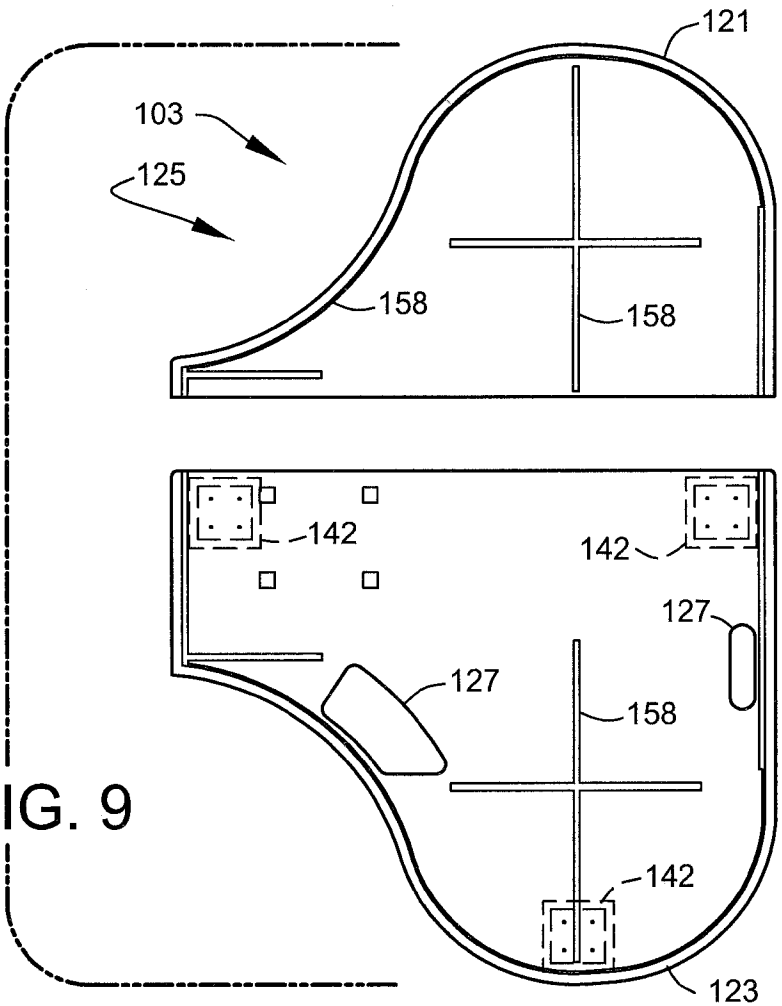
FIG. 9 shows a top view of a top panel and one-piece bottom panel used to construct a concert grand piano case according to another alternate preferred embodiment of the present invention.

FIG. 9 shows a top view of a concert-grand top panel 121 and a one-piece concert-grand bottom panel 123, as shown. Concert-grand top panel 121 and concert-grand bottom panel 123 are preferably used to construct concert-grand piano case 125 according to another alternate preferred embodiment of the present invention. In this preferred embodiment a number of mountable components 103 are modified to produce an outer assembly simulating the dramatic appearance of a large concert grand piano, as shown.

Demountable components 103 requiring length modification to produce concert-grand piano case 125 include the flexible outer side-panel, cross support panels, top panel 121, and bottom panel 123. Demountable components 103 of the concert-grand piano case 125 that require no modification and directly interchange with the prior embodiments include front board 110A, channel bar 116, first cheek-board 112, second cheek-board 114, keyboard drawer assembly 122, inner support panel 134, foot-pedal assembly 107, and the leg assemblies 118.

Figure 10:
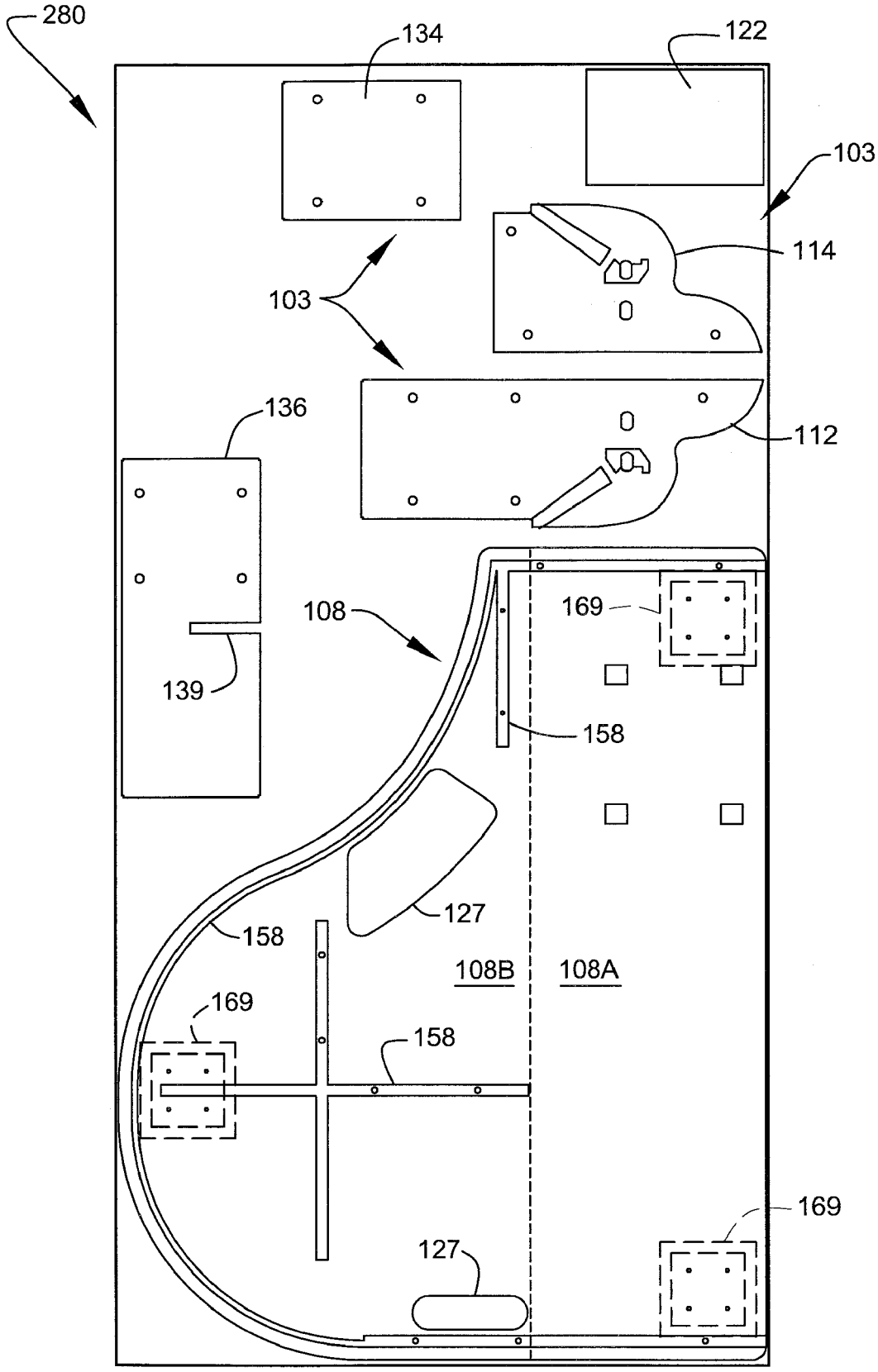
FIG. 10 shows a top view depicting a preferred component layout of a first sheet panel used to produce components of the preferred embodiment of FIG. 1.
Figure 11:
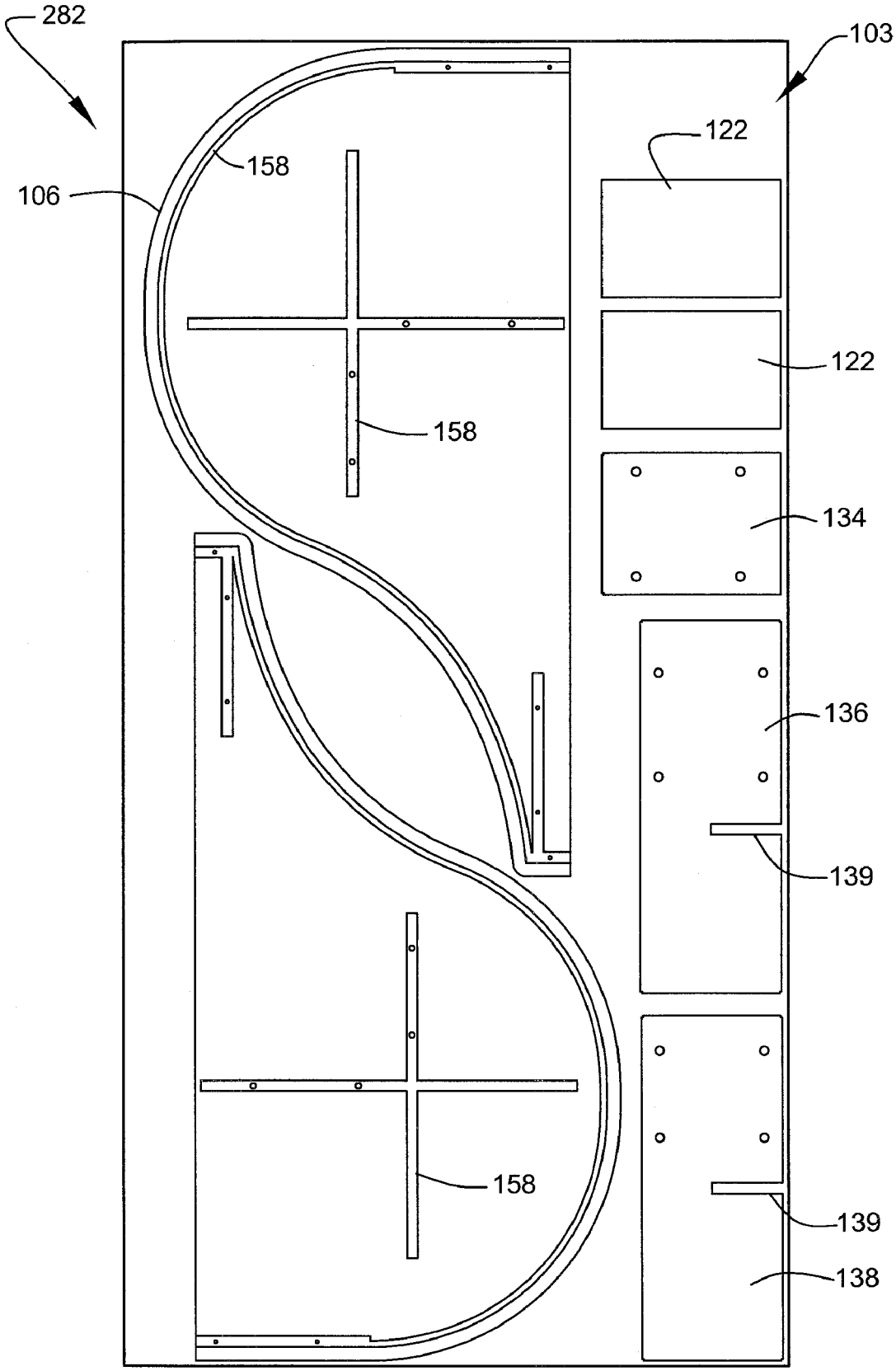
FIG. 11 shows a top view depicting a preferred component layout of a second sheet panel used to produce components of the preferred embodiment of FIG. 1.
Figure 12:
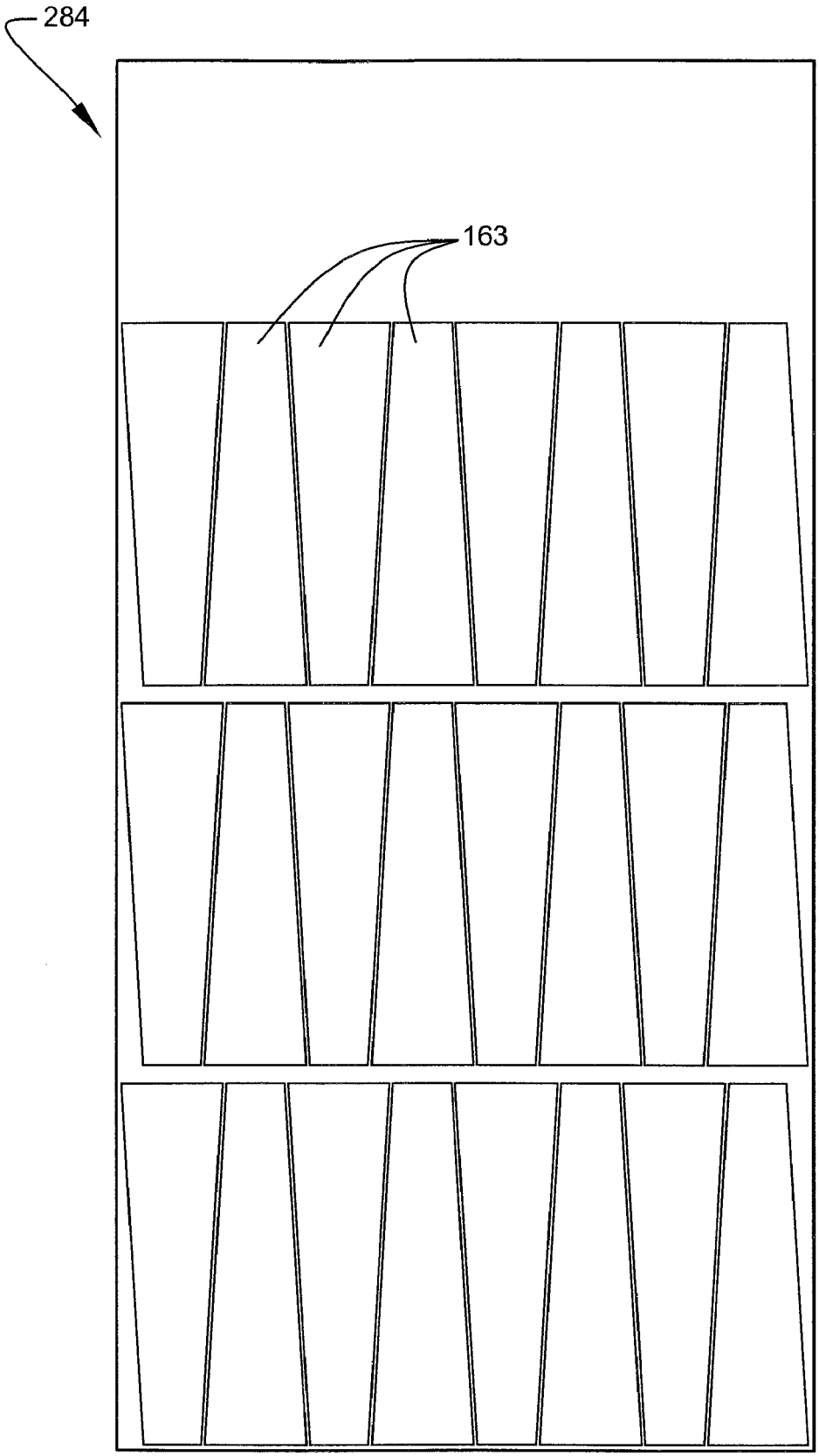
FIG. 12 shows a top view depicting a preferred component layout of a third sheet panel used to produce leg components of the preferred embodiment of FIG. 1.

FIG. 10 shows a top view depicting a preferred component layout of a first sheet panel 280 used to produce mountable components 103 of the preferred embodiment of FIG. 1. FIG. 11 shows a top view depicting a preferred component layout of a second sheet panel 282 used to produce mountable components 103 of the preferred embodiment of FIG. 1. FIG. 12 shows a top view depicting a preferred component layout of a third sheet panel 284 used to produce leg components tapered leg panels 163 of the preferred embodiment of FIG. 1.

For economy of construction, the sheet material of first sheet panel 280, second sheet panel 282, and third sheet panel 284 each comprise a standard 48 inch×96 inch nominal outside dimensional format. This allows the mountable components 103 to be fabricated from a wide range of commercially available construction grade products. Preferred products include rigid medium density fiber board, pressboard, and most preferably substantially rigid plywood products.

Preferably, first sheet panel 280 and second sheet panel 282 each comprise a nominal thickness of about ¾ inch. Preferably, third sheet panel 284 comprises a nominal thickness of about ½ inch. It should be noted that preferred sheet thickness are, to some extent, dependent on the properties of the selected sheet material. Thus, selection of a specific sheet material will sometimes dictate upsizing or downsizing of sheet thicknesses based on, for example, recommendations of the material manufacturer, accepted fabrication methods, structural support requirements, etc. To maximize the use of material, components to form more than one modular shell 104 are cut from a single panel, as shown.

Other panels having yet thinner sections are used to produce outer side-panel 120 (see FIG. 2). These panels may preferably comprise pressboard, alternately preferably thin plywood, or alternately preferably opaque and/or translucent plastics. Preferably, a flexible product marketed under the name "Kerfkore" is preferred when an opaque outer side-panel 120 is selected. "Kerfkore" is supplied by the Kerfkore Company of Brunswick, Ga. as a nominal 4foot×8 foot panel preferably comprising a thickness of about ½ inch. Preferred core materials include particleboard, alternately preferably MDF (medium density fiberboard), alternately preferably plywood, or alternately preferably a suitable Class A substrate. The rear face of the "Kerfkore" comprises a series of parallel cuts (kerfs) thus allowing the panel to form compound curves. Preferably, the opposite face of the "Kerfkore" material preferably receives an exposed finish such as the above-described plastic laminate.

FIG. 13 shows a sectional view through the section 13-13 of FIG. 1. FIG. 13 further illustrates the relationships between mountable components 103 within an assembled portable piano assembly 102. Leg assemblies 118 are shown resting on floor surface 129 in their preferred assembled engagement with the underside of bottom panel 108. Electronic piano device 105 is illustrated resting in a preferred playable position supported by bottom forward panel 108A. Centralized support structure 109 is shown firmly and structurally engaged with top panel 106 and bottom panel 108. Foot-pedal assembly 107 is shown in its preferred mounted position assisting support of bottom forward panel 108A and bottom rear panel 108B (while providing player access to foot-actuated switch assembly 181). Outer side-panel 120 is illustrated in a preferred engagement with upper and lower dado channels 158 running along the periphery of top panel 106 and bottom panel 108.

Preferably, front board 110A and channel bar 116 together form a unique front-panel closure assembly 234 within modular case 104. Preferably, front-panel closure assembly 234 is structured and arranged to provide at least partial closure of internal compartment 132, as shown. Preferably, channel bar 116 is structured and arranged to span horizontally from first cheek-board 112 to second cheek-board 114. Furthermore, channel bar 116 comprises a degree of vertical adjustment allowing it to lower to a position of rest over an upper surface of electronic piano device 105, as shown (at least embodying herein wherein such front-panel assembly comprises at least one front closure-panel structured and arranged to provide at least partial front closure of such at least one interior compartment, and at least one front support-bar structured and arranged to support such at least one front closure-panel in at least one operable position).

Figure 14:
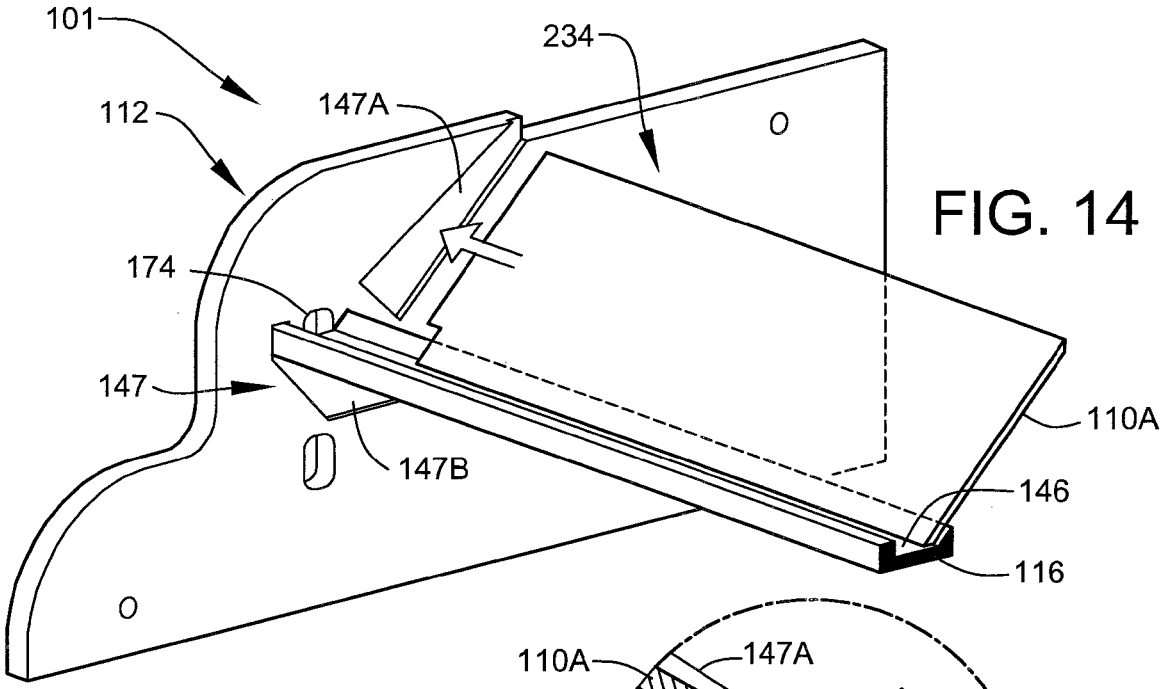
FIG. 14 shows a perspective view, in partial section, of a cheek panel of the preferred embodiment of FIG. 1.
Figure 15:
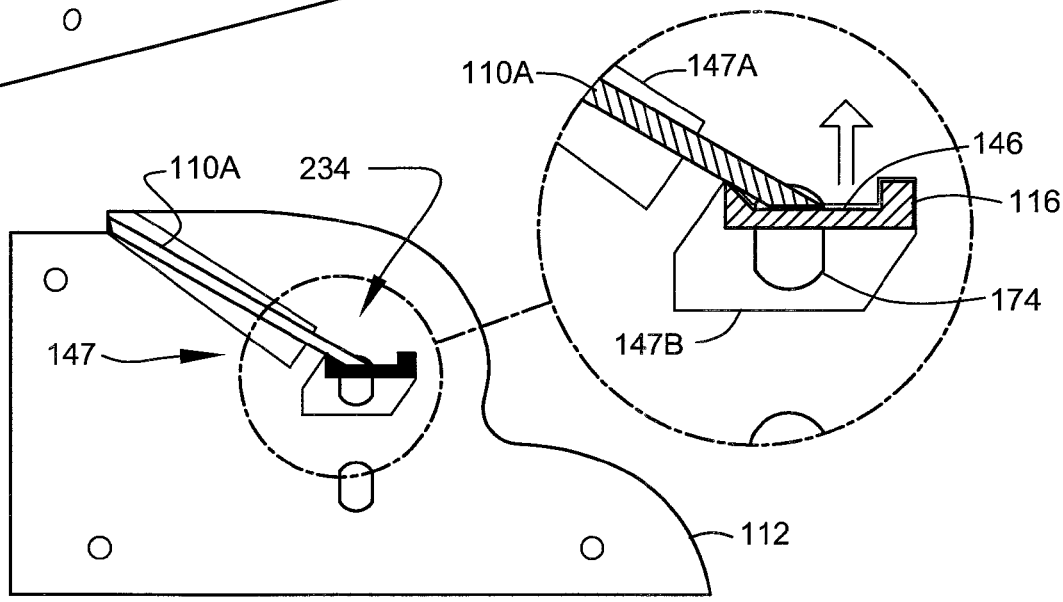
FIG. 15 and FIG. 16 show equivalent sectional diagrams illustrating the adjustability of the front board and channel bar of the preferred embodiment of FIG. 1.
Figure 16:
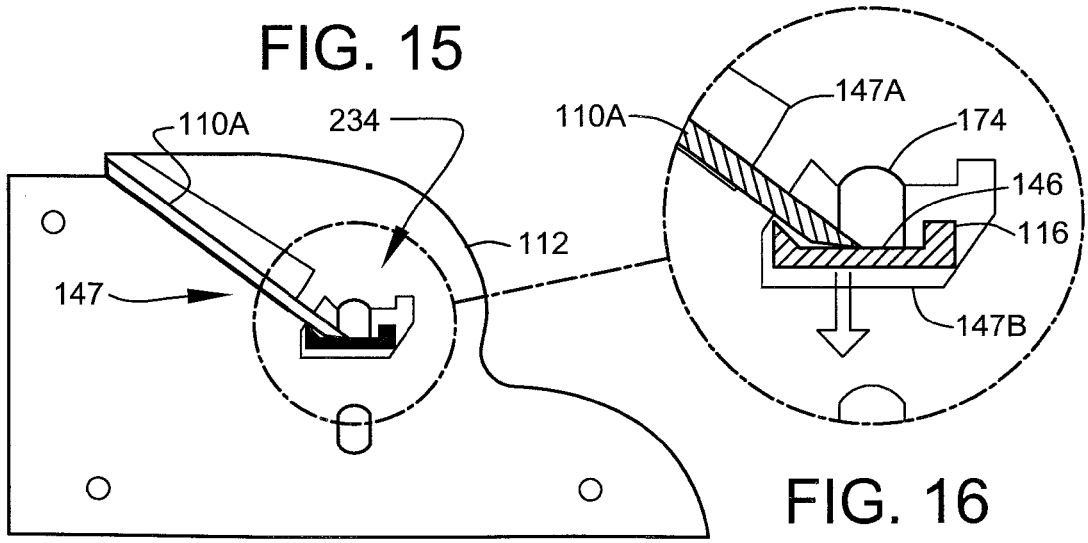

FIG. 14 shows a partial perspective view of second cheek-board 114 (a cheek panel of the preferred embodiment of FIG. 1). FIG. 15 and FIG. 16 show equivalent sectional diagrams illustrating the adjustability of front board 110A and channel bar 116 of front-panel closure assembly 234.

Reference is now made to FIG. 14 through FIG. 16 with continued reference to FIG. 13. It is also helpful to again note that an important feature of outer assembly 101 is the ability of the assembly to convincingly simulate the appearance of an acoustic piano. A key to achieving this goal is the level of concealment afforded by outer assembly 101 about electronic piano device 105. In general, the most convincing simulations require high levels of concealment about the electronic piano device. One method of achieving a high level of concealment is to custom fit outer assembly 101 about a specific electronic piano device 105. This approach has a number of drawbacks, the most significant drawback being the cost of custom fitting each piano case to a single one of the numerous models and brands of electronic piano devices. To overcome this problem, front-panel closure assembly 234 preferably comprises a novel adjustment feature providing a near custom fit between the piano housing and each one of a large number of electronic piano devices 105 mountable within portable piano assembly 102.

Preferably, front-panel closure assembly 234 functions as an adjustable concealment element structured and arranged to substantially conceal at least a substantial portion of the rear housing (non-keyboard portions) of electronic piano device 105. By preferably designing channel bar 116 and front board 110A with a degree of vertical adjustment, front-panel closure assembly 234 is preferably adapted to adjustably conform to the outer physical size of electronic piano device 105, as shown (at least embodying herein wherein the positions of such at least one front closure-panel and such at least one front support-bar are vertically adjustable relative to the at least one upper surface of the at least one electronic piano).

Preferably, both channel bar 116 and front board 110A are supported loosely within an opposing set of recessed pockets 147 formed within the keyboard-side faces of first cheek-board 112 and second cheek-board 114, as shown. Preferably, the recessed pockets 147 of first cheek-board 112 and second cheek-board 114 are symmetrically identical, as shown. Preferably, each recessed pocket 147 is divided into an upper recess 147A adapted to receive a distal end extension of front board 110A, as shown, and lower recess 147B adapted to receive a distal end of channel bar 116, as shown. FIG. 15 and FIG. 16 graphically illustrate the range if vertical adjustment afforded by the system. Preferably, both front board 110A and channel bar 116 are adapted to vertically translate a distance of at least about one inch. Preferably, upper recess 147A comprises an elongated fan shape that permits the lower end of front board 110A to move in a vertical sweep while maintaining the upper end of front board 110A closely adjacent top panel 106 (see FIG. 13). Upon reading the teachings of this specification, those of ordinary skill in the art will now understand that, under appropriate circumstances, considering such issues as intended use, cost, etc., other pivot arrangements, such as, for example, physically hinging a front board to a top panel, etc., may suffice. Also note that the rhombus-like shape of lower recess 147B is designed to maintain a generally consistent relationship between the lower contact line of front board 110A within channel bar 116 as the lower end of front board 110A moves vertically.

In summary, the distal ends of channel bar 116 and front board 110A are preferably engaged within recessed pockets of first cheek-board 112 and second cheek-board 114, as shown. Preferably, the recessed pockets are structured and arranged to allow both channel bar 116 and front board 110A a degree of vertical movement. In this way, front board 110A and channel bar 116 are free to rest in a position where the underside of channel bar 116 is supported on the upper surface of electronic piano device 105. This preferred arrangement automatically adjusts outer assembly 101 to fit many electronic piano devices 105 (of various heights) while concealing the non-traditional construction of the piano shell.

In addition to functioning as part of the adjustable concealer, channel bar 116 preferably functions as a support for books, sheet music, etc., and further comprises the unique function of preventing damage to electronic piano device 105 from spilled liquids. Spilled beverages are a surprisingly frequent problem for piano bar and dueling piano performers. Overly exuberant audience members, on being invited to the stage, often spill beverages on or within the vicinity of the keyboard.

Preferably, the upper side of channel bar 116 comprises continuous channel 146, as shown. Preferably, continuous channel 146 is structured and arranged to collect the spilled liquid before it drains to the piano device. Continuous channel 146 is preferably made to comprise a drainage slope equal to about 1/32 inch per foot. Beverages and similar liquids accidentally spilled within the channel are preferably directed to drain aperture 174, preferably extending through one of the cheek boards, preferably first cheek-board 112, as shown (at least embodying herein wherein such at least one cheek panel comprises at least one passage structured and arranged to pass the at least one spilled liquid from such at least one channel to a location outside such at least one piano-type case, wherein such at least one channel is further structured and arranged to assist in transferring the at least one spilled liquid to such at least one passage, and at least one of such at least one left cheek-panel and such at least one right cheek-panel comprises such at least one passage structured and arranged to pass the at least one spilled liquid to at least one location beyond such at least one appearance simulator).

Figure 17:
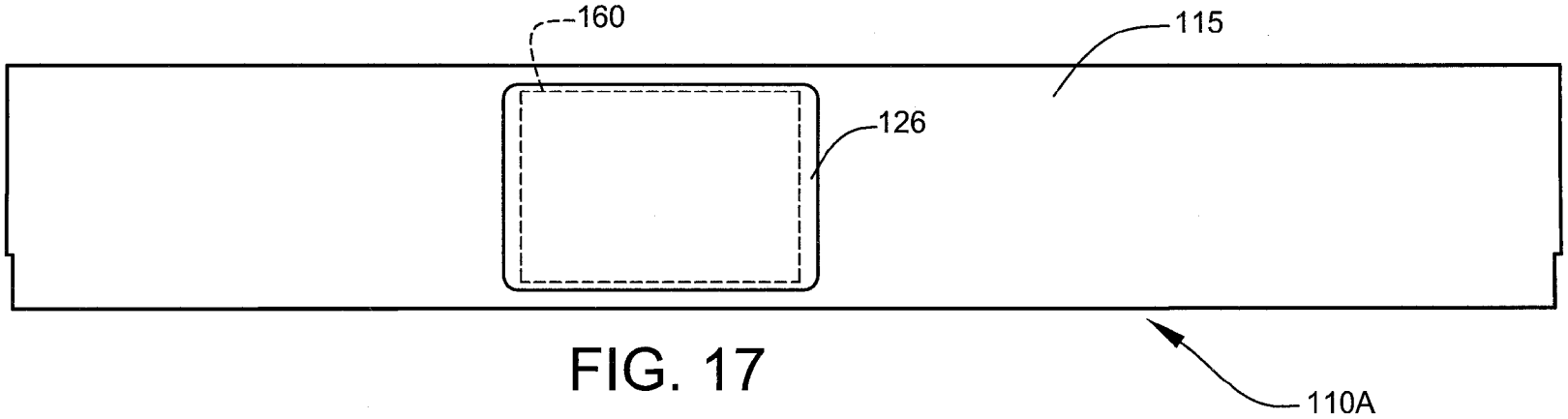
FIG. 17 shows a front view of the basic front board of the preferred embodiment of FIG. 1.

FIG. 17 shows a front view of the basic front board 110A of the preferred embodiment of FIG. 1. The basic preferred front board 110A, as depicted in FIG. 17, preferably comprises a single sheet of rigid material 115 preferably containing a clear window identified herein as transparent panel 126, as shown. Preferably, transparent panel 126 comprises a sheet of transparent plastic set within an opening of front board 110A, as shown. An enhanced embodiment of front board 110A is constructed from a combination of sheet plastic and wood-based panels, as described in FIG. 18A.

Alternately preferably, substantially the entire front board 110A is constructed from a sheet of transparent plastic. Preferably, the majority of the plastic is back-painted, to correspond to the finish of modular case 104, leaving transparent panel 126 unpainted to allow for transparent viewing of internal video display 160 (at least embodying herein wherein such at least one front closure-panel comprises at least one transparent panel-portion structured and arranged to assist viewing of at least one internal visual display by the at least one player).

Figure 18A:
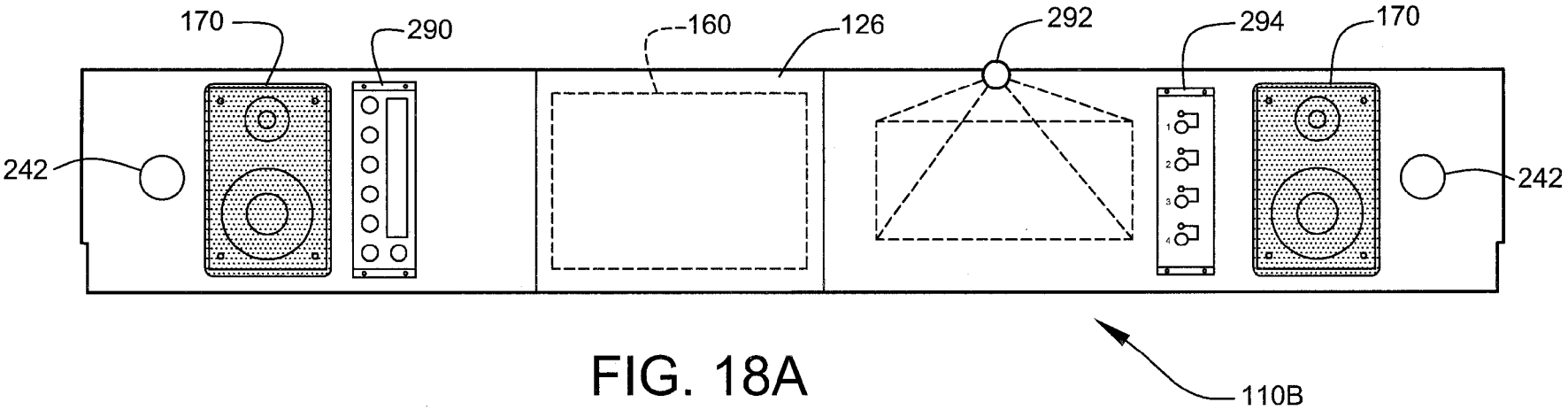
FIG. 18A shows a front view of an enhanced front board according to an alternate preferred embodiment of the present invention.
Figure 18B:
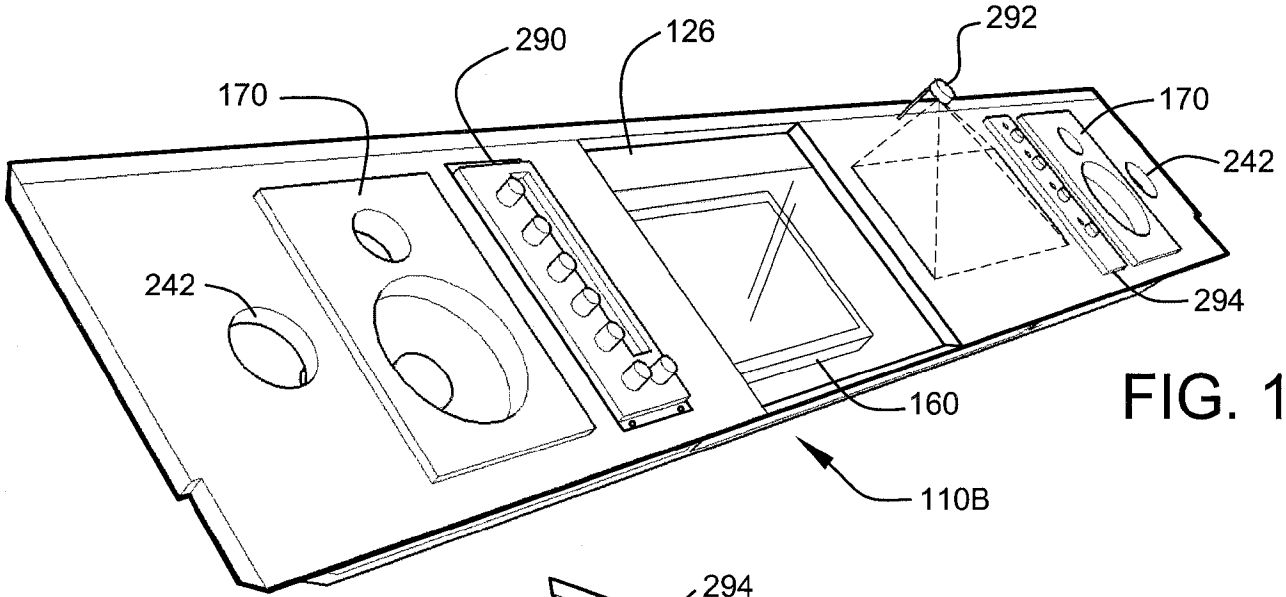
FIG. 18B shows a front perspective view of the enhanced front board of FIG. 18A.
Figure 18C:
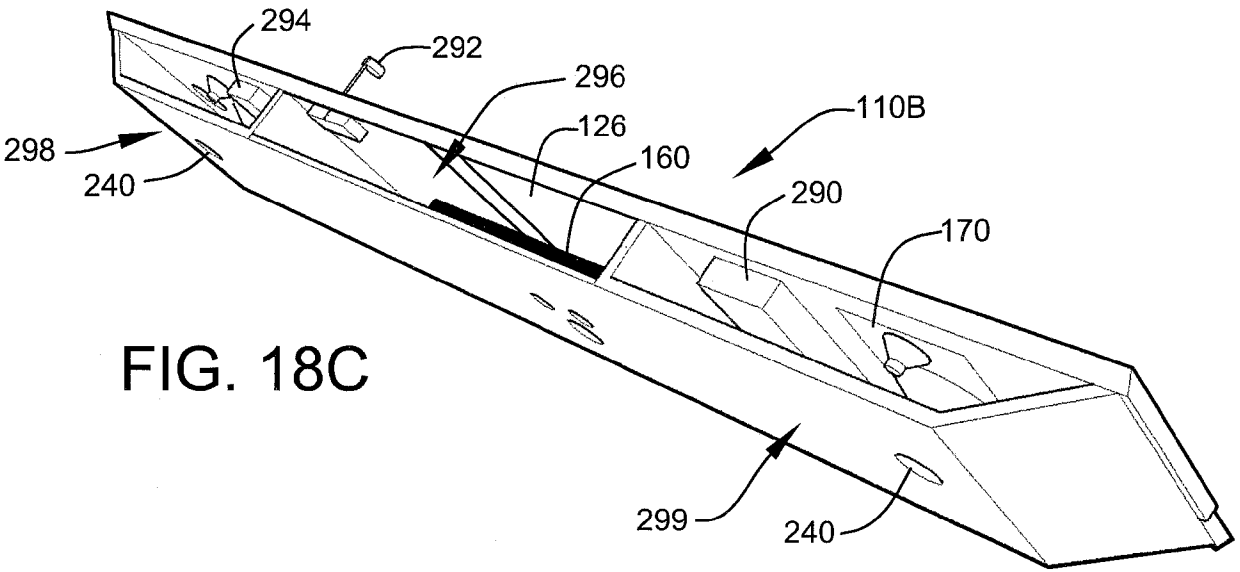
FIG. 18C shows a rear perspective view of the enhanced front board of FIG. 18A.

FIG. 18A shows a front view of enhanced front board 110B according to an alternate preferred embodiment of the present invention. FIG. 18B shows a front perspective view of the enhanced front board 110B of FIG. 18A. FIG. 18C shows a rear perspective view of the enhanced front board 110B of FIG. 18A. Preferably, enhanced front board 110B comprises a number of optional preferred components used to enhance the usefulness of electronic piano device 105 during a performance. These optionally preferred components preferably include, front monitor speakers 170, audio control unit 290, keyboard projection system 292, and a hardware controller unit of hardware controller system 294, as shown.

Preferably, the backside of front board 110B comprises a group of rear compartments, as best illustrated in FIG. 18C. Preferably, the rear central section of front board 110B comprises center compartment 296 preferably housing internal video display 160, as shown. Preferably, each side of center compartment 296 is flanked by side compartments identified herein as left speaker compartment 299 and right speaker compartment 298, as shown. Preferably, left speaker compartment 299 and right speaker compartment 298 each contain one front monitor speaker 170, preferably each speaker 170 is a two-way loudspeaker assembly, as shown. Preferably, left speaker compartment 299 additionally houses the rear chassis portion of audio control unit 290, as shown. Right speaker compartment 298 is preferably used to house the rear chassis portion of the hardware controller unit of hardware controller system 294. In the illustrated view of FIG. 18C, the top panels of left speaker compartment 299 and right speaker compartment 298 have been removed to show the internal components. Preferably, both left speaker compartment 299 and right speaker compartment 298 are substantially enclosed to improve acoustics and control airflow through the compartments, as described below. The interiors of both left speaker compartment 299 and right speaker compartment 298 may preferably comprise an applied layer of acoustic batting to acoustically increase the apparent volume of the compartments.

Preferred embodiments of left speaker compartment 299 and right speaker compartment 298 further comprise an air ducting system used to conduct filtered air between an air filtration unit located within internal compartment 132 and the area surrounding the player. Preferably, left speaker compartment 299 and right speaker compartment 298 each comprise an air input aperture 240 and an air output aperture 242, as shown. Both left speaker compartment 299 and right speaker compartment 298 function as air plenums passing filtered air between input aperture 240 and air output aperture 242, as shown (at least embodying herein wherein such at least one loudspeaker comprises at least one vent structured and arranged to vent the purified air generated by such at least one onboard air purifier; and at least one air conduit structured and arranged to conduct the purified air between such at least one air outlet and such at least one loudspeaker). Upon reading the teachings of this specification, those of ordinary skill in the art will now understand that, under appropriate circumstances, considering such issues as intended use, performer preference, etc., other filtering arrangements, such as, for example, providing a system that draws tobacco smoke through the front board for filtering/discharge, introducing air-treating compounds within the airstreams, etc., may suffice.

Preferably, audio control unit 290, and the hardware controller unit of hardware controller system 294 are each contained within a rack-mount-type enclosure, as shown. Thus, preferably, audio control unit 290, and the hardware controller unit of hardware controller system 294 are both removably mounted within the face of front board 110B using mounting arrangements substantially similar to the component mountings used for rack-mounted audio equipment or alternately preferably, aircraft avionics. Although a single audio control unit 290 and hardware controller unit are depicted in the present illustration, under appropriate circumstances additional control units may be accommodated within the width of the front board. Upon reading the teachings of this specification, those of ordinary skill in the art will now understand that, under appropriate circumstances, considering such issues as intended use, preferences of concealment, etc., other mounting arrangements, such as, for example, mounting the electronic devices behind concealment panels, behind operable doors, below the bottom panel, utilizing flush control surfaces to minimize visual impact on the front panel, color matching the controls to the piano housing, etc., may suffice.

Preferably, a standard qwerty-type computer keyboard 124 functions as a preferred user input to control the accessing of the database information on computer 150 (as shown and described in FIG. 19); alternately preferably, computer input by the user is enabled by keyboard projection system 292, as shown. Keyboard projection system 292 preferably comprises a virtual keyboard apparatus that preferably projects a fully functional "virtual" keyboard on the surface of front board 110B. The keyboard image is most often rendered by a laser or LED projection system. Keyboard projection system 292 detects the position and movements of the operator's fingers and translates the movements into keystrokes usable by an electronic device (computer 150). Keyboard projection system 292 also preferably functions as a virtual mouse. Keyboard projection system 292 preferably comprises at least one commercially available unit, such as, for example, commercial units manufactured by I-Tech Dynamic of Kwai Chung, New Territories Hong Kong. Preferably, front monitor speakers 170 (at least embodying herein at least one loudspeaker structured and arranged to produce at least one audible sound wave) are located and/or directionally arranged to focus sound to the player of electronic piano device 105, as shown.

Figure 19:
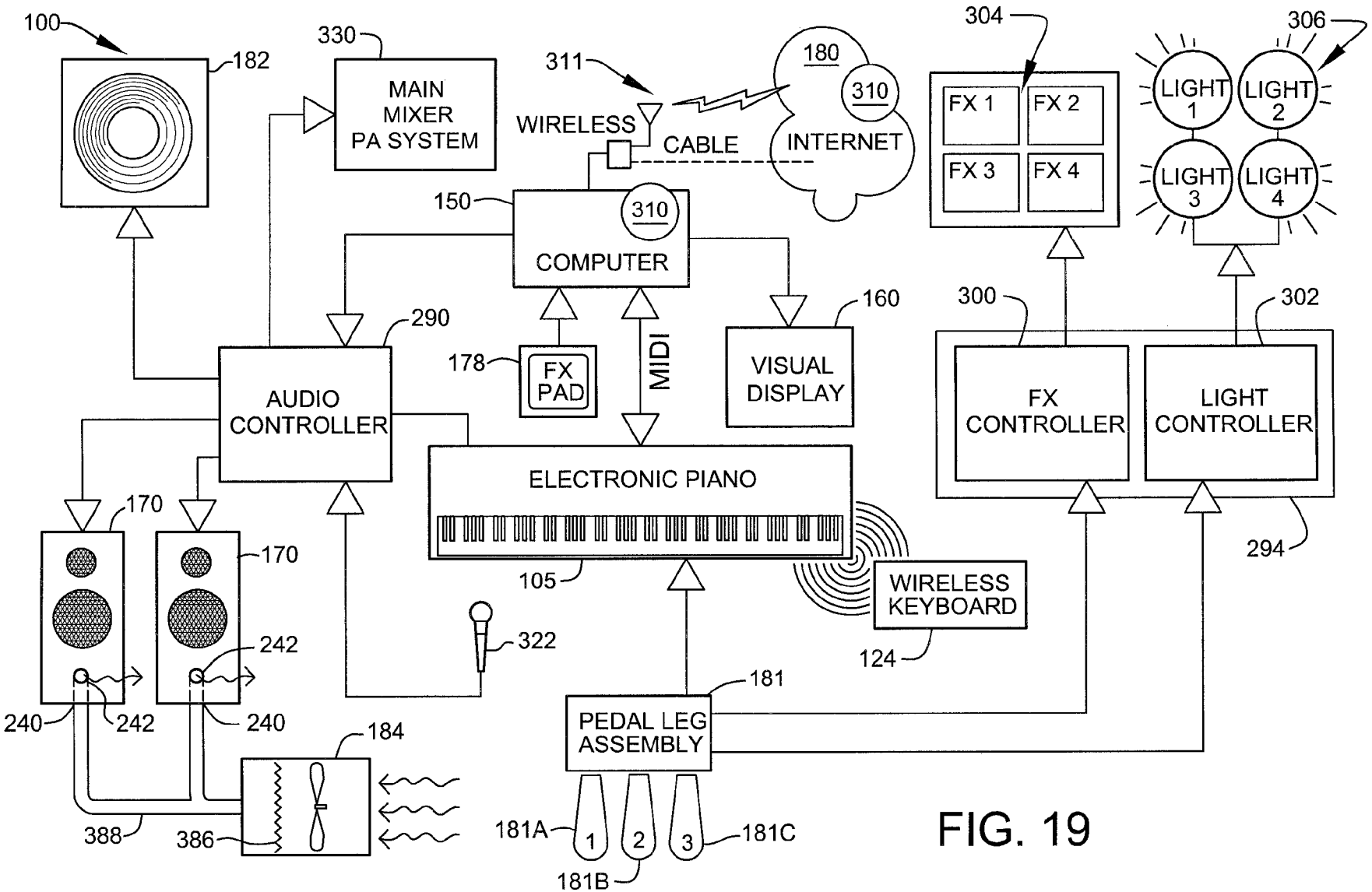
FIG. 19 shows a block diagram generally illustrating preferred electrical component arrangements of the portable piano assembly of FIG. 1.

FIG. 19 shows a block diagram generally illustrating preferred electrical component arrangements of the modular piano assembly of FIG. 1. Mobile music entertainment system 100 preferably comprises a range of interlinked internal and external electronic components adapted to enhance the operation of portable piano assembly 102. At least one preferred component arrangement includes: electronic piano device 105, computer 150, audio control unit 290, foot-actuated switch assembly 181, keyboard 124, internal video display 160, front monitor speakers 170, sub woofer 182, air purifier 184, first hardware controller 300, second hardware controller 302 (both of hardware controller system 294), theatrical special-effects hardware 304, theatrical lighting effects hardware 306, and sound-effects pad 178.

Central to the electrical component arrangements of the portable piano assembly is electronic piano device 105, as shown. Preferably, electronic piano device 105 is electrically coupled to at least audio control unit 290, foot-actuated switch assembly 181, and computer 150 via a MIDI (Musical Instrument Digital Interface) link, as shown.

Computer 150 of mobile music entertainment system 100 preferably comprises at least one internal data processor. Preferably, computer 150 is structured and arranged to process music-related data contained within at least one music-related database 310, as shown. Music-related database 310 preferably comprises at least one index of music-related data searchable by computer 150. This music-related data preferably comprises a wide range of content including digital copies of sheet music, lyrics, musical trivia, arrangements, entertainment data, etc.

Computer 150 is preferably used to deliver the music-related data derived from music-related database 310 to a player during his or her performance. Music-related data generated by computer 150 is preferably displayed on internal video display 160, as shown (at least embodying herein at least one visual display structured and arranged to visually display at least one output of such music-related data by such at least one data processor). Keyboard 124 (or alternately keyboard projection system 292) preferably functions as a user input to control the accessing of the database information on computer 150 (at least embodying herein at least one player input system structured and arranged to assist player-generated inputs to such at least one data processor). Upon reading the teachings of this specification, those of ordinary skill in the art will now understand that, under appropriate circumstances, considering such issues as intended use, user preference, etc., other user interface/input arrangements, such as touch-sensitive devices, voice-recognition devices, mice, light pens, trackballs, motion-sensing devices, hand-actuated switches, and/or foot-actuated switches, etc., may suffice. Preferably, the selected user interfaces preferably allows the player to quickly query, recall, and display many thousands of songs and song arrangements contained within database 310.

The internal data processor of computer 150 preferably utilizes well-known logic structures such as registers for arithmetic operation, address control registers, stack pointers, instruction registers, instruction decoders, etc. Preferably, the internal data processor is electrically coupled with peripheral circuits by means of internal address and data buses using standard means. Computer 150 preferably comprises an assembly of PC-type hardware components. Preferably, computer 150 further comprises software programming adapted to operate the computer and peripherals, local software programming enabling interactions with music-related database 310, and preferably comprises at least one MIDI port interoperable with electronic piano device 105 and sound-effects pad 178, as shown.

Computer 150 preferably comprises at least one mass storage memory containing music-related database 310 (at least embodying herein at least one onboard data-storage device structured and arranged to provide onboard storage of the at least one database). Alternately, most or substantially the entire music-related database 310 is located on at least one remote server that is accessible through a private or public network such as Internet 180. In this preferred arrangement, computer 150 is adapted to access Internet 180 via network connection 311 utilizing, for example, a dedicated high-speed line, a conventional modem, or a variety of other wired and wireless network devices, as shown. Internet 180 comprises a global network connecting local and regional networks and computers, public and private. Internet 180 is the preferable connection method of linking computer 150 to a remotely located music-related database 310 in preferred embodiments of the present invention. Preferably, network connection 311 is structured and arranged to support at least one client-server process supporting at least one transfer of the music-related data between computer 150 and the remote server containing music-related database 310.

Preferably, foot-actuated switch assembly 181 comprises third switch pedal 181C structured and arranged to simulate a customary sustain piano pedal (damper or loud pedal), as shown. Preferably, third switch pedal 181C is operationally coupled with electronic piano device 105 and preferably functions as sustain control during playing. Upon reading the teachings of this specification, those of ordinary skill in the art will now understand that, under appropriate circumstances, considering such issues as intended use, user preference, etc., other third pedal arrangements, such as providing an alternate audio effect, an additional visual effects trigger, etc., may suffice. First switch pedal 181A and second switch pedal 181B are electrically coupled to first hardware controller 300 and/or second hardware controller 302, as briefly described below and in greater detail in FIG. 20A.

Preferably, first hardware controller 300 and second hardware controller 302 interoperate with foot-actuated switch assembly 181 to control the operation of theatrical special-effects hardware 304 and theatrical lighting effects hardware 306, respectively. Upon reading the teachings of this specification, those of ordinary skill in the art will now understand that, under appropriate circumstances, considering such issues as intended use, cost, equipment selection, etc., other control arrangements, such as, for example, utilizing the onboard computer to control the operation of the hardware controllers, etc., may suffice.

Audio control unit 290 preferably controls the stream of audio signals produced by mobile music entertainment system 100. Upon reading the teachings of this specification, those of ordinary skill in the art will now understand that, under appropriate circumstances, considering such issues as intended use, cost, equipment selection, etc., other control arrangements, such as, for example, utilizing the onboard computer to supplement the control and operation of the audio control unit, etc., may suffice. The specific structures and arrangements of audio control unit 290 are covered further in FIG. 21.

Figure 20A:
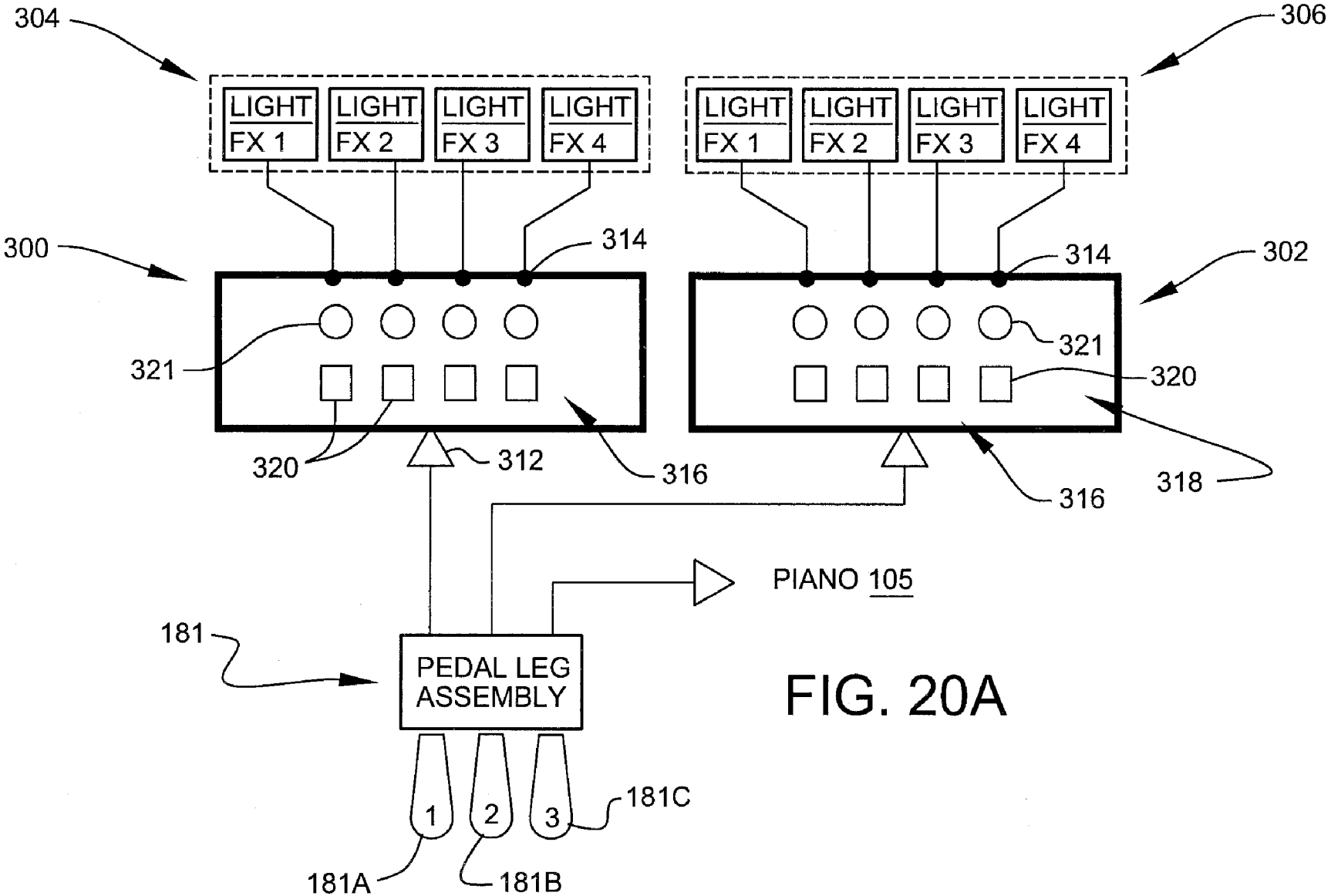
FIG. 20A shows a block diagram generally illustrating preferred electrical component arrangements of a foot control unit of the portable piano assembly of FIG. 1.

Mobile music entertainment system 100 preferably comprises a unique hardware controller arrangement that operates in conjunction with foot-actuated switch assembly 181. FIG. 20A shows a block diagram generally illustrating preferred electrical component arrangements of foot-actuated switch assembly 181, first hardware controller 300, and second hardware controller 302 of the modular piano assembly of FIG. 1. Mobile music entertainment system 100 preferably supports the use of a variety of theatrical hardware devices used to enhance the piano performance.

As previously described, third switch pedal 181C is operationally coupled with electronic piano device 105 and preferably functions as a standard sustain control during playing. First switch pedal 181A and second switch pedal 181B are electrically coupled to first hardware controller 300 and second hardware controller 302 and are used to trigger one or more theatrical hardware devices (at least embodying herein wherein such at least one third switch pedal is structured and arranged to assist musical control of the at least one electronic piano and such at least one first switch pedal and such at least one second switch pedal are each structured and arranged to provide at least one trigger signal usable to trigger the at least one electrically-operated hardware device). Preferably, the operation and physical structures of first hardware controller 300 and second hardware controller 302 are substantially similar. The following teachings shall include descriptions covering both the units.

First hardware controller 300 preferably comprises input port 312 structured and arranged to receive a trigger signal generated by first switch pedal 181A. Preferably, first hardware controller 300 comprises at least one output port 314, more preferably four separately operable output ports 314, each one structured and arranged to output at least one control signal usable to control an electrically-operated hardware device. In the present example, the electrically-operated hardware devices comprise four theatrical lighting effects identified herein as theatrical lighting effects hardware 306. Theatrical lighting effects hardware 306 may preferably comprise strobes, lasers, video projectors, marquee-type lights, LED illumination, general illumination, etc.

First hardware controller 300 preferably comprises at least one internal signal processor 316 structured and arranged to control at least one operational relationship between the receiving of a trigger signal at input port 312 and the output of a control signal by one of the output ports 314. More specifically, internal signal processor 316 comprises selector system 318 adapted to allow a user to pre-select which and how many of the output ports 314 will generate an output signal on receipt of the input signal at input port 312 (at least embodying herein at least one selectable enabler structured and arranged to allow independently selectable enablement of each one of such at least four output ports). This preferred feature permits the user to preset one or all output ports 314 to an "enabled (ready-standby) mode". Preferably, each of the theatrical lighting effects hardware, coupled to an output port in "enabled-mode", is triggered by a single actuation of first switch pedal 181A.

A preferred user interface arrangement of selector system 318 comprises a dedicated switch 320 for each output port 314 electrically coupled with an indicator light 321 to indicate the enabled status of the associated port (and may preferably be incorporated into switch 320). Upon reading the teachings of this specification, those of ordinary skill in the art will now understand that, under appropriate circumstances, considering such issues as intended use, cost, etc., other user interface arrangements, such as, for example, providing a two-position switch having a first position initiating a single trigger event (disabling the output port until the user initiates a reset) and a second position setting the port to automatically repeat the sending of an output signal on each subsequent signals received at the input port, or utilizing computer addressable switches to programmatically set and enabled mode condition, etc., may suffice.

Structures, arrangements, and operational characteristics of second hardware controller 302 are substantially similar to those of first hardware controller 300, as described above. The only important difference between the two controllers comprises the electrically coupling of input port 312 of second hardware controller 302 to second switch pedal 181B.

Control implementation of both first hardware controller 300, and second hardware controller 302 is accomplished under at least to two preferred methods. In the first preferred method, the output signal of output port 314 comprises a low-voltage trigger signal that is coupled to the low-voltage trigger circuit of the effects hardware. Under this preferred method, the effects hardware is powered independently of the control signal.

In the second preferred implementation method, the output signal of output port 314 is supplied at line voltage (the operating voltage of the effects hardware). Under this alternate preferred approach; selector system 318 comprises a series of internal control relays adapted to trigger the hardware devices by directly supplying full operating voltage at output ports 314. The advantage of this method lies in its universal applicability wherein output ports 314 may preferably comprise standard plug-in-type electrical outlets. A preferred embodiment of the second preferred implementation method preferably utilizes a Middle Atlantic model PD915R rack-mount power strip equipped with 8 rear outlets (Middle Atlantic of Fairfield, N.J.). Preferably, the power strip is modified to comprise one or more relay boards, preferably used to control the line voltage supplied to outlets of the power strip. A Velleman model K2633 relay card (Velleman Inc. of Fort Worth, Tex.), preferably comprising four line-voltage relay modules, is preferably used to control electrical power to four of the eight rear outlets. Preferably, the individual switches 320 are wired in-line with the foot-actuated switch assembly 181 and thus provide the user with a means for setting each of the four outlets in a ready condition for trigger by foot pedals. Preferably, switches 320 comprise a set of single pole, single throw on/off-type switches electrically coupled to the relay card by low-voltage wiring. Preferably, the relay card is powered by a 9 Volt DC power-supply board tied to the line voltage of the unit. Upon reading the teachings of this specification, those of ordinary skill in the art will now understand that, under appropriate circumstances, considering such issues as intended use, user preference, etc., other trigger arrangements, such as utilizing hand-actuated momentary contact buttons to trigger the relays, using additional relay boards to allow control of additional outlets, etc., may suffice.

Figure 20B:
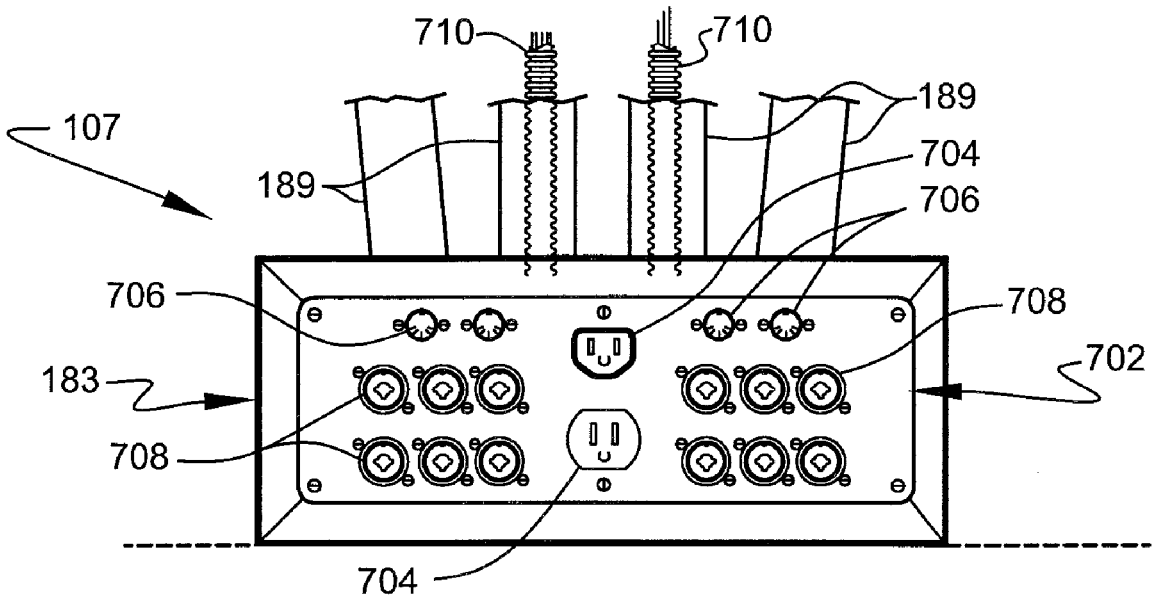
FIG. 20B shows a rear view of a pedal box of the foot control unit (foot-actuated switch assembly) of the portable piano assembly of FIG. 1.
Figure 20C:
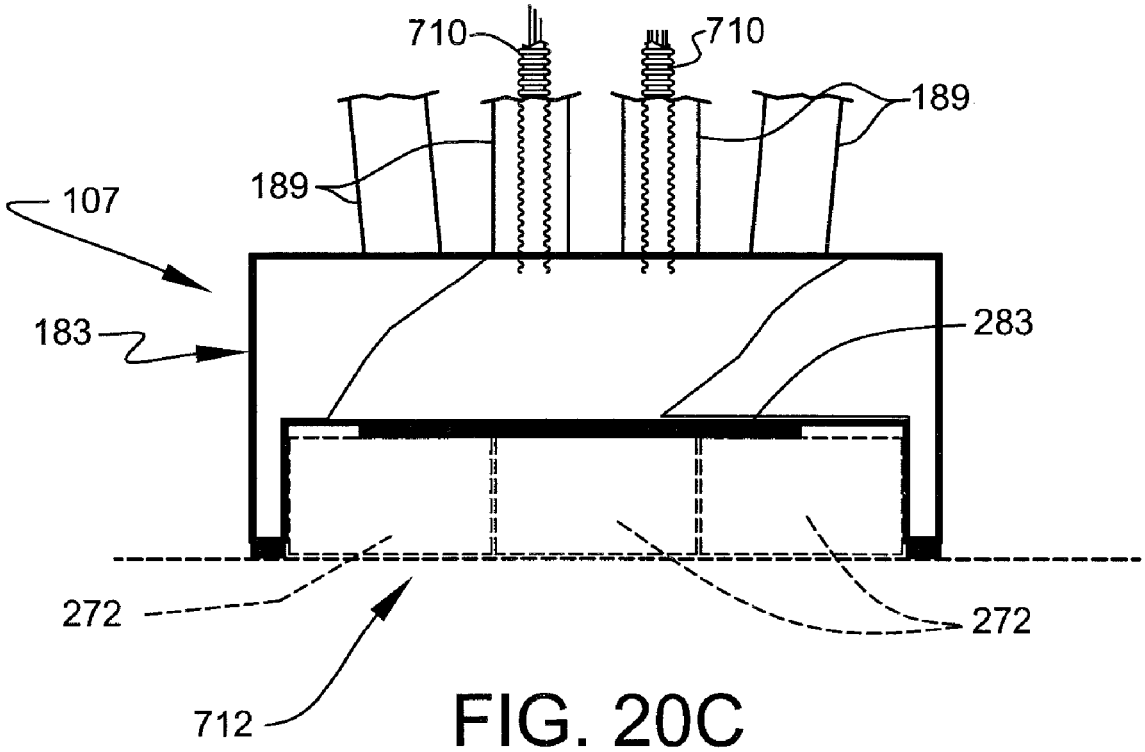
FIG. 20C shows a rear view of the pedal box of the foot control unit of FIG. 20B.

FIG. 20B shows a rear view of pedal box 183 of foot-actuated switch assembly 181 of portable piano assembly 102 of FIG. 1. FIG. 20C shows a rear view of pedal box 183 of foot-actuated switch assembly 181 of FIG. 20B. Preferably, essentially all wiring entering and leaving portable piano assembly 102 is preferably routed through foot-pedal assembly 107. Preferably, the rear portion of pedal box 183 preferably comprises connector panel 702 comprising a plurality of power, audio, and computer connectors, as shown. Connector panel 702 preferably comprises power connectors 704, computer interface connectors 706, and multipurpose connectors 708, as shown. Preferably, power connectors 704 support power input for portable piano assembly 102 and preferably provide a point of accessory power, as shown. Preferably, computer interface connectors 706 comprise at least one industry-standard electronic interface connector, more preferably a set standard MIDI connectors, as shown. Physically, each MIDI connector preferably comprises a DIN (Deutsches Institut für Normung) 5/180° connector, as shown. Upon reading the teachings of this specification, those of ordinary skill in the art will now understand that, under appropriate circumstances, considering such issues as intended use, advances in technology, etc., other computer interface/protocol arrangements, such as industry-standard network interfaces, universal serial bus (USB) interfaces, FireWire interfaces, etc., may suffice. Preferably, multipurpose connectors 708 function to supply audio, low-voltage control signals, etc. Preferably, multipurpose connectors 708 comprise Neutrik-type "combo" jacks that accept both XLR and ¼" TS or TRS plugs, as shown.

Preferably, electrical wiring 710 is routed from pedal box 183 to internal compartment 132 through support members 189, as shown. Preferably, electrical wiring 710 passes through mounting panel 191 and terminates at an appropriate connector/electrical coupler located within internal compartment 132.

Figure 45A:
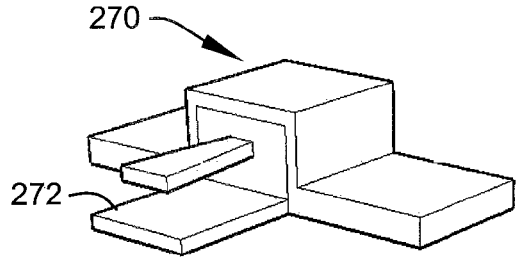
FIG. 45A and FIG. 45B show front perspective views illustrating a foot pedal restrainer of the mobile music entertainment system according to another preferred embodiment of the present invention.
Figure 45B:
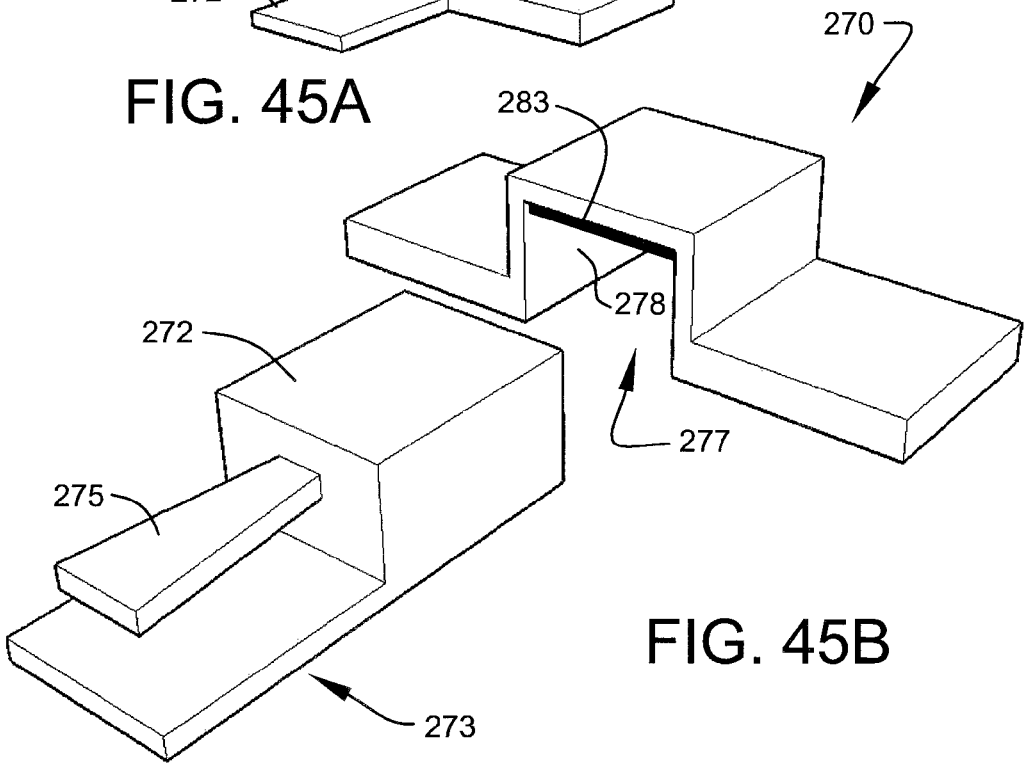
Figure 45C:
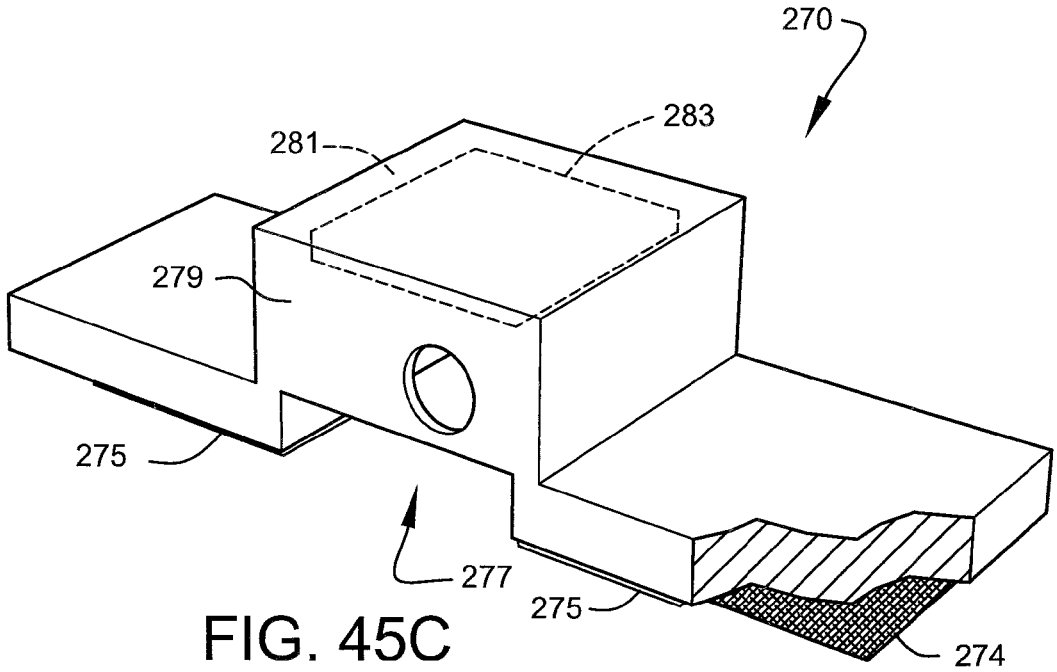
FIG. 45C shows a rear perspective view illustrating the foot pedal restrainer of FIG. 32A and FIG. 32B.

Preferably, pedal box 183 comprises front internal pedal bay 712 preferably adapted to fit over the electronic foot controls 272 of foot-actuated switch assembly 181, as shown. Preferably, pedal box 183 assists in maintaining electronic foot control 272 in a constant position on the supporting floor surface by the weight of the piano system. Electronic foot controls of the type illustrated herein generally comprise, for example, a sustain control pedal of a musical keyboard, such as, an M-Audio SP-2 or Yamaha FC4 piano style sustain pedal. Preferably, front internal pedal bay 712 comprises a four-sided box-like pocket having two generally opposing side walls, a rear wall, and an upper wall 714. Preferably, a resilient pad 283 is applied to the upper wall 714 to assist in maintaining a continuous force-transferring frictional connection between pedal box 183 and the electronic foot controls 272. FIG. 45A through FIG. 45C preferably describes a related preferred embodiment containing additional enabling information relating to preferred means for positioning and restraint of foot-actuated switch assembly 181.

Figure 21:
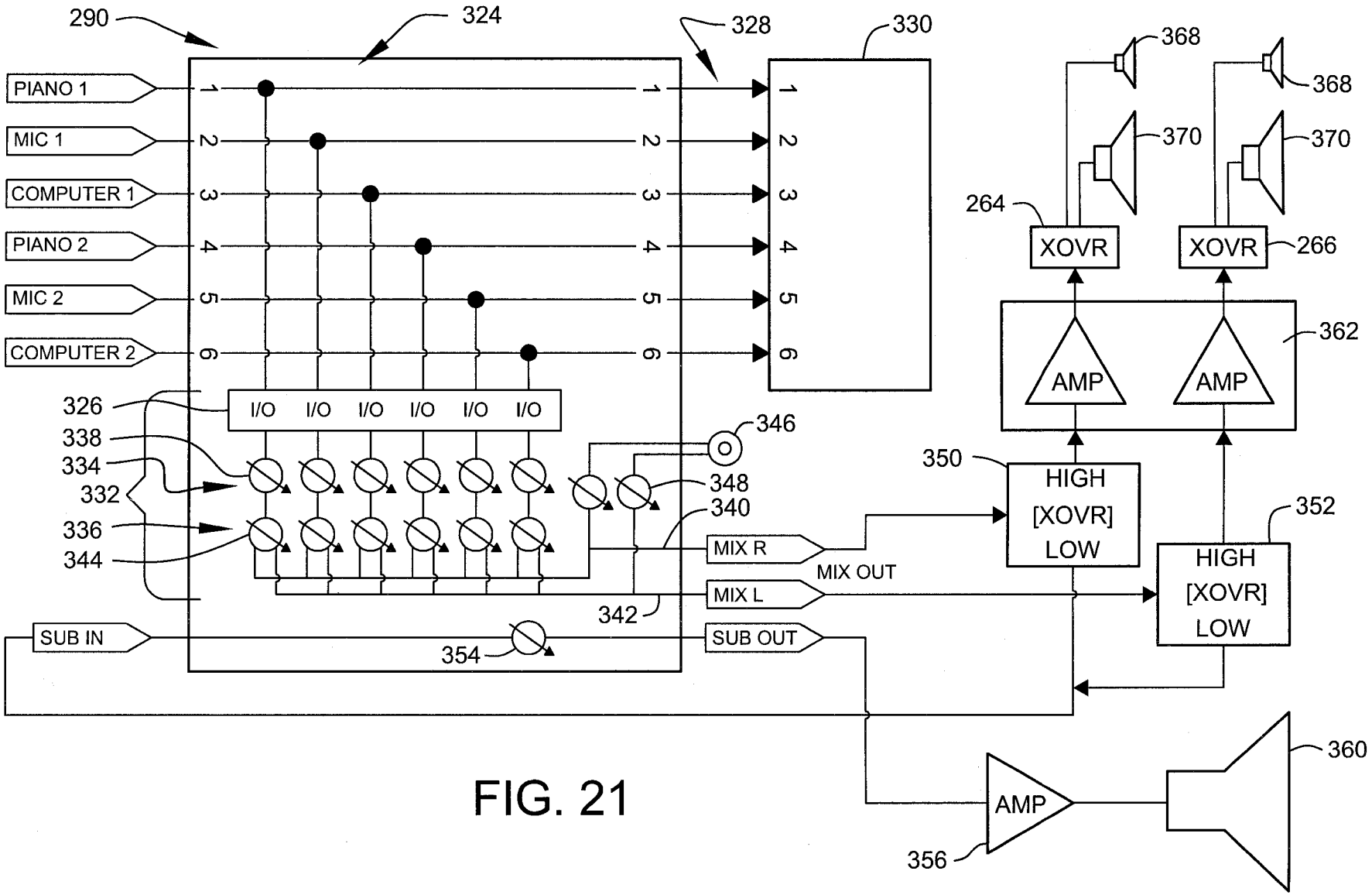
FIG. 21 shows a block diagram generally illustrating preferred electrical component arrangements of an on-board audio controller of the portable piano assembly of FIG. 1.

FIG. 21 shows a block diagram generally illustrating preferred electrical component arrangements of an on-board audio control unit 290 of portable piano assembly 102 of FIG. 1.

As previously noted, audio control unit 290 is structured and arranged to control the audio input and audio output of at least one mobile music entertainment system 100. Audio control unit 290 is most preferably adapted to contemporaneously control audio inputs from two portable piano assemblies 102, such as may be used in a "dueling-piano" performance. During such a "dueling-piano" performance, it is important that both players clearly hear their own performances as well as that of the partner player. Audio control unit 290 is preferably adapted to output a user adjustable audio mix, using the combined audio inputs of the two portable piano assemblies 102.

Preferably, each audio control unit 290 comprises six audio input ports identified herein as PIANO 1, MIC 1, COMPUTER 1, PIANO 2, MIC 2, and COMPUTER 2, as shown. Preferably, each of the six audio input ports are structured and arranged to receive at least one electronic audio signal from an electronic audio source. For example, PIANO 1 receives audio input from the user's own electronic piano device 105 while the PIANO 2 port receives audio input from a partner's electronic piano device 105. Similarly, MIC 1 receives audio input from the user's own microphone 322 (see FIG. 19) while MIC 2 receives audio input from the partner's microphone 322. Lastly, COMPUTER 1 and COMPUTER 2 receive audio signals originating from the audio card of the user's onboard computer 150 and partner's onboard computer 150, respectively.

Preferably, PIANO 1, MIC 1, COMPUTER 1, PIANO 2, MIC 2, and COMPUTER 2, are each electrically coupled to one of six dedicated audio channels within audio divider circuit 324, as shown. Preferably, audio divider circuit 324 is structured and arranged to divide each of the incoming signals to produce six secondary electronic audio signals, as shown. Preferably, the six secondary signals are routed to a primary audio processing circuit 332 comprising audio equalizer 326, level adjustment section 334, and pan adjustment section 336, as shown. Audio processing circuit 332 is preferably adapted to output a tertiary audio signal comprising a user adjusted mix of the incoming audio signals (at least embodying herein at least one first audio-processor circuit structured and arranged to process the at least one second electronic audio signal to produce at least one third electronic audio signal; and at least embodying herein at least one audio-processor circuit structured and arranged to process each one of the at least six secondary electronic audio signals to produce at least six post-processed electronic audio signals).

Preferably, audio divider circuit 324 further comprises a direct audio pass-through adapted to pass the original six unaltered signals to six individual output ports identified herein as split outputs 328, as shown (at least embodying herein at least one audio output structured and arranged to output the at least one first electronic audio signal substantially without signal processing). The unaltered audio signals can be routed from split outputs 328 to the PA mixing console 330 of a main stage sound system, as shown.

Preferably, audio equalizer 326 of primary audio processing circuit 332 is adapted to provide user adjustment of signal levels of different bands (or frequencies ranges) within each of the six secondary electronic audio signals. Audio equalizer 326 preferably comprises a plurality of audio filters, each filter providing linear cutiboost control over a fixed frequency range within the six secondary electronic audio signals. The number of filters preferably utilized within each audio channel of audio equalizer 326 ranges from three (low, mid, high) to over eleven.

After passing through audio equalizer 326 (at least embodying herein at least one frequency adjuster structured and arranged to adjust at least one signal level within at least one frequency range of the at least one second electronic audio signal; and further embodying herein at least one frequency-band adjuster structured and arranged to adjust at least one signal level within at least one frequency band within each of the at least six secondary electronic audio signals), the six frequency-adjusted audio signals pass through level (volume) adjustment section 334, as shown. Preferably, level adjustment section 334 comprises a plurality of electrical potentiometers 338 used to adjust the signal levels for each of the six audio signals exiting audio equalizer 326, as shown. Preferably, a single user adjustable electrical potentiometer 338 is coupled inline with each of the six audio channels, as shown (at least embodying herein at least one first signal-level adjuster structured and arranged to adjust at least one overall signal level of each one of the at least six secondary electronic audio signals).

Preferably, the six level-adjusted audio channels are combined to form a multi-channel output, most preferably two composite "mixed" signal channels comprising right mixed channel 340 and left mixed channel 342. The combining of the six level-adjusted audio signals preferably occurs within pan adjustment section 336, as shown. Pan adjustment section 336 preferably comprises a second bank of potentiometers, this time comprising six pan-type potentiometers 344, as shown. Preferably, a single pan-type potentiometer 344 receives one of the six audio signals exiting level adjustment section 334 and splits the signal between right mixed channel 340 and left mixed channel 342. Preferably, the level of the signals applied to right mixed channel 340 and left mixed channel 342 are controllable by user adjustments of pan-type potentiometers 344. During user adjustment of pan-type potentiometers 344, the sum of the voltage levels applied to right mixed channel 340 and left mixed channel 342 remains substantially constant as the signal is "panned" from one channel to the other (at least embodying herein at least one signal-combining circuit structured and arranged to combine at least two of the at least six post-processed electronic audio signals to produce at least one composite multi-channel audio signal; wherein at least one signal-combining circuit comprises at least one second signal-level adjuster structured and arranged to contemporaneously adjust at least one signal level of at least one first audio channel and at least one second audio channel of the at least one composite multi-channel electronic audio signal; and wherein during such contemporaneous signal-level adjustment, the sum of the signal levels of the at least one first audio channel and the at least one second audio channel is held substantially constant)

Preferably, the composite audio signals of right mixed channel 340 and left mixed channel 342 are output from audio control unit 290 at two output ports identified herein as MIX R and MIX L, respectively (at least embodying herein at least one composite audio output structured and arranged to output the at least one composite multi-channel electronic audio signal). In addition, the mixed audio signals of right mixed channel 340 and left mixed channel 342 are also routed to headphone output 346, as shown. Preferably, the signal level at headphone output 346 is independently adjustable through the use of inline level adjusting potentiometers 348, as shown.

Preferably, from the output ports MIX R and MIX L, the right and left composite audio signals are each routed to a frequency-divider, identified herein as crossover 350 and crossover 352, as shown. Preferably, crossover 350 and crossover 352 are structured and arranged to divide the right and left composite audio signals into an upper-frequency signal and a low-frequency signal; Preferably, the low-frequency signal outputs from crossover 350 and crossover 352 are combined to form a single composite low-frequency signal that is returned to a low-frequency audio input port of audio control unit 290 identified herein as SUB IN. Preferably, the composite low-frequency signal input at SUB IN passes through level adjusting potentiometers 354 (at least embodying herein at least one low-frequency signal-level adjuster) before being directed to an output port identified herein as SUB OUT. In a preferred configuration, the composite low-frequency signal from SUB OUT is passed through powered audio amplifier 356 where the composite low-frequency signal is amplified before delivery to a low-frequency loudspeaker identified herein as subwoofer driver 360, as shown. Subwoofer driver 360 preferably converts the amplified signal to audible sound waves (at least embodying herein at least one low-frequency loudspeaker structured and arranged to convert the at least one lower-frequency signal to at least one audible sound wave). Subwoofer driver 360 preferably comprises a power capacity generally matching the output levels of powered audio amplifier 356. In preferred embodiments of the present invention, subwoofer driver 360 comprises an 18-inch diameter loudspeaker comprising long-throw acoustic-suspension construction.

Preferably, the right and left upper-frequency signals output from crossover 350 and crossover 352 are routed along individual channels to a second powered amplifier identified herein as monitor amplifier 362, as shown. Preferably, monitor amplifier 362 comprises at least two amplification channels structured and arranged to amplify both the right and left upper-frequency signals, as shown.

From monitor amplifier 362 the amplified right and left upper-frequency signals are routed to right and left monitor speakers 170, as shown. Right and left monitor speakers 170 are preferably mounted within front board 110B, as described in FIG. 18B. Preferably, right and left monitor speakers 170 are of a two-way design containing two independent loudspeakers each having a separate optional operational frequency range. Preferably, both monitor speakers 170 comprise a high-frequency loudspeaker identified herein as tweeter 368, and a mid-frequency loudspeaker identified herein as midrange driver 370, as shown.

Preferably, right and left monitor speakers 170 each comprise a second frequency-divider identified herein as right monitor crossover 264 and left monitor crossover 266. Preferably, right monitor crossover 264 divides the right upper-frequency signal into at least one upper-frequency band and at least one lower-frequency band. Similarly, left monitor crossover 266 divides the left upper-frequency signal into at least one upper-frequency band and at least one lower-frequency band. Within each monitor speaker 170, the audio signal of the upper-frequency band is coupled to tweeter 368 and the audio signal of lower-frequency band is coupled to midrange driver 370, as shown.

All input and output ports of audio control unit 290 preferably comprise industry standard audio hardware formats (for example, input ports PIANO 1, MIC 1, COMPUTER 1, PIANO 2, MIC 2, and COMPUTER 2 each comprise ¼-inch XLR-type connectors).

Figure 22:
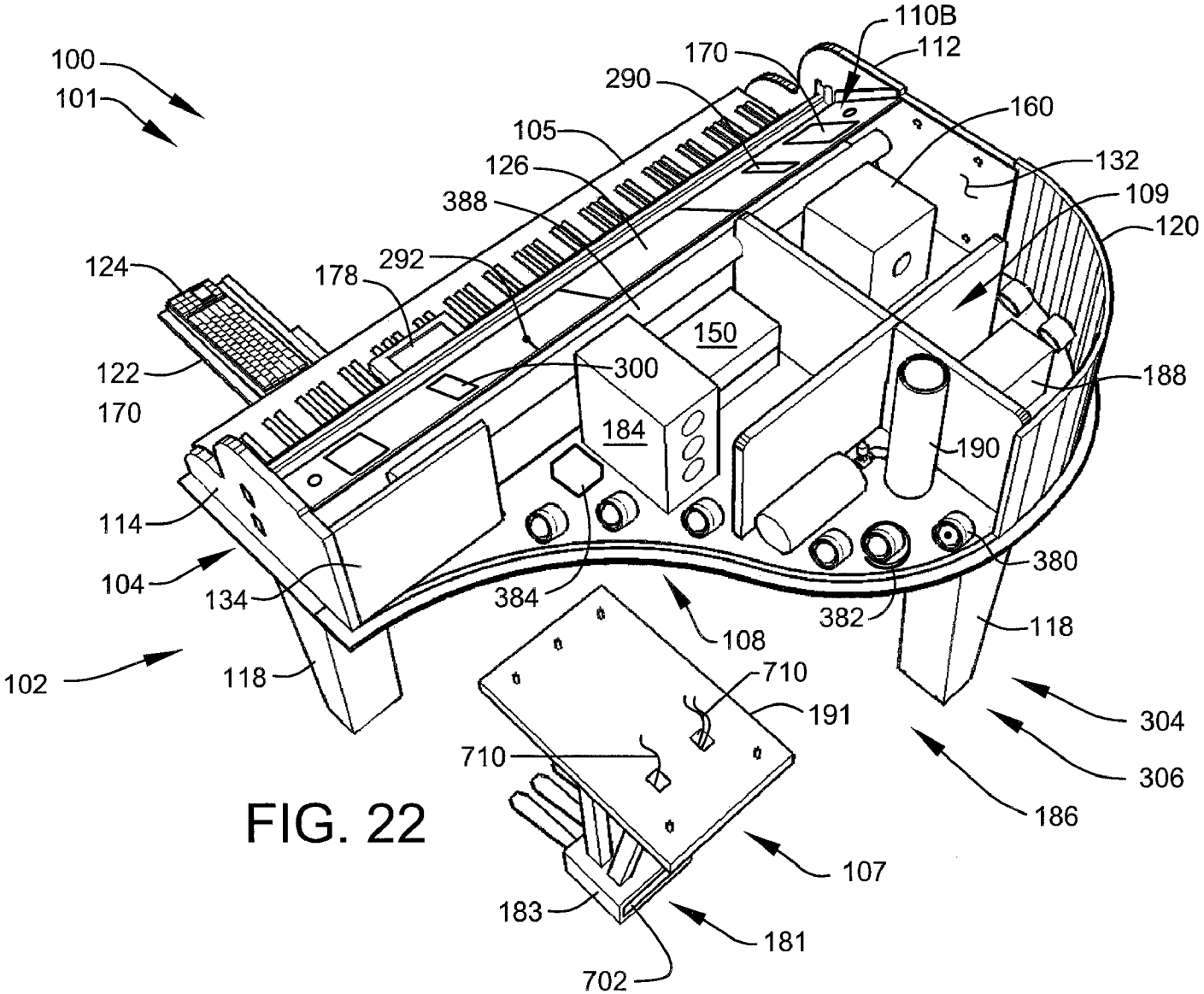
FIG. 22 shows a perspective view, in partial cut-away, illustrating example arrangements of preferred components of the modular piano assembly of FIG. 1, according to preferred embodiments of the present invention.

FIG. 22 shows a perspective view, in partial cut-away, illustrating preferred example arrangements of theatrical special-effects hardware 304 and theatrical lighting effects hardware 306 within modular case 104 of portable piano assembly 102 of FIG. 1. In the view of FIG. 22, top panel 106 and a portion of outer side-panel 120 have been omitted from the illustration for clarity. In addition, foot-pedal assembly 107 is shown detached from bottom panel 108.

Portable piano assembly 102 preferably comprises many options for mounted placement of theatrical special-effects hardware 304 and theatrical lighting effects hardware 306 within modular case 104. The relatively large and open interior of internal compartment 132 allows for mounting of custom hardware installations, as shown.

In the preferred example arrangement of FIG. 22, theatrical special-effects hardware 304 comprises fog machine 188 and confetti cannon 190, as shown. Preferably, fog machine 188 is mounted to bottom panel 108 and discharges through an aperture in bottom panel 108. Confetti cannon 190 is also preferably mounted to bottom panel 108 and discharges through an aperture in top panel 106 (omitted from the view). Preferably, both fog machine 188 and confetti cannon 190 are electrically coupled to output ports 314 of first hardware controller 300 and are triggered by foot-actuated switch assembly 181. Upon reading the teachings of this specification, those of ordinary skill in the art will now understand that, under appropriate circumstances, considering such issues as intended use, cost, etc., other special-effects hardware arrangements, such as, for example, electrically-triggered pyrotechnics, pop-up props, mechanically-actuated props, etc., may suffice.

Preferably, theatrical lighting effects hardware 306 are mounted to mountable components 103 within the interior of modular case 104 and preferably comprise internal lighting assembly 186, strobe light 380, spinning-light effect 382, and laser projector 384, as shown. Preferably, each of the lighting effects are electrically coupled to output ports 314 of second hardware controller 302 and are triggered by foot-actuated switch assembly 181. Adjustable mounting assemblies allow the hardware position to be adjusted to achieve specific lighting effects.

Preferred embodiments of portable piano assembly 102 comprise one or more translucent panels. For example, a dramatic lighting effect is preferably achieved by locating a plurality of lighting assembly 186 within internal compartment 132, and constructing outer side-panel 120 from a translucent material such as frosted plastic. For example, a ⅛" thick bronze-glazed acrylic panel appears essentially black in color when front lit, but takes on an attractive translucency when backlit by lighting assembly 186. Preferably, the plurality of lighting assemblies 186 are triggered by theatrical lighting effects hardware 306 to produce a variety of light patterns on the outer surfaces of modular shell 104. Sequencing of colored lights within lighting assembly 186 can be used to produce dramatic color-changing effects on the outer case.

Preferably, the on-board air purifier 184 is structured and arranged to provide filtered air (removing impurities such as smoke) to the player during a performance. Preferably, air purifier 184 comprises at least one air intake, preferably located within bottom panel 108 that functions to intake air into the filter system. An internal filter 386 (see FIG. 19) removes impurities from the air and an internal fan moves the purified air to the outlet system within front board 110B, as described in FIG. 18A. Preferably, a system of air conduits 388 routes the purified air between air purifier 184 and front board 110B.

Upon reading the teachings of this specification, those of ordinary skill in the art will now understand that, under appropriate circumstances, considering such issues as intended use, etc., other hardware mounting arrangements, such as, for example, modifying the configuration of the central support structure to create an acoustic enclosure suitable for housing subwoofer driver 360, providing quick-mounting devices for quickly mounting/removing the hardware within the case, etc., may suffice.

FIG. 23A and FIG. 23B each show perspective views of a beverage and prop-storing bench 200 of modular piano assembly 102 of FIG. 1. Beverage and prop-storing bench 200 is preferably designed to improve the comfort of a pianist by providing novel piano-bench features. Preferably, beverage and prop-storing bench 200 comprises four height-adjusting legs 201 supporting an oversize bench case 205, as shown. Preferably, bench case 205 is fitted with a generally planar seating surface 206 adapted to support the pianist in at least one seated position allowing playing of electronic piano device 105.

Preferably, bench case 205 comprises a pair of large opposing storage drawers 202 adapted to hold performance props, as shown. In addition, storage drawers 202 preferably comprises at least one cold beverage holder 204 adapted to hold beverage containers 203 (cups, bottles etc.), as shown. Preferred embodiments of seating surface 206 comprise seat padding materials.

FIG. 24 shows a sectional view through cold beverage holder 204 of the beverage and prop-storing bench of FIG. 23A and FIG. 23B. Preferably, cold beverage holder 204 is adapted to chill and insulate beverage containers 203 (a canned or bottled beverage). Preferably, cold beverage holder 204 comprises a generally cylindrical sleeve containing at least one reusable refrigerant 207 disposed about the cavity of the sleeve in a generally annular arrangement, as shown. Preferably, reusable refrigerant 207 comprises a substance which may be frozen in conventional refrigerator freezers whereby the refrigerant (in a frozen state) will chill and keep chilled the beverage contained within beverage container 203. Preferably, to facilitate freezing, cold beverage holder 204 is removable from a receiving socket within storage drawers 202. Preferably, reusable refrigerant 207 comprises a liquid such as water, more preferably, a freezable gelatinous material such as BLUE ICE®, available from the Gott Division of Rubbermaid, Inc.

FIG. 25 shows a partial perspective view of alternate cold beverage holder 208 of the beverage and prop-storing bench 200 of FIG. 23A and FIG. 23B. Preferably, alternate cold beverage holder 208 comprises removable cold insert 209, as shown. Preferably, cold insert 209 comprises generally rectangular elements containing reusable refrigerant 207. Preferably, one or more cold inserts 209 are supported within storage drawers 202 and preferably extend the width of the storage drawer 202, as shown. A preferred commercial product preferred for use as cold insert 209 includes a 4 inch×8-½ inch×2 inch hard-sided can cooler by Rubbermaid of Fairlawn, Ohio.

Figure 26:
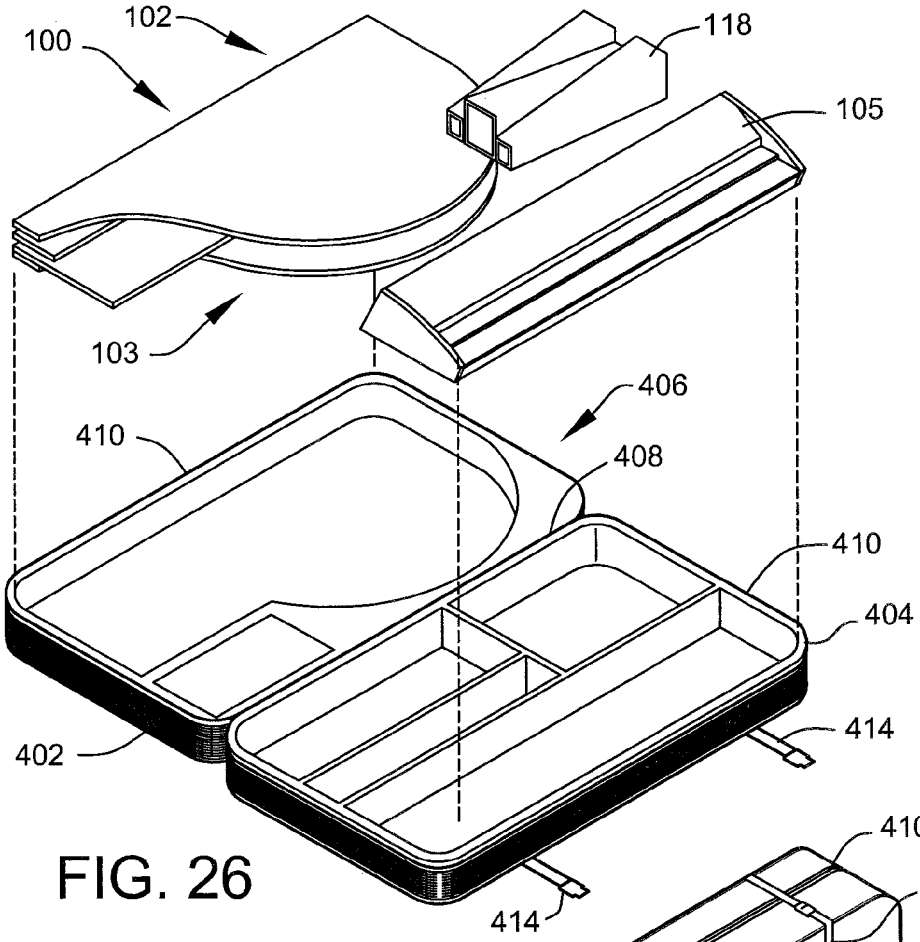
FIG. 26 shows a perspective view of a soft-sided storage unit receiving disassembled components of the mobile music entertainment system, according to preferred embodiments of the present invention.
Figure 27:
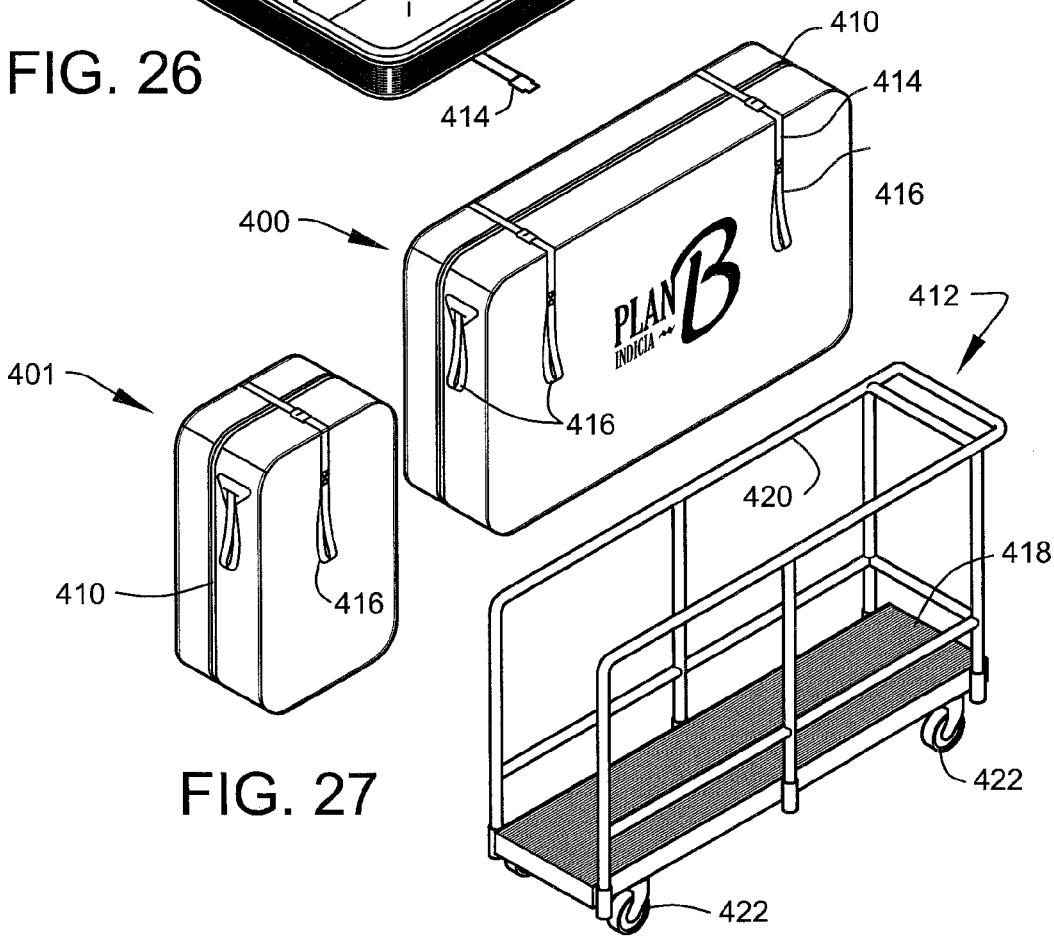
FIG. 27 shows a perspective view of soft-sided storage units and associated transport cart, of the mobile music entertainment system, according to preferred embodiments of the present invention.

FIG. 26 shows perspective view of a soft-sided storage unit 400 receiving disassembled components of mobile music entertainment system 100, according to preferred embodiments of the present invention. FIG. 27 shows a perspective view of soft-sided storage unit 400 and transport cart 412, of mobile music entertainment system 100, according to preferred embodiments of the present invention. Generally stated, soft-sided storage unit 400 preferably comprises a portable storage container having a plurality of holders, pockets, and compartments adapted to store and organize individual mountable components 103 of a disassembled portable piano assembly 102. Preferably, soft-sided storage unit 400 is constructed in two parts, preferably comprising first housing portion 402 and second housing portion 404, as shown. A grouping of storage compartments, collectively identified herein as compartment assembly 406, is preferably formed within first housing portion 402 and second housing portion 404, as shown. Compartment assembly 406 preferably comprises individual storage compartments adapted to generally fit and closely support the various shapes of mountable components 103, as shown.

Preferably, first housing portion 402 and second housing portion 404 are pivotally joined along the live hinge 408, as shown. Preferably, first housing portion 402 and second housing portion 404 pivot about live hinge 408 and are preferably secured together by peripheral zipper 410, as best shown in FIG. 27. Additional supporting straps 414 applied to the exterior of first housing portion 402 and second housing portion 404 assist in maintaining soft-sided storage unit 400 in the depicted "closed" configuration during transport. Upon reading the teachings of this specification, those of ordinary skill in the art will now understand that, under appropriate circumstances, considering such issues as user preference, intended use, etc., other fastener arrangements, such as hook-and-loop fasteners, buckles, straps, zippers, ties, etc., may suffice. In addition, gripping handles 416 are applied to the exterior of first housing portion 402 and second housing portion 404 to assist in manual transport.

Soft-sided storage unit 400 is constructed from a preferred selection of durable and generally water resistant materials. Preferably, a substantial portion of the outer surfaces of soft-sided storage unit 400 comprises at least one durable textile, preferably a woven ballistic nylon. Compartment assembly 406 preferably comprises a combination of lightweight textiles encapsulating cellular-foam inserts.

Preferably, fabrics are assembled by mechanical seaming using appropriate compatible thread stock. Preferably, semi-rigid inner panels of soft-sided storage unit 400 comprise sheet plastic or semi-rigid plastic foam. Preferably, to assist in providing greater durability, fabrics may also be bonded to adjacent substrates. Upon reading the teachings of this specification, those of ordinary skill in the art will now understand that, under appropriate circumstances, considering such issues as user preference, intended use, etc., other materials, such as Gor-Tex, Lycra, Kevlar, carbon fiber, micro-twills, fabrics containing natural fibers, natural and synthetic leathers, bullet resistant fabrics, high-durometer plastics, molded housings, etc., may suffice. Furthermore, upon reading the teachings of this specification, those of ordinary skill in the art will now understand that, under appropriate circumstances, considering such issues as intended use, etc., other semi-rigid sheet materials, such as closed-cell foams, light-weight laminated composites, low density polyethylene sheets, honeycomb structures, homogenous laminated sheets, thin plywood, fiber boards, etc., may suffice.

More than one soft-sided storage unit 400 may be used to store specific groupings of mountable components 103. For example, leg assemblies 118 may be separately stored in a smaller embodiment of soft-sided storage unit 400, as best illustrated in FIG. 27.

Preferably, transport cart 412 of mobile music entertainment system 100 comprises a wheeled cart adapted to assist in transporting soft-sided storage unit 401 between venue sites. Transport cart 412 preferably comprises a support platform 418 surrounded on three sides by support cage 420, as shown. Support cage 420 secondarily functions as a protective structure surrounding soft-sided storage unit 400 during storage and transport. The use of four caster-type wheels 422 is generally preferred.

Figures 28, 29:
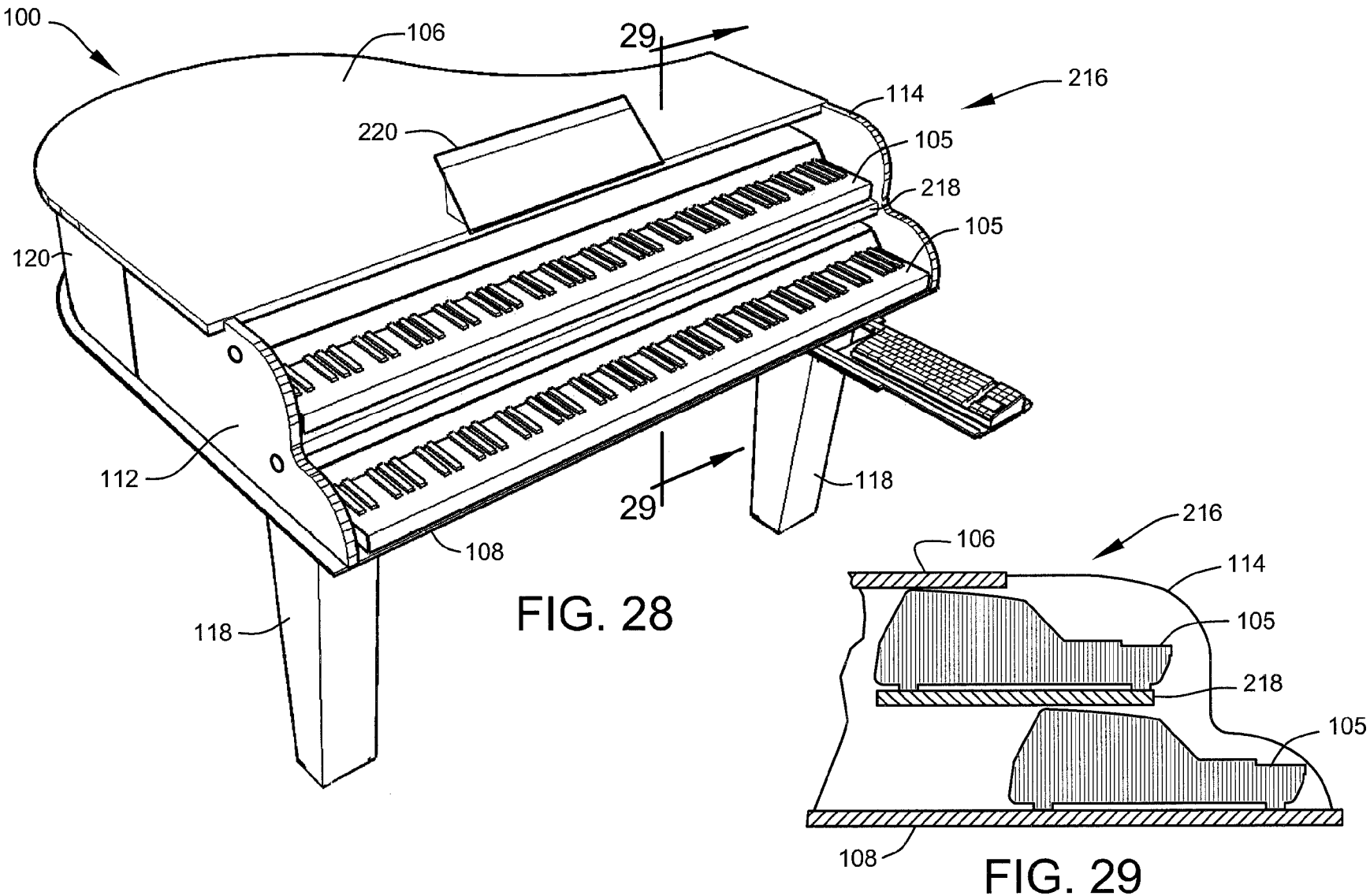
FIG. 28 shows a perspective view illustrating a dual keyboard piano assembly of the mobile music entertainment system according to another preferred embodiment of the present invention.
FIG. 29 shows a sectional view through the section 29-29 of FIG. 28.

FIG. 28 shows a perspective view illustrating dual keyboard piano assembly 216 of mobile music entertainment system 100 according to another preferred embodiment of the present invention. FIG. 29 shows a sectional view through the section 29-29 of FIG. 28.

Preferably, dual keyboard piano assembly 216 is adapted to simulate the appearance of an acoustic piano. In addition, dual keyboard piano assembly 216 is preferably adapted to simultaneously house two electronic piano devices 105, as shown. Preferably, dual keyboard piano assembly 216 comprises shelf 218 adapted to support the upper electronic piano device 105 in a playable position, as shown (at least embodying herein at least one first support structured and arranged to support the at least one first electronic piano in at least one first playable position). Preferably, shelf 218 spans between, and is supported by, first cheek-board 112 and second cheek-board 114, as shown. Preferably, the lower electronic piano on device 105 is supported, in a playable position, from bottom panel 108, as shown (at least embodying herein at least one second support structured and arranged to support the at least one second electronic piano in at least one second playable position).

Preferably, dual keyboard piano assembly 216 comprises top-mounted video display 220, as shown. Preferably, a top-mounted video display 220 is coupled to internal computer 150 and functions in a manner substantially similar to the display systems of the prior embodiments.

Upon reading the teachings of this specification, those of ordinary skill in the art will now understand that, under appropriate circumstances, considering such issues as intended use, cost, etc., other duel-piano housing arrangements, such as, for example, utilizing non-piano housing shapes, housing configurations placing the electronic pianos in non-parallel orientations, etc., may suffice.

Figure 30:
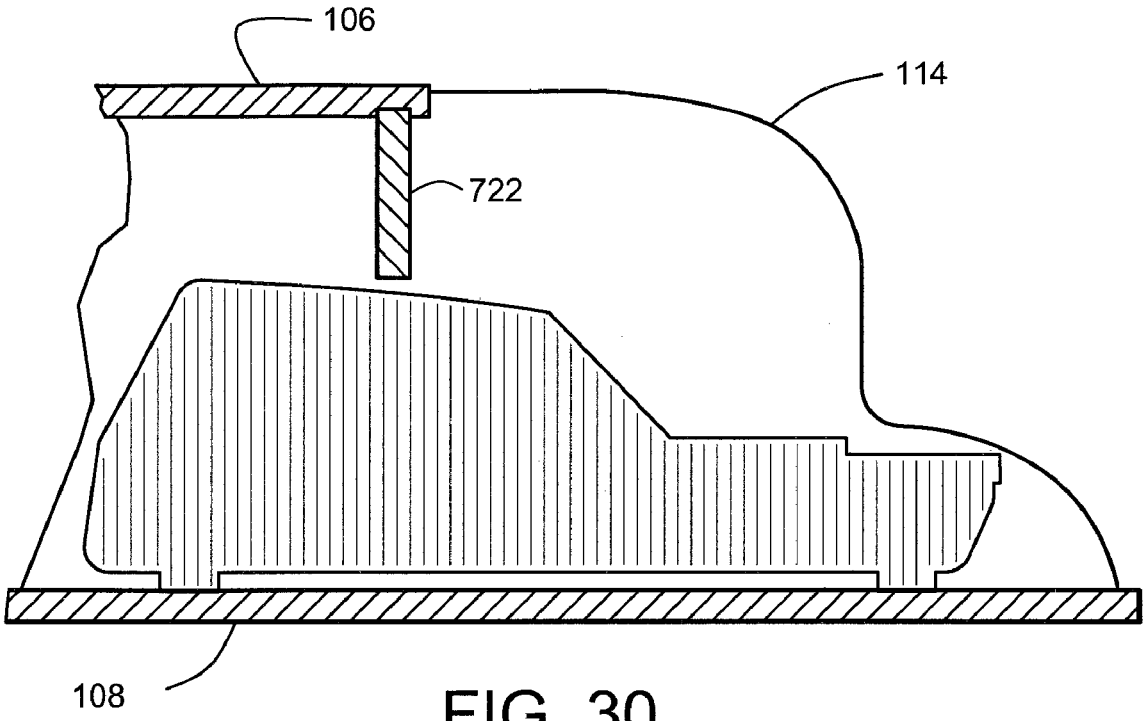
FIG. 30 shows a partial sectional view through a transverse section taken between cheek boards of an alternate modular piano assembly of the mobile music entertainment system, according to another preferred embodiment of the present invention.

FIG. 30 shows a partial sectional view through a transverse section taken between cheek boards of alternate modular piano assembly 720 of the mobile music entertainment system 100, according to another preferred embodiment of the present invention. Preferably, alternate modular piano assembly 720 comprises substantially an identical construction to modular case 104 of portable piano assembly 102, with the following preferred exceptions. Preferably, alternate modular piano assembly 720 utilizes a fixed front board 722, as shown. Preferably, fixed front board 722 comprises a substantially vertical and non-adjustable panel, as shown. Preferably, fixed front board 722 extends generally horizontally from first cheek-board 112, to second cheek-board 114. Preferably, fixed front board 722 is demountable from first cheek-board 112, second cheek-board 114, and top panel 106, preferably using cam-and-post fastener assemblies, as previously illustrated in FIG. 7. Alternate modular piano assembly 720 is preferred when cost is of concern and/or the physical size of electronic piano device 105 can be readily anticipated.

Figure 31:
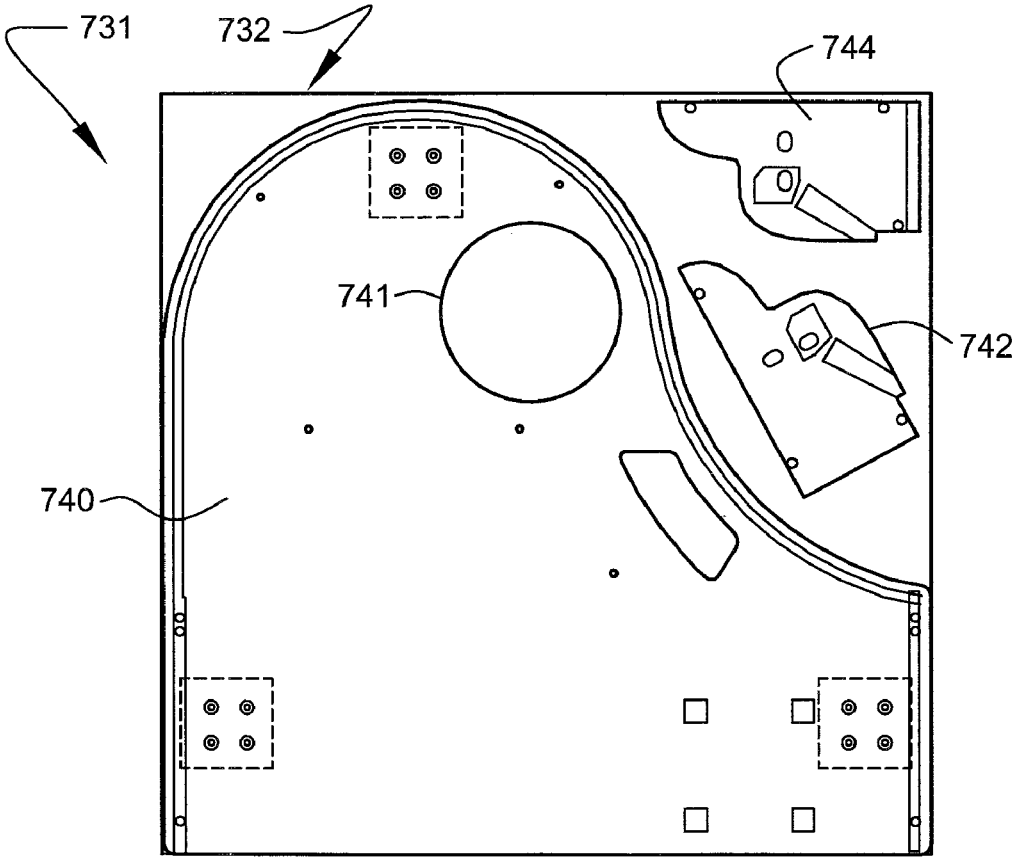
FIG. 31 shows a top view depicting a preferred component layout of a first sheet panel used to produce components of an alternate modular piano assembly, according to another preferred embodiment of the present invention.
Figure 32:
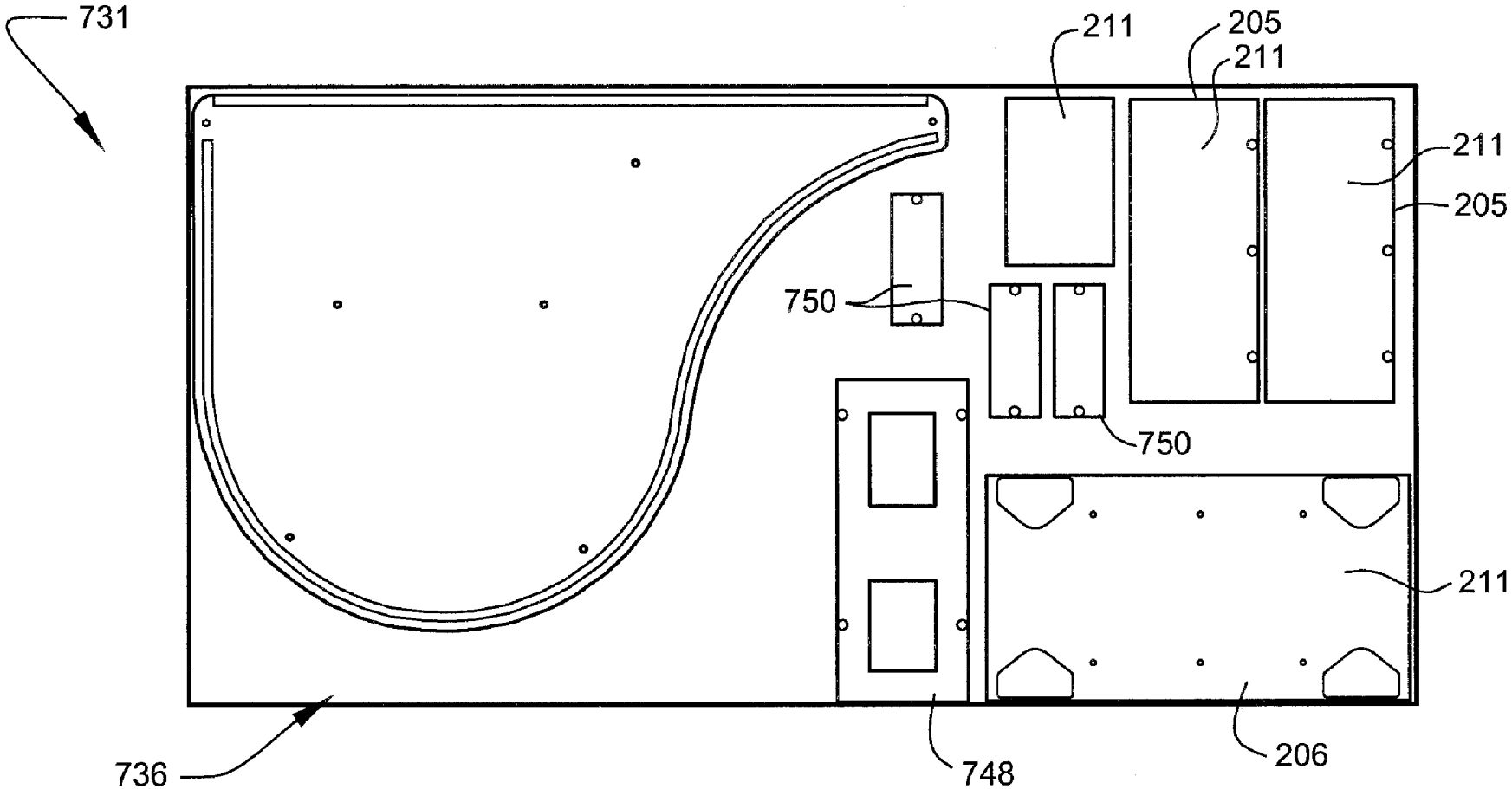
FIG. 32 shows a top view depicting a preferred component layout of a second sheet panel used to produce components of the alternate modular piano assembly of FIG. 31.

FIG. 31 shows a top view depicting alternate preferred components 730 shown in a preferred layout (prior to cutting) within a first sheet panel 732. Preferably, alternate preferred components 730 are used to produce components of alternate modular piano assembly 734, according to another preferred embodiment of the present invention. FIG. 32 shows a top view depicting a preferred component layout of a second sheet panel 736 preferably containing additional alternate preferred components 730 preferably used to produce alternate modular piano assembly 734 of FIG. 31.

Preferably, alternate modular piano assembly 734 comprises substantially an identical construction to modular case 104 of portable piano assembly 102, with the following preferred exceptions. Preferably, alternate modular piano assembly 734 comprises an alternate centralized support structure 739 that preferably utilizes an alternate preferred support arrangement, as best described in FIG. 33. In addition, both first cheek-board 742 and second cheek-board 744 of alternate modular piano assembly 734 are preferably of similar size, as shown. Preferably, bottom panel 740 of first sheet panel 732 preferably comprises an additional subwoofer opening 741, as shown. Bottom panel 740 also preferably comprises a single undivided (unhinged) panel, as shown.

Preferably, the following components are derived from second sheet panel 736: alternate top panel 746, primary central support panel 748, and at least three secondary central support panels 750, as shown. Preferably, alternate top panel 746 is substantially similar in size and construction to top panel 106 with the exception of the appropriate mounting preparation for primary central support panel 748. Preferably, bench components 211, preferably used to produce prop-storing bench 200, are further derived from second sheet panel 736.

For economy of construction, the sheet material of second sheet panel 736 comprises a standard 48 inch×96 inch nominal outside dimensional format. Preferably, first sheet panel 732 comprises a standard 60 inch×60 inch nominal outside dimensional format. The preferred use of standard sheet formats allows alternate preferred components 730 to be fabricated from a wide range of commercially available construction grade products. As previously noted, preferred products include rigid medium density fiber board, pressboard, and most preferably substantially rigid plywood products.

Figure 33:
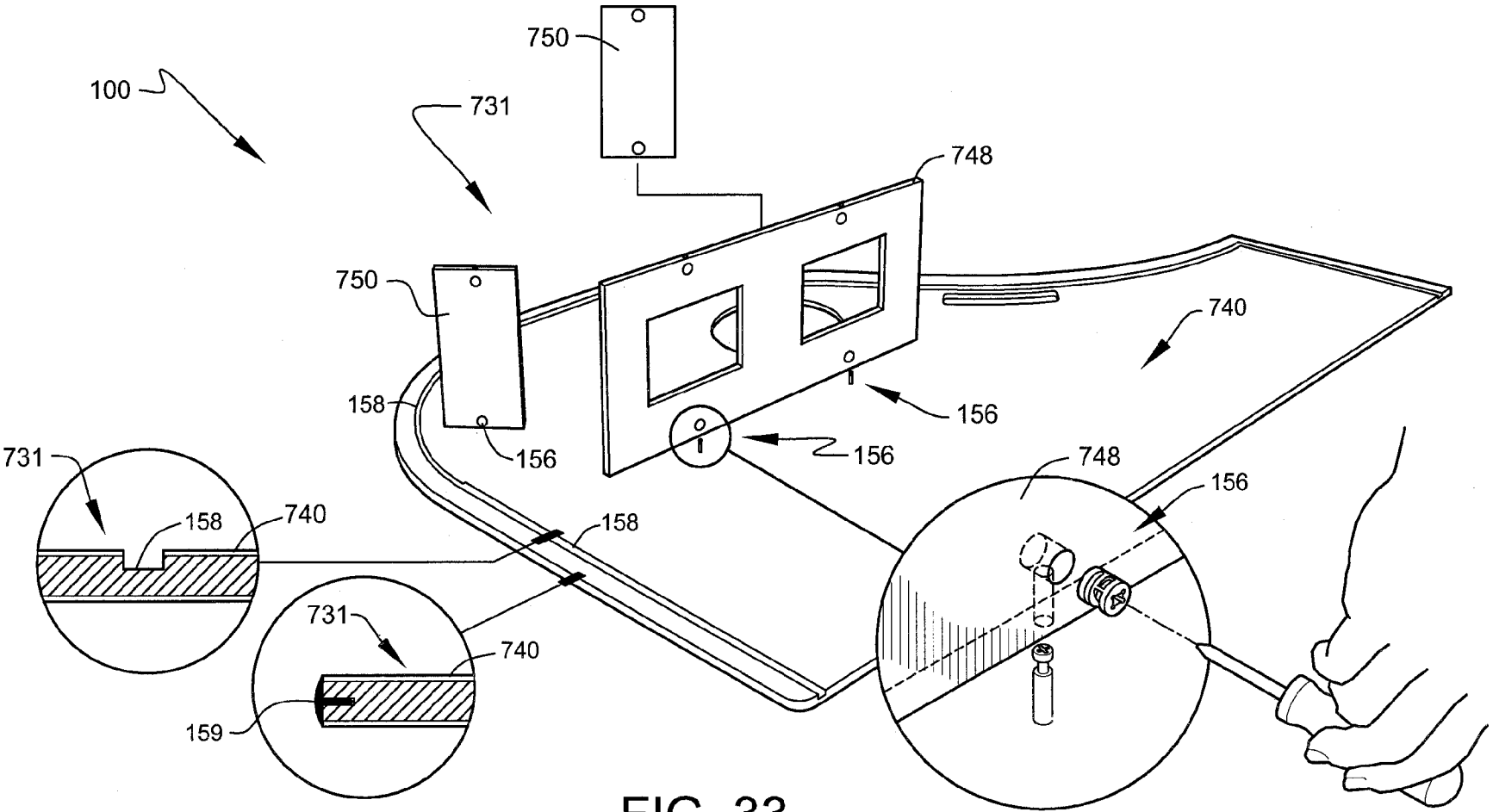
FIG. 33 shows an exploded view illustrating preferred assembly arrangements of the alternate modular piano of FIG. 31.

FIG. 33 shows an exploded view illustrating preferred assembly arrangements of alternate centralized support structure 739 of alternate modular piano assembly 734 of FIG. 31. Preferably, individual demountable panels of alternate centralized support structure 739 are preferably joined without engagement within the recessed "dados", as was preferred for modular case 104. Preferably, the individual demountable panels of alternate centralized support structure 739 are preferably butted flush with the surfaces of alternate top panel 746 and bottom panel 740, preferably at about a 90-degree orientation, and are preferably retained in position using a plurality of cam-and-post fastener assemblies 156, as shown. Preferably, primary central support panel 748 is mounted to alternate top panel 746 and bottom panel 740 in a generally transverse orientation, as shown. Preferably, secondary central support panels 750 are mounted to alternate top panel 746 and bottom panel 740 near the peripheral dado channel 158 for the outer side-panel 120, as shown.

Preferably, surfaces of demountable components that are visibly exposed after assembly receive one or more decorative/protective finishes. Preferably, considering such issues as intended use, cost, etc., such decorative and or protective finishes may comprise plastic laminates, wood veneers, lacquered finishes, painted finishes, etc. T-molding 159 is preferably applied to exposed peripheral edges of exposed demountable components, as illustrated in the enlarged detail of FIG. 33.

Upon reading the teachings of this specification, those of ordinary skill in the art will now understand that, under appropriate circumstances, considering such issues as intended use, manufacturing and assembly costs, etc., other support arrangements, such as, for example, triangular layouts, curving or circular layouts, box-like arrangements, the use of tension struts, etc., may suffice.

Figure 34:
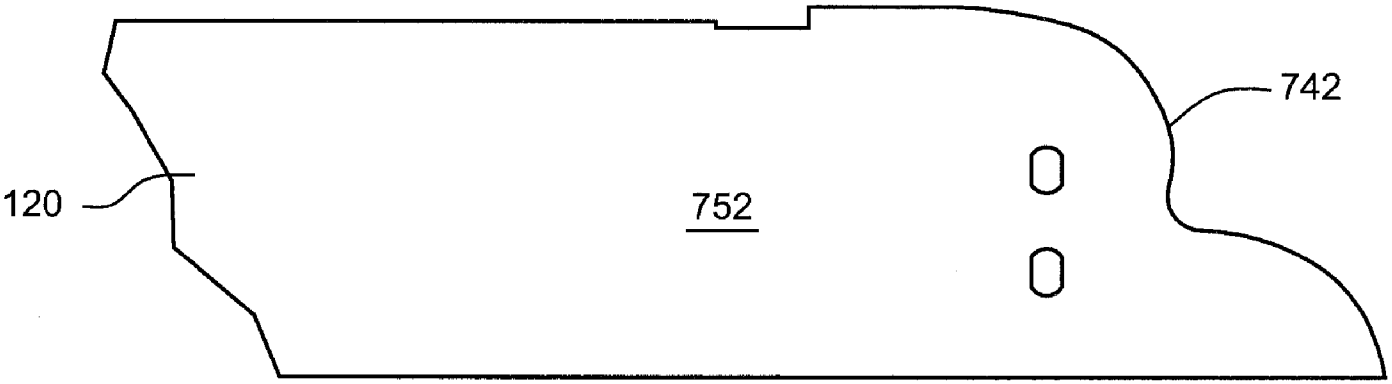
FIG. 34 shows an outer side view of an alternate preferred finishing technique according to preferred embodiments of the mobile music entertainment system.
Figure 35:
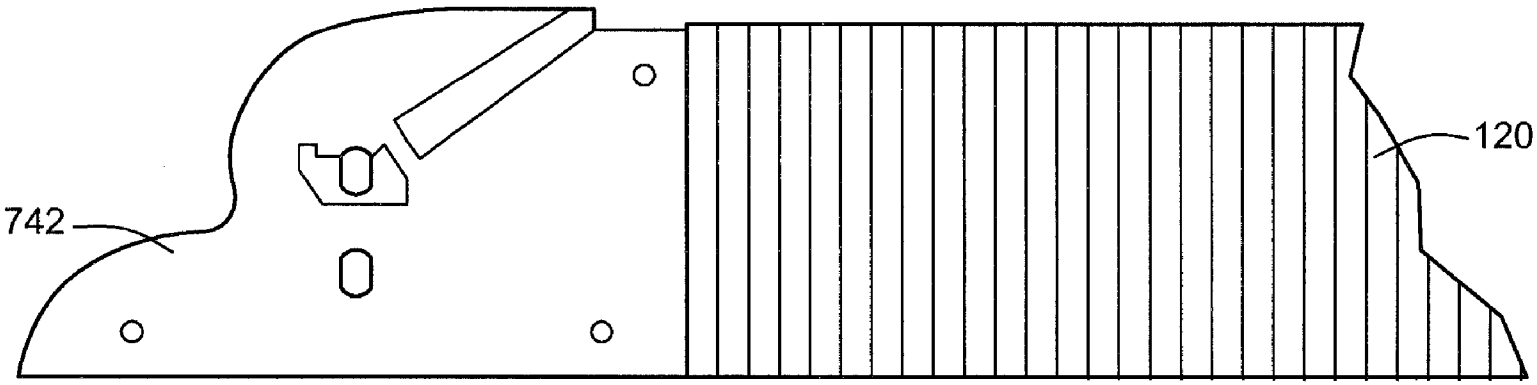
FIG. 35 shows an outer side view of an alternate preferred finishing technique according to preferred embodiments of the mobile music entertainment system.

FIG. 34 shows an outer side view of an alternate preferred finishing technique according to preferred embodiments of the mobile music entertainment system 100. FIG. 35 shows an outer side view of an alternate preferred finishing technique according to preferred embodiments of the mobile music entertainment system 100. Preferably, first cheek-board 742 and outer side-panel 120 both receive a common outer finish 752 (typically a preferred plastic laminate material), as shown. This preferred finish technique eliminates the visible joint that would otherwise occur between first cheek-board 742 and outer side-panel 120. Upon reading the teachings of this specification, those of ordinary skill in the art will now understand that, under appropriate circumstances, considering such issues as intended use, portability requirements, etc., other construction arrangements, such as combining one or more demountable elements into a single permanent assembly to speed assemblage or breakdown, etc., may suffice.

Figure 36:
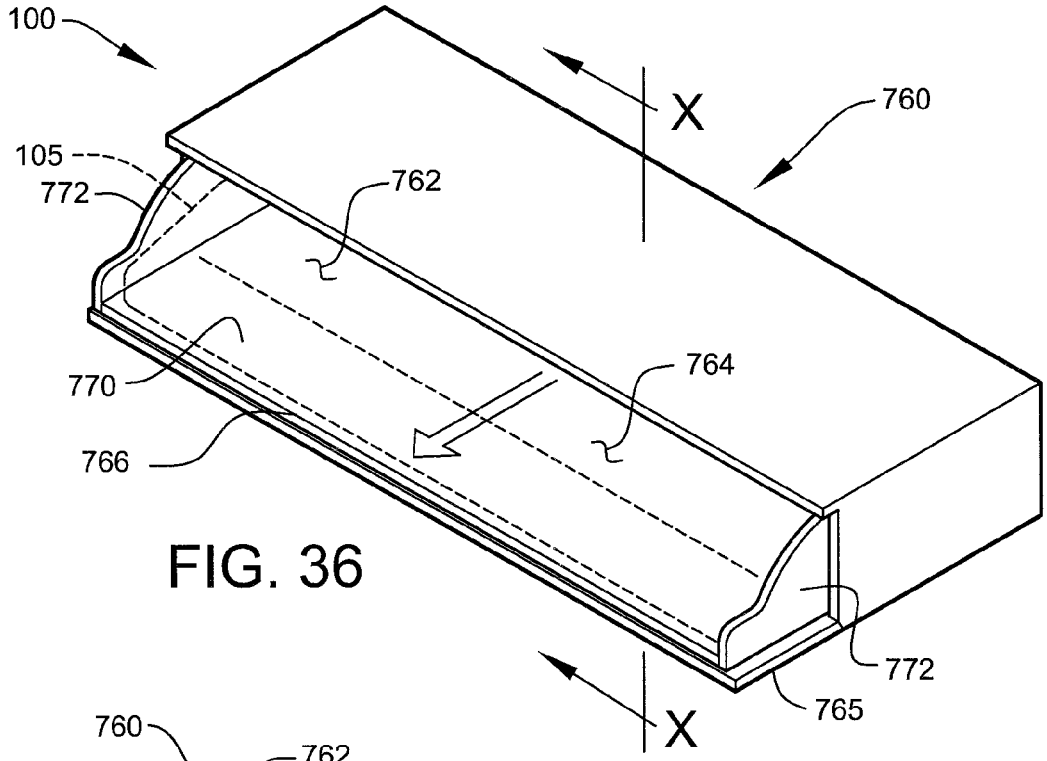
FIG. 36 shows a perspective view of an alternate keyboard housing around which several preferred alternate modular piano assemblies of the mobile music entertainment system may be created, according to additional preferred embodiments of the present invention.

FIG. 36 shows a perspective view of alternate keyboard housing 760 around which several preferred alternate modular piano assemblies of the mobile music entertainment system 100 may be created, according to additional preferred embodiments of the present invention. Preferably, alternate keyboard housing 760 is adapted to removably house and support at least one electronic piano device 105 (indicated by dashed lines), as shown. Alternate keyboard housing 760 is preferably designed to further assist in simulating a portion of an acoustic piano by closely engaging and surrounding electronic piano device 105, as shown.

Preferably, alternate keyboard housing 760 comprises a generally rectangular cabinet having a hollow internal compartment 762, as shown. Preferably, internal compartment 762 is accessed through a large front opening 764, preferably spanning substantially the entire front portion of alternate keyboard housing 760, as shown. Preferably, internal compartment 762 is concealed by, when in a closed position, front hinged door 765 (at least embodying herein wherein said at least one access opening comprises at least one operable door structured and arranged to, when in a closed position, substantially conceal said at least one interior compartment). Preferably, internal compartment 762 contains a sliding support tray 766 structured and arranged to assist deployment of electronic piano device 105 from within internal compartment 762, as illustrated in FIG. 37 and FIG. 38.

Figure 37:
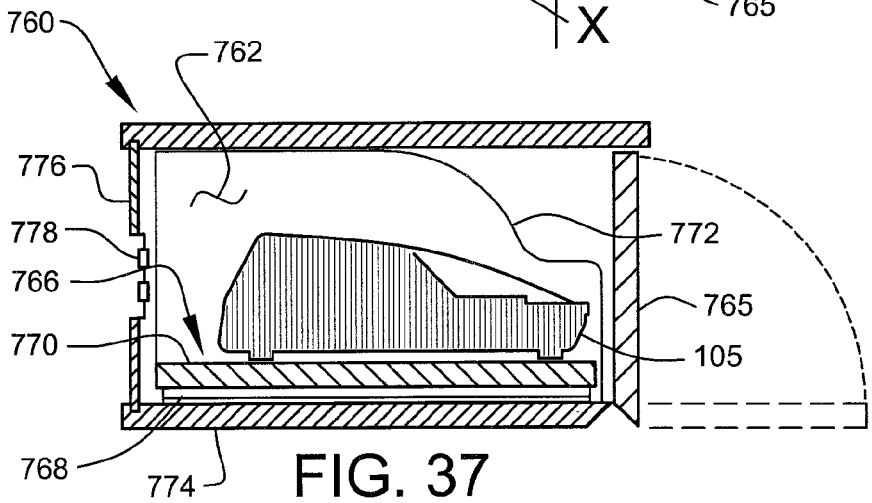
FIG. 37 shows a first sectional view through the section X-X of FIG. 36 illustrating the stowage of an electronic piano device within the alternate keyboard housing.
Figure 38:
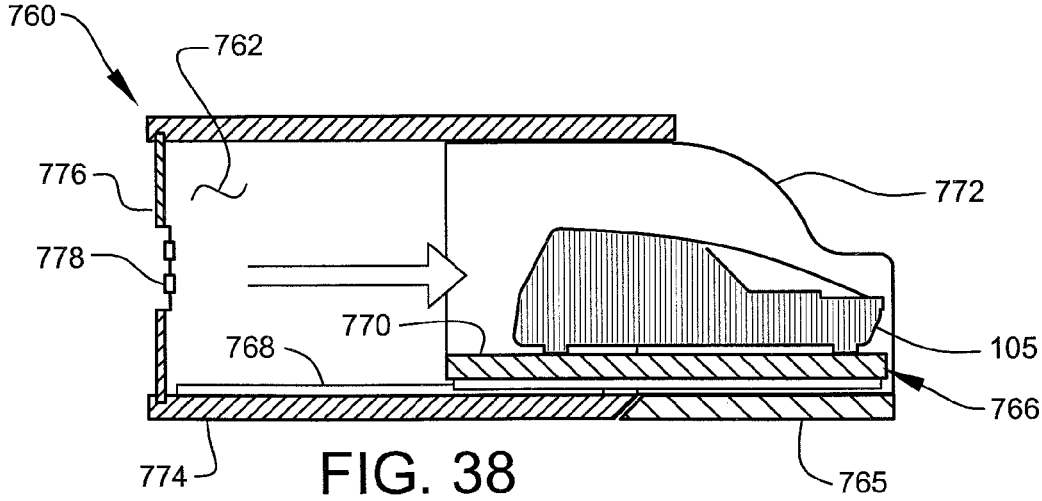
FIG. 38 shows a second sectional view through the section X-X of FIG. 36 illustrating the deployment of the electronic piano device from within the alternate keyboard housing.

FIG. 37 shows a first sectional view through the section X-X of FIG. 36 illustrating the stowage of electronic piano device 105 within internal compartment 762 of alternate keyboard housing 760. FIG. 38 shows a second sectional view through the section X-X of FIG. 36 illustrating the deployment of electronic piano device 105 from within internal compartment 762 of alternate keyboard housing 760. Preferably, keyboard tray 766 comprises a generally "U-shaped-"support member having a base panel 770 and two side panels 772 projecting generally upward from each end, as shown. Preferably, each side panel 772 is shaped to generally resemble the right and left cheek structures of an acoustic piano, as shown.

Preferably, base panel 770 of keyboard tray 766 is movably mounted to the lower panel 774 of internal compartment 762 using a set of sliding tracks 768, as shown (at least embodying herein at least one translational transporter structured and arranged to assist translational transport of said at least one support tray at least partially from within said at least one interior compartment). Preferably, sliding tracks 768 allow keyboard tray 766 to translate forward and back, thus facilitating deployment and retraction of electronic piano device 105 in and out of alternate keyboard housing 760, as shown. Preferably, each sliding track 768 (preferably two) comprise full extension bottom-mount (under mount) drawer slides by Hafele America Co. of Archdale, N.C. Front hinged door 765 preferably swings down to a position generally parallel to lower panel 774 of internal compartment 762, as shown. Preferably, rear panel 776 preferably comprises at least one connector panel 778, as shown, preferably providing appropriate audio and power connectors supporting operation of electronic piano device 105.

Figure 39:
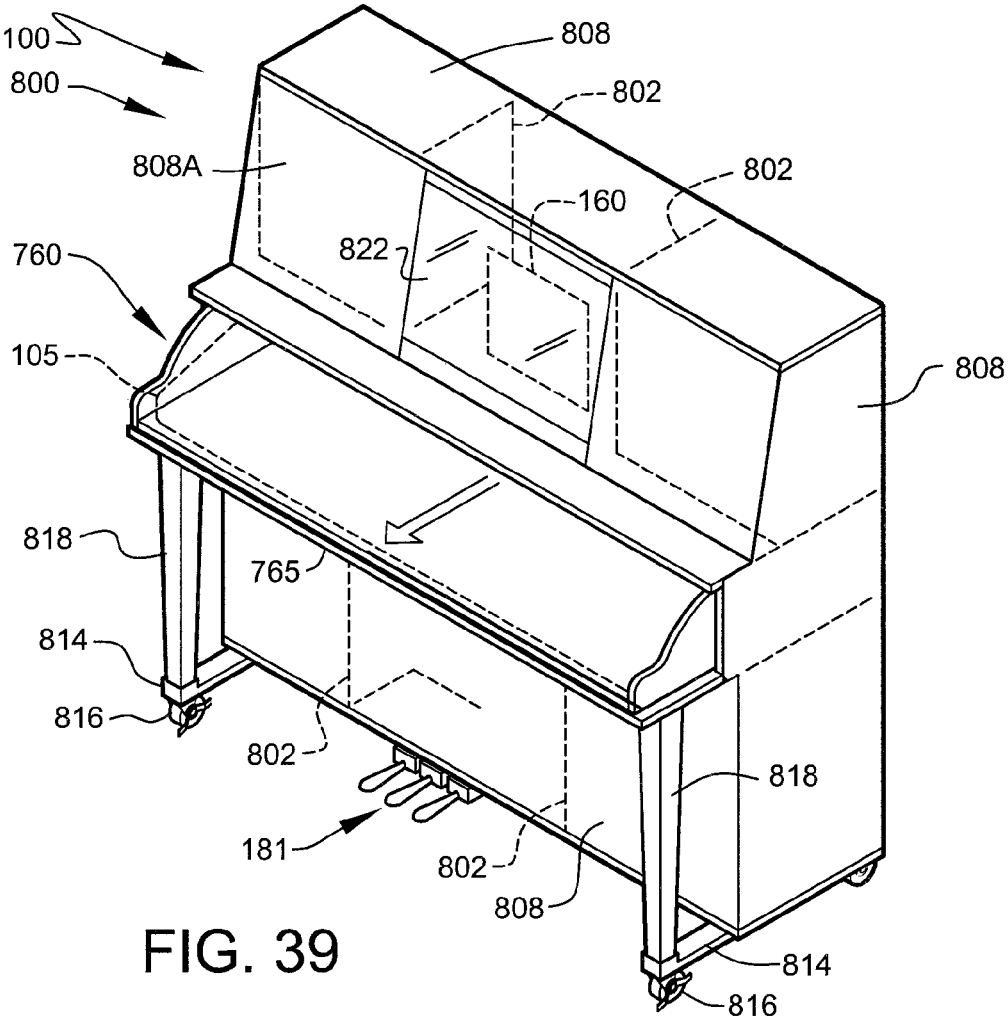
FIG. 39 shows a perspective view illustrating an upright-style modular piano assembly of the mobile music entertainment system, preferably utilizing the alternate keyboard housing of FIG. 36, according to another preferred embodiment of the present invention.
Figure 40:
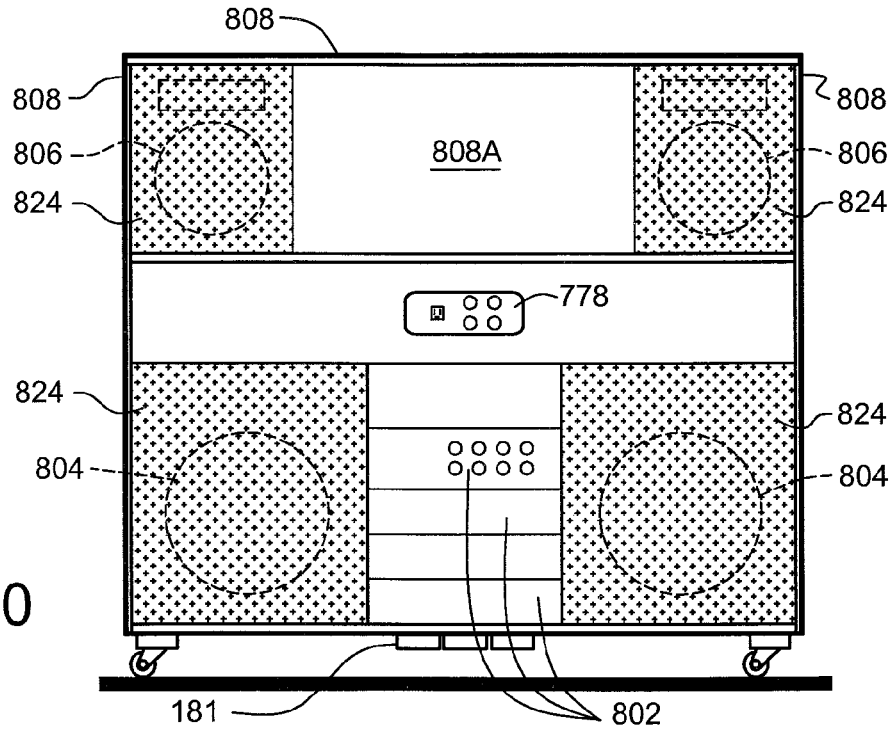
FIG. 40 shows a rear view of the upright-style modular piano assembly of FIG. 39.
Figure 41:
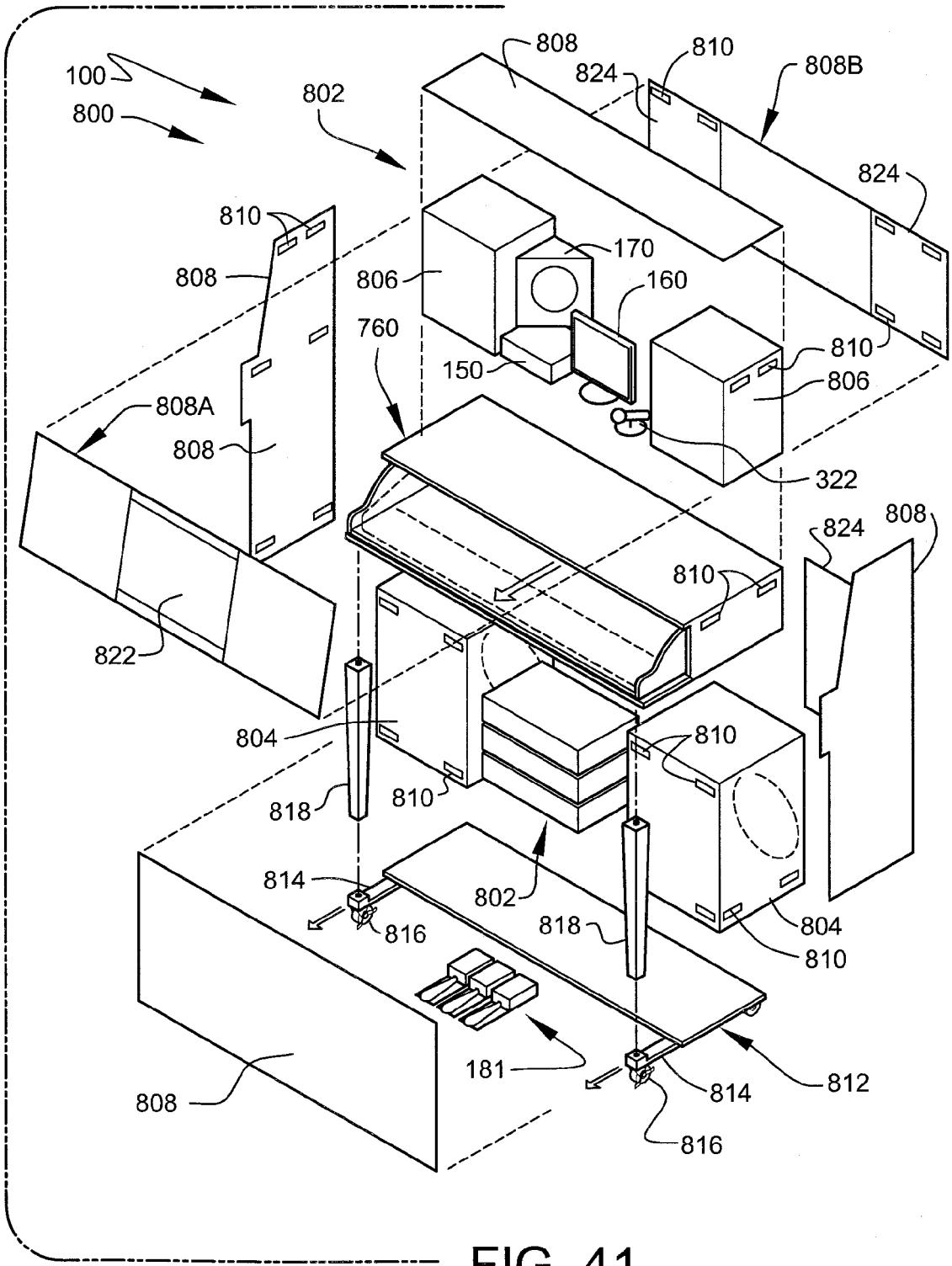
FIG. 41 shows an exploded perspective view of the upright-style modular piano assembly of FIG. 39.

FIG. 39 shows a perspective view illustrating upright-style portable piano assembly 800 of mobile music entertainment system 100, preferably utilizing alternate keyboard housing 760 of FIG. 36, according to another preferred embodiment of the present invention. FIG. 40 shows a rear view of the upright-style modular piano assembly 800 of FIG. 39. FIG. 41 shows an exploded perspective view of upright-style modular piano assembly 800 of FIG. 39.

Preferably, upright-style portable piano assembly 800 is structured and arranged to simulate the outer appearance of an acoustic piano, as shown. Preferably, upright-style portable piano assembly 800 is preferably assembled by stacking a preferred grouping of functional components 802, preferably including alternate keyboard housing 760; lower audio loudspeakers 804 and upper audio loudspeakers 806, as shown. Preferably, the "stacked" assemblies of functional components 802 are preferably concealed behind a set of external concealment panels 808, as shown. Preferably, the rear of each external concealment panel 808 is preferably equipped with a fastener, preferably a removable fastener, most preferably a removable hook-and-loop fastener 810, as shown. Preferably, each functional component 802 to be concealed by a respective external concealment panel 808 is preferably equipped with a corresponding portion of hook-and-loop fastener 810, as shown.

Preferably, lower audio loudspeakers 804 are supported on a special rolling support base 812, as shown. Preferably, rolling support base 812 comprises a set of extendable bars 814, as shown. Preferably, each extendable bar 814 comprises a pivoting wheel 816, as shown. Preferably, a pair of demountable legs 818 extend between the ends of extendable bars 814 and the underside of front hinged door 765 (of alternate keyboard housing 760), as shown.

In a preferred example embodiment of upright-style portable piano assembly 800, two lower audio loudspeakers 804 are symmetrically stacked over the end portions of rolling support base 812, as shown. Preferably, the two extendable bars 814 are extended from rolling support base 812 and are fitted with two demountable legs 818, as shown. Preferably, alternate keyboard housing 760 is stacked over the two lower audio loudspeakers 804 and front hinged door 765 is swung open to form a contact engagement with the upper ends of demountable legs 818, as shown. Preferably, upper audio loudspeakers 806 are then symmetrically stacked on the upper surface of alternate keyboard housing 760, as shown. Additional functional components 802 are preferably installed between the two lower audio loudspeakers 804 and between the upper audio loudspeakers 806, as shown. These additional functional components 802 may preferably include, depending on the preferred requirements of the assembly, computer 150, system controller 152, monitor speakers 170, foot-actuated switch assembly 181, internal video display 160, microphone 322, amplifiers 820, etc., as shown. Preferably, a plurality of appropriately shaped external concealment panels 808 are then preferably applied over the functional components 802 to complete the illusion of an upright-style piano, as shown.

Preferably, one or more external concealment panels 808 comprise specialized configurations beyond peripheral shape. For example, front concealment panel 808A preferably comprises at least one transparent window portion 822 to assist viewing of internal video display 160, as shown. Furthermore, rear panel 808B preferably comprises several acoustically permeable portions 824 to assist transmission of sound from the speakers.

Thus, the above-described preferred arrangements of upright-style portable piano assembly 800 preferably enable rapid set-up and breakdown of upright shell 504, greatly facilitating storage and transport. The preferred modularity and interchangeably within interrelated groups of functional components 802 also allows unique component combinations to be selected and assembled to produce an upright-style piano tailored to specific purchase/rental price criteria. Upon reading and viewing the illustrative teachings of this specification, those of ordinary skill in the art will now understand that, under appropriate circumstances, considering such issues as intended use, cost, etc., other housing and shell arrangements, such as, for example, larger grand piano shells, smaller (highly transportable) embodiments suitable for airline travel, embodiments adapted to resemble pipe organs, etc., may suffice.

In summary, the above-described preferred arrangements of upright-style portable piano assembly 800 preferably supports a preferred assembly method, related to the support of electronic piano device 105 within upright-style portable piano assembly 800, such method preferably comprising the steps of: providing at least one cabinet (alternate keyboard housing 760), preferably comprising internal compartment 762, preferably structured and arranged to house electronic piano device 105 therein. Preferably, supportively stacking such at least one cabinet on at least one lower body component, preferably the two lower audio loudspeakers 804; and providing at least one upper body component, more preferably two upper audio loudspeakers 806. Preferably, supportively stacking such at least one upper body component on the cabinet of alternate keyboard housing 760. Preferably, providing at least two leg members (demountable legs 818) structured and arranged to visually simulate the leg members of the at least one upright stringed-acoustic piano. Preferably, providing a plurality of mountable cover panels (external concealment panels 808), each such mountable cover panel being structured and arranged to be repeatably demountable from at least one of such at least one cabinet, such at least one lower body component, and such at least one upper body component. Preferably, mounting such plurality of external concealment panels 808 to such at least one cabinet (alternate keyboard housing 760), such at least one lower body component, and such at least one upper body component to produce such at least one piano-simulating assembly identified herein as upright-style portable piano assembly 800.

Figure 42:
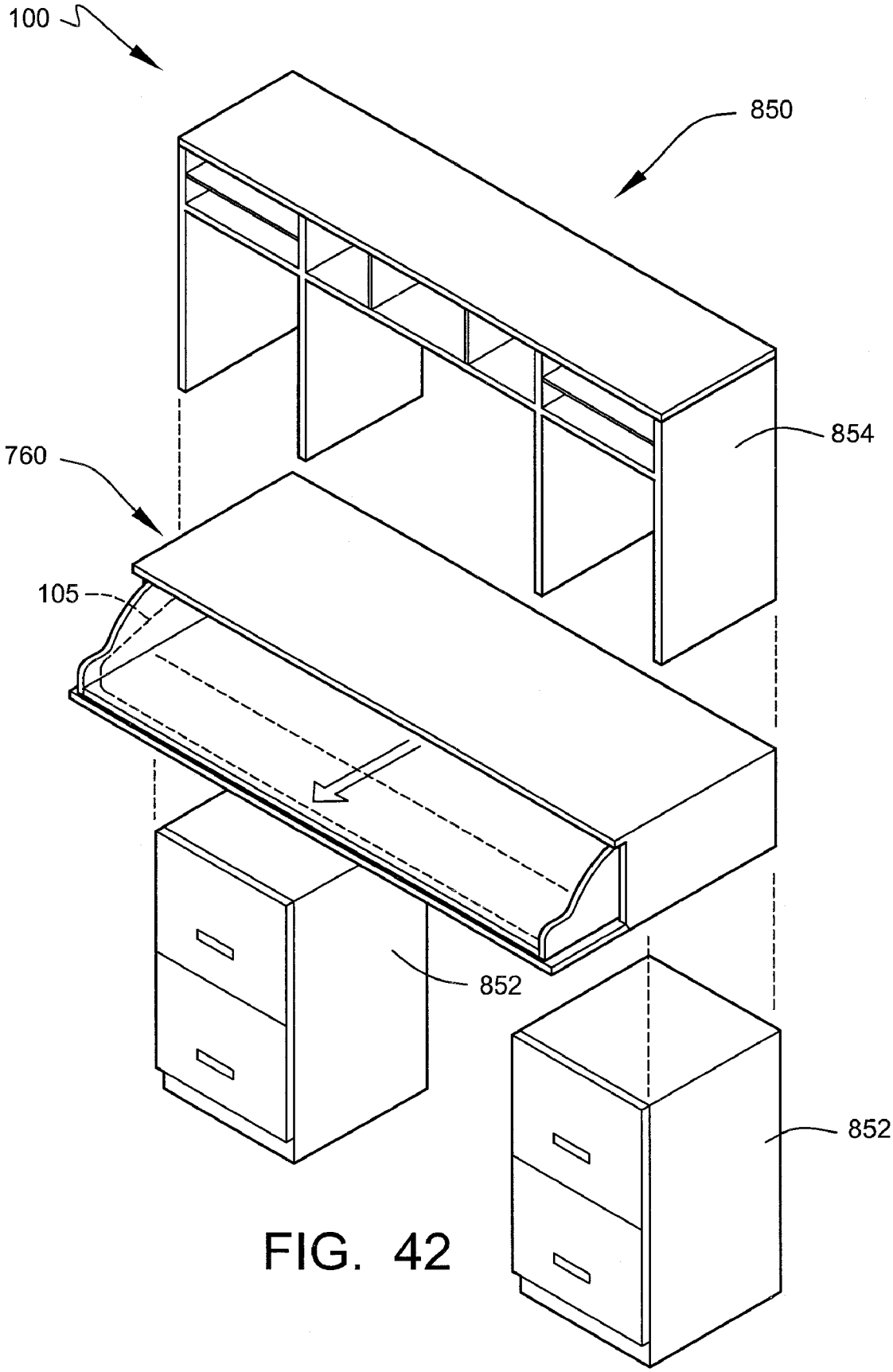
FIG. 42 shows an exploded perspective view of a writing desk, preferably comprising the alternate keyboard housing of FIG. 36, according to another preferred embodiment of the present invention.
Figure 43:
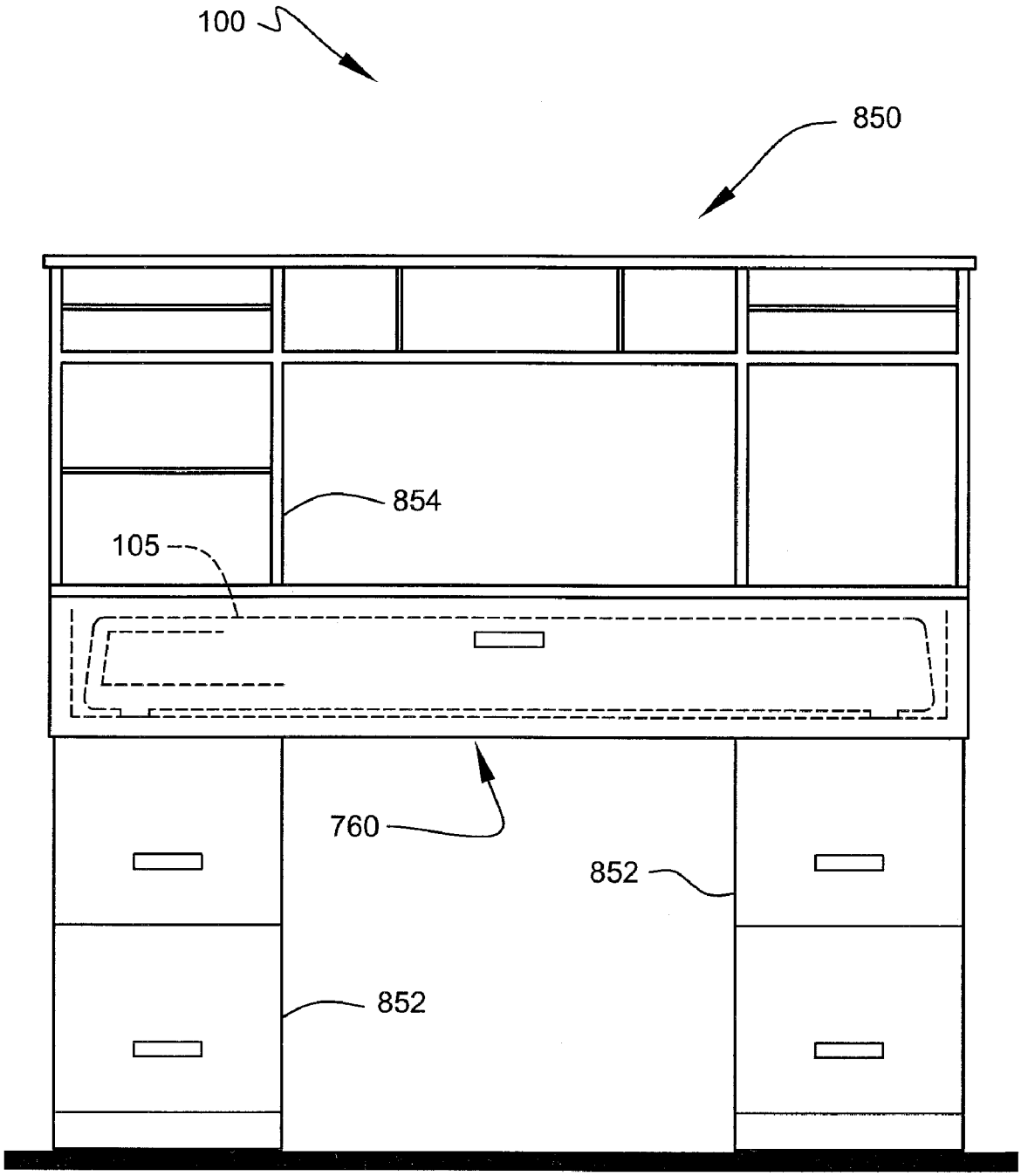
FIG. 43 shows a front view of the writing desk of FIG. 42.

FIG. 42 shows an exploded perspective view of piano writing desk 850, preferably comprising alternate keyboard housing 760 of FIG. 36, according to another preferred embodiment of mobile music entertainment system 100. FIG. 43 shows a front view of piano writing desk 850 of FIG. 42. Piano writing desk 850 preferably comprises alternate keyboard housing 760 preferably supported by a pair of filing cabinets 852, as shown. Piano writing desk 850 preferably comprises an upper "hutch" unit 854, preferably consisting of a set of shelves or cabinets, is preferably placed on top of alternate keyboard housing 760, as shown.

Piano writing desk 850 illustrates the versatility of alternate keyboard housing 760 in generating ready-to-assemble (RTA) furniture embodiments of mobile music entertainment system 100. Preferably, piano writing desk 850 is suitable for use in a small home or apartment where space is limited. Upon reading the teachings of this specification, those of ordinary skill in the art will now understand that, under appropriate circumstances, considering such issues as intended use, user preference etc., other furniture arrangements utilizing alternate keyboard housings, such as coffee tables, sideboards, computer workstations, etc., may suffice.

Figure 44:
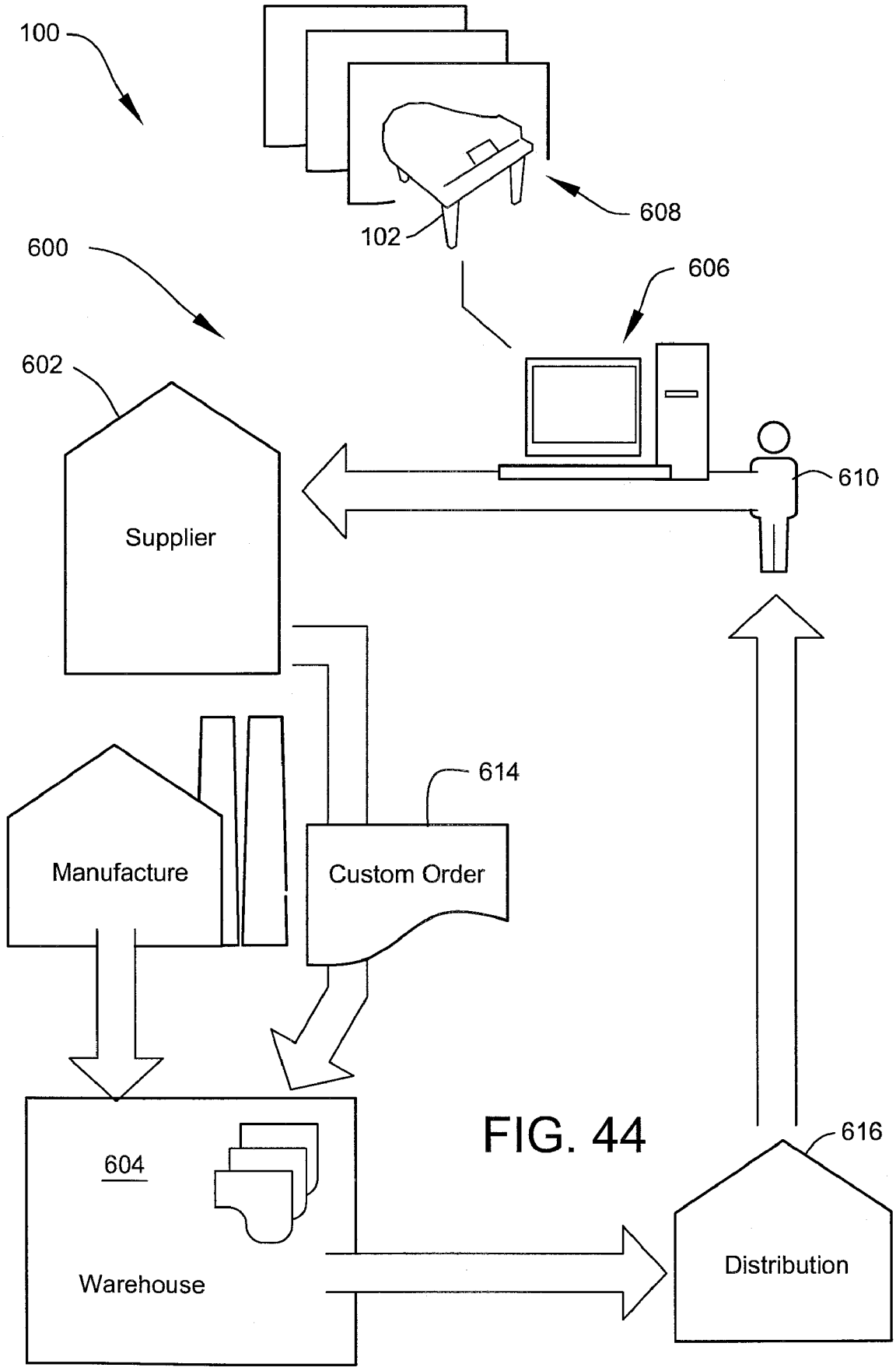
FIG. 44 shows a diagram generally illustrating preferred methods of production and distribution according to the present invention.

FIG. 44 shows a diagram, generally illustrating a business method 600 related to producing and distributing custom mobile music entertainment systems 100. Under these methods, the unique modular construction of mobile music entertainment system 100 is preferably utilized to provide user-customized embodiments of portable piano assembly 102.

In a preferred method of the present system, a supplier 602 produces a quantity of modular components 103 used in the assembly of portable piano assembly 102. These modular components preferably comprise a diverse range of user selectable options, including colors, materials, special-effects devices, wireless triggers, audio speakers, etc. Preferably, a quantity of the modular components 103 are produced and stored in an inventory 604, as shown. The supplier 602 preferably operates one or more Internet website servers 606 offering to provide custom embodiments of portable piano assembly 102 for production and sale, as shown. Preferably, the Internet website server 606 comprises a website 608 adapted for the acceptance of orders and purchase transactions, from individuals 610, for custom designed modular piano assemblies. Preferably, the website 608 is structured to permit the individuals 610 to select and specify specific designs for producing a single unit or limited quantities of the custom designed modular piano assemblies 102. For example, an individual 610 preferably accesses the Internet website server 606 and selects, from a customization menu, modular component combinations for a custom portable piano assembly 102. The individual 610 preferably completes the order 614 by providing payment and shipping information. Preferably, the supplier collects the user selected modular components, using the customization data provided by the individual, and prepares the components for shipping. In an optional preferred step, the supplier may contract with the individual 610 to provide some level of "factory" preassembly and/or testing. In a final preferred step, the supplier 602 provides for the shipping 616 of the custom portable piano assembly 102 to the individual, thus completing the transaction. Preferably, the supplier 602 maintains sufficient stocks of modular components 103 to allow for shipping of a custom piano "kit" within about 48 hours from the time of order. In addition, the present invention preferably comprises the assembling of one or more "pre-configured" kits offering all equipment, props, etc. needed to stage a "dueling piano-type" performance.

Thus, in accordance with preferred embodiments of the present invention, there is provided, a system enabling a method related to providing at least one custom piano housing adapted to house at least one keyboard instrument, the at least one custom piano housing adapted to generally simulate the outer appearance of at least one stringed-acoustic piano, such method comprising the steps of: producing at least one stored inventory comprising groups of demountable elements, each such group usable to assemble the at least one custom piano housing; offering to sell such at least one custom piano to at least one customer by providing at least one custom ordering system allowing selection of at least one custom combination of demountable elements usable to produce at least one custom piano housing; providing for acceptance of at least one custom order and at least one payment from the at least one customer; and providing for shipping such at least one custom combination of demountable elements to the at least one customer. Even further, it provides such a system wherein: each such demountable element is structured and arranged to be repeatably demountable from such at least one custom piano housing; and at least one portion of such demountable elements comprise substantial modularity to assist interchangeability of such demountable elements between the groups of demountable elements. Even further, it provides such a system wherein such at least one custom ordering step is enabled by at least one Internet site operated in conjunction with at least one website server.

FIG. 45A and FIG. 45B show front perspective views illustrating foot pedal restrainer 270 of the mobile music entertainment system 100 according to another preferred embodiment of the present invention. FIG. 45C shows a rear perspective view illustrating foot pedal restrainer 270 of FIG. 32A and FIG. 32B.

Preferably, foot pedal restrainer 270 is adapted to positionally stabilize an electronic foot control 272 during use, preventing the device from sliding out of the reach of the performer's foot, as shown. Preferably, electronic foot control 272 is of a type comprising at least one floor-supportable fixed portion 273 and at least one foot-operable moving portion 275, as shown. Electronic foot controls of the type illustrated herein generally comprise, for example, a sustain control pedal of a musical keyboard, such as, an M-Audio SP-2 or Yamaha FC4 piano style sustain pedal.

In the basic preferred embodiment, foot pedal restrainer 270 comprises a weighted apparatus adapted to fit over electronic foot control 272, as shown. Preferably, the "ballast" weight of foot pedal restrainer 270 assists in maintaining electronic foot control 272 in a constant position on the supporting surface by adding additional inertial mass to the system.

Preferably, electronic foot control 272 fits within an internal pedal bay 277 of foot pedal restrainer 270, as shown. Preferably, pedal bay 277 comprises a four-sided box-like pocket having two generally opposing side walls 278, rear wall 279, and an upper wall 281, as shown. Preferably, a resilient pad 283 is applied to upper wall 281 to assist in maintaining a continuous force-transferring frictional connection between foot pedal restrainer 270 and the upper surfaces of floor-supportable fixed portion 273 during use. Upon reading the teachings of this specification, those of ordinary skill in the art will now understand that, under appropriate circumstances, considering such issues as intended use, pedal brand/model, etc., other arrangements, such as, for example, providing a pedal bay form-fit to a specific pedal, providing a pedal bay having rounded, organic, or self-molding shapes, etc., may suffice.

Preferably, the additional inertial mass of foot pedal restrainer 270 is applied to the upper external surface of electronic foot control 272 by contact with the interior of pedal bay 277, as shown. Preferably, coupling of the inertial mass of foot pedal restrainer 270 to the upper external surface increases the overall inertial mass of electronic foot control 272, thus greatly reducing the tendency of the pedal to move under the pressure of the user's foot.

Preferably, rear wall 279 is structured to allow the passage of electrical cabling, as shown. Preferred embodiments of foot pedal restrainer 270 further comprise a bottom-mounted hook-and-loop (Velcro®) panel 274 adapted to engage carpet, used in combination with a bottom-mounted friction resisting rubber pad 275, as shown. This preferred set of features assists in maintaining foot pedal restrainer 270 in place over both carpeted and smooth floor surfaces (at least embodying herein wherein such at least one inertial mass comprises at least one removable engager structured and arranged to removably engage at least one carpet covering of at least one floor support surface and at least one friction-increasing material structured and arranged to increase surface friction between such at least one inertial mass and at least one non-carpet finish of at least one floor support surface).

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A system, related to enhancing the usefulness of at least one electronic piano, said system comprising:

a) at least one appearance simulator structured and arranged to generally simulate the outer appearance of at least one stringed-acoustic grand piano;

b) wherein said at least one appearance simulator comprises at least one housing structured and arranged to removably house the at least one electronic piano in at least one playable position;

c) wherein said at least one housing comprises at least one assembly of mountable elements, each such mountable element being structured and arranged to be repeatably demountable from said at least one housing to assist compact stowage;

d) wherein said at least one assembly of mountable elements comprises at least one outer side-panel structured and arranged to generally resemble at least one outer rim of the at least one stringed-acoustic grand piano;

e) wherein said at least one outer side-panel is sufficiently flexible to repeatably form at least one compound curve; and f) wherein said at least one outer side-panel is sufficiently flexible to repeatably form a substantially flat plane after each such repeated demounting from said at least one appearance simulator.

2. The system according to claim 1 wherein said at least one assembly of mountable elements further comprises:

a) at least one lower support panel structured and arranged to provide lower load-bearing support;

b) at least one upper support panel structured and arranged to provide upper load-bearing support; and c) at least one non-peripheral support member structured and arranged to provide centralized structural support of substantially the entire said at least one upper support panel;

d) wherein said at least one upper support panel is structured and arranged to generally resemble at least one upper lid of the least one stringed-acoustic grand piano;

e) wherein said at least one upper support panel is maintained in at least one substantially horizontal orientation during such structural support by said at least one central support;

f) wherein said at least one non-peripheral support member is structured and arranged to be supported substantially by said at least one lower support panel; and g) wherein said at least one housing comprises at least one interior compartment formed substantially within said at least one lower support panel, said at least one upper support panel, and said at least one outer side-panel.

3. The system according to claim 2 wherein said at least one lower support panel is structured and arranged to support the at least one electronic piano in the at least one playable position.

4. The system according to claim 2 wherein said at least one upper support panel is supported and arranged to provide load-bearing support at least about equal to an amount required to support at least one standing adult human player.

5. The system according to claim 2 wherein said at least one assembly of mountable elements further comprises at least one leg assembly structured and arranged to support said at least one lower support panel above at least one supporting floor surface.

6. The system according to claim 2 wherein said at least one non-peripheral support is structured and arranged to resist, substantially, at least two non-parallel directions of shear force developed within said at least one appearance simulator.

7. The system according to claim 6 wherein said at least one non-peripheral support comprises at least one generally cross-shaped member.

8. The system according to claim 6 further comprising:

a) at least one left cheek-panel structured and arranged to generally resemble at least one left cheek-portion of the at least one stringed-acoustic grand piano; and b) at least one right cheek-panel structured and arranged to generally resemble at least one right cheek-portion of the at least one stringed-acoustic grand piano.

9. The system according to claim 8 wherein said at least one assembly of mountable elements further comprises:

a) at least one front-panel assembly structured and arranged to provide at least partial front-panel closure of said at least one interior compartment;

b) wherein said front-panel assembly comprises i) at least one front closure-panel structured and arranged to provide at least partial front closure of said at least one interior compartment, and ii) at least one front support-bar structured and arranged to support said at least one front closure-panel in at least one operable position;

c) wherein said one front support-bar is structured and arranged to span in at least one substantially horizontal orientation essentially from said at least one left cheek-panel to said at least one right cheek-panel; and d) wherein said at least one front support-bar is structured and arranged to reside over at least one upper surface of the at least one electronic piano in such at least one playable position.

10. The system according to claim 9 wherein the positions of said at least one front closure-panel and said at least one front support-bar are vertically adjustable relative to the at least one upper surface of the at least one electronic piano.

11. The system according to claim 9 wherein:

a) said at least one front support-bar comprises at least one channel structured and arranged to transport at least one spilled liquid;

b) said at least one channel comprises at least one slope structured and arranged to assist in draining the at least one spilled liquid from said at least one channel to at least one location away from the at least one electronic piano;

c) at least one of said at least one left cheek-panel and said at least one right cheek-panel comprises at least one passage structured and arranged to pass the at least one spilled liquid to at least one location beyond said at least one appearance simulator; and d) said at least one channel is structured and arranged to drain to said at least one passage.

12. The system according to claim 9 wherein said at least one front closure-panel comprises at least one transparent panel-portion structured and arranged to assist viewing of at least one internal component within said at least one interior compartment.

13. The system according to claim 9 further comprising:

a) at least one loudspeaker, structured and arranged to produce at least one audible sound wave;

b) wherein said at least one loudspeaker is mounted substantially within said at least one front closure-panel.

14. The system according to claim 2 further comprising:

a) at least one piano bench structured and arranged to support at least one player of the at least one electronic piano in a seated playing position;

b) wherein said at least one piano bench comprises at least one storage compartment;

c) wherein said at least one storage compartment comprises at least one beverage-container holder structured and arranged to hold at least one beverage container; and d) wherein said at least one beverage-container holder comprises at least one refrigerant structured and arranged to assist in controlling the temperature of at least one beverage contained within the at least one beverage container.

15. The system according to claim 5 wherein said at least one lower support panel comprises:

a) at least one first lower-support-panel portion;

b) at least one second lower-support-panel portion; and c) at least one pivot structured and arranged to provide pivotal rotation of said at least one first lower-support-panel portion relative to said at least one second lower-support-panel portion.

16. The system according to claim 15 further comprising:

a) at least one secondary support-member structured and arranged to support both said at least one first lower-support-panel portion and said at least one second lower-support-panel portion from the at least one supporting floor surface;

b) wherein said at least one secondary support-member comprises at least one foot-actuated switch assembly structured and arranged to provide foot-actuated electrical control of at least one electrically-operated hardware device, and c) wherein said at least one foot actuated switch assembly comprises i) at least one first switch pedal structured and arranged to simulate at least one una corda piano pedal, ii) at least one second switch pedal structured and arranged to simulate at least one sostenuto piano pedal, iii) at least one third switch pedal structured and arranged to simulate at least one sustain piano pedal, iv) at least one pedal box structured and arranged to supportively position said at least one first switch pedal, said at least one second switch pedal, and said at least one third switch pedal adjacent the at least one supporting floor surface, v) at least one removable mount structured and arranged to removably mount to both said at said at least one first lower-support-panel portion and said at least one second lower-support-panel portion, and vi) at least one vertical support member structured and arranged to support said at least one removable mount from said at least one pedal box; and d) wherein said at least one vertical support member is structured and arranged to generally resemble at least one piano lyre.

17. The system according to claim 16 wherein:

a) said at least one third switch pedal is structured and arranged to assist musical control of the at least one electronic piano; and b) wherein said at least one first switch pedal and said at least one second switch pedal are each structured and arranged to enable at least one trigger signal usable to trigger the at least one electrically-operated hardware device.

18. The system according to claim 1 further comprising:

a) at least one data processor structured and arranged to process music-related data of at least one database;

b) at least one visual display structured and arranged to visually display at least one output of such music-related data by said at least one data processor; and c) at least one player-input system structured and arranged to assist player-generated inputs to said at least one data processor.

19. The system according to claim 18 further comprising:

a) at least one network connection structured and arranged to connect said at least one data processor to at least one communication network comprising at least one remote server containing the at least one database, and b) wherein said at least one network connection is structured and arranged to support at least one client-server process supporting at least one transfer of the music-related data between said at least one database processor and such at least one remote server.

20. The system according to claim 18 further comprising at least one onboard data-storage device structured and arranged to provide onboard storage of at least selected parts of the at least one database.

21. The system according to claim 20 further comprising:

a) such at least one database comprising music-related data;

b) wherein said at least one database comprises at least one searchable index structured and arranged to be searchable by said at least one data processor.

22. The system according to claim 1 further comprising:

a) at least one hardware-control system structured and arranged to control at least one electrically-operated hardware device;

b) wherein said at least one hardware-control system comprises at least one input port structured and arranged to receive at least one trigger signal;

c) at least one output port structured and arranged to output at least one control signal usable to control the electrically-operated hardware device, and d) at least one signal processor structured and arranged to control at least one operational relationship between a receiving of such at least one trigger signal at said at least one input port and an output of such at least one control signal supplied at said at least one output port.

23. The system according to claim 22 wherein:

a) said at least one hardware-control system comprises at least four output ports each structured and arranged to output at least one control signal on receiving such at least one trigger signal at said at least one input port; and b) each at least four output ports comprise at least one selectable enabler structured and arranged to allow independent user-selectable enablement of each one of said at least four output ports.

24. The system according to claim 16 further comprising:

a) such at least one electrically-operated hardware device;

b) wherein said at least one electrically-operated hardware device comprises at least one device mount structured and arranged to mount said at least one electrically-operated hardware device within said at least one appearance simulator.

25. The system according to claim 24 wherein said at least one electrically-operated hardware device comprises at least one illumination device.

26. The system according to claim 25 wherein said at least one illumination device comprises at least one at least one strobe light.

27. The system according to claim 24 wherein said at least one illumination device comprises at least one laser projector.

28. The system according to claim 24 wherein said at least one electrically-operated hardware device comprises at least one fog-generation device.

29. The system according to claim 24 wherein said at least one at least one electrically-operated hardware device comprises at least one confetti-launching device.

30. The system according to claim 1 further comprising:

a) at least one onboard audio controller structured and arranged to control at least one audio input and at least one audio output of said system;

b) wherein said at least one onboard audio controller comprises i) at least one audio input structured and arranged to receive at least one first electronic audio signal, ii) at least one audio divider circuit structured and arranged to divide the at least one first electronic audio signal to produce at least one second electronic audio signal, iii) at least one pass-through audio output structured and arranged to output the at least one first electronic audio signal substantially without signal processing, iv) at least one first audio-processor circuit structured and arranged to process the at least one second electronic audio signal to produce at least one third electronic audio signal, and v) at least one second audio output structured and arranged to output the at least one third electronic audio signal; and c) wherein said at least one first audio-processor circuit comprises at least one frequency adjuster structured and arranged to adjust at least one signal level within at least one frequency range of the at least one second electronic audio signal.

31. The system according to claim 1 further comprising:

a) at least one onboard air purifier structured and arranged to remove impurities from air adjacent at least one player of the at least one electronic piano;

b) wherein said at least one onboard air filter comprises i) at least one air intake structured and arranged to intake air adjacent said system, ii) at least one air filter structured and arranged to filter the impurities from the air, and iii) at least one air outlet structured and arranged to output purified air in at least one area adjacent the at least one player.

32. The system according to claim 31 further comprising:

a) at least one loudspeaker structured and arranged to produce at least one audible sound wave;

b) wherein said at least one loudspeaker comprises i) at least one vent structured and arranged to vent the purified air generated by said at least one onboard air purifier, and ii) at least one air conduit structured and arranged to conduct the purified air between said at least one air outlet and said at least one loudspeaker.

33. The system according to claim 1 wherein said at least one outer side-panel comprises at least one translucent portion structured and arranged to pass visible light.

34. The system as in claim 1, further comprising:

a) at least one foot-actuated pedal assembly structured and arranged to provide foot actuated control of the at least one keyboard instrument;

b) wherein said at least one foot-actuated pedal assembly comprises i) at least one first pedal structured and arranged to simulate at least one una corda piano pedal, ii) at least one second pedal structured and arranged to simulate at least one sostenuto piano pedal, iii) at least one third pedal structured and arranged to simulate at least one Sustain piano pedal, iv) at least one pedal box structured and arranged to supportively position said at least one first pedal, said at least one second pedal, and said at least one third pedal, and v) at least one vertical support member structured and arranged to supportively position said at least on pedal box between the at least one piano-simulating housing and at least one supporting floor surface c) wherein said at least one vertical support member is structured and arranged to visually simulate at least one piano lyre;

d) wherein said at least one vertical support member comprise at least mount structured and arranged to mount said at least one vertical support member to the at least one piano-simulating housing;

e) wherein said at least one third pedal is structured and arranged to assist musical interoperation with the at least one electronic piano; and f) wherein said at least one first pedal and said at least one second pedal each comprise at least one electrical trigger structured and arranged to provide at least one trigger signal usable to trigger the at least one electrically-operated hardware device.

35. A system related to enhancing the usefulness of at least one electronic piano, the at least one electronic piano comprising at least one keyboard portion and at least one non-keyboard portion, the at least one non-keyboard portion comprising at least one outer physical size, said system comprising:

a) at least one housing structured and arranged to generally simulate the outer appearance of at least one upright stringed-acoustic piano;

b) wherein said at least one housing comprises at least one assembly of mountable, interlocking elements collectively forming an upright piano cabinet shell, comprising a top panel, a bottom panel having a wheel cart, side panels, legs, upper and lower rear panels, upper and lower front panels, and a central enclosure sized for an electronic piano, each said mountable element structured and arranged to be repeatably demountable from said at least one housing to assist compact stowage;

c) wherein said at least one assembly of mountable elements form:

i) at least one supporting shelf structured and arranged to removably support the at least one electronic piano in at least one playable position, and ii) at least one concealer enclosure structured and arranged to substantially conceal the at least one non-keyboard portion of the at least one electronic piano during the support in the at least one playable position;

iii) one or more auxiliary concealer enclosures housing auxiliary equipment supporting the function of the keyboard instrument in a musical performance, the auxiliary enclosures positioned above, below or behind the electronic piano enclosure;

d) wherein said at least one concealer enclosure comprises at least one conformer shell structured and arranged to conform said at least one appearance simulator to the at least one outer physical size of the at least one non-keyboard portion; and e) wherein said at least one conformer shell comprises at least one structured and arranged to self adjust said at least one conformer to the at least one outer physical size of the at least one non-keyboard portion.

36. The system according to claim 35 wherein said at least one housing further comprises:

a) at least one left cheek-panel structured and arranged to generally resemble at least one left cheek-portion of the at least one stringed-acoustic piano; and b) at least one right cheek-panel structured and arranged to generally resemble at least one right cheek-portion of the at least one stringed-acoustic piano.

37. The system according to Claim 36 wherein said at least one concealer comprises:

a) at least one front-panel assembly structured and arranged to provide at least partial front-panel closure of said at least one housing;

b) wherein said front-panel assembly comprises i) at least one front closure-panel structured and arranged to provide at least partial front closure of said at least one housing, and ii) at least one front support-bar structured and arranged to support said at least one front closure-panel in at least one operable position; and c) wherein said one front support-bar is structured and arranged to span in at least one substantially horizontal orientation essentially from said at least one left cheek-panel to said at least one right cheek-panel.

38. The system according to claim 37 wherein:

a) said at least one conformer comprises said at least one front closure-panel and said at least one front support-bar;

b) the positions of said at least one front closure-panel and said at least one front support-bar are vertically adjustable relative to at least one upper surface of the at least one electronic piano;

c) said at least one front closure-panel and said at least one front support-bar are structured and arranged to conform to the at least one outer physical size of the at least one non-keyboard portion by adjustably resting on the at least one upper surface; and d) said at least one self-adjuster operates substantially by the downward force of gravity.

39. The system according to claim 37 wherein said at least one front closure-panel comprises at least one transparent panel-portion structured and arranged to assist viewing of at least one internal visual display by the at least one player.

40. The system according to claim 39 wherein said at least one front closure-panel further comprises at least one loudspeaker structured and arranged to produce at least one audible sound wave.

41. A system, related to enhancing the usefulness of at least one electronic piano, said system comprising:

a) at least one cabinet structured and arranged to hold the at least one electronic piano;

b) wherein said at least one cabinet comprises i) at least one interior compartment structured and arranged to internally house the at least one electronic piano therein;

ii) at least one access opening structured and arranged to provide access to said at least one interior compartment, and iii) at least one support tray structured and arranged to support the at least one electronic piano within said at least one interior compartment;

c) wherein said at least one support tray comprises at least one translational transporter structured and arranged to assist translational transport of said at least one support tray at least partially from within said at least one interior compartment;

d) wherein said at least one support tray comprises at least one left cheek-panel structured and arranged to generally resemble at least one left cheek-portion of the at least one stringed-acoustic piano and at least one right cheek-panel structured and arranged to generally resemble at least one right cheek-portion of the at least one stringed-acoustic piano; and e) wherein said at least one access opening comprises at least one operable door structured and arranged to, when in a closed position, substantially conceal said at least one interior compartment.

42. A method related to the support of at least one at least one electronic piano within at least one piano-simulating assembly, the at least one piano-simulating assembly adapted to simulate the outer appearance of at least one upright stringed-acoustic piano, said method comprising the steps of:

a) providing at least one cabinet, comprising at least one interior compartment, structured and arranged to house the at least one electronic piano therein;

b) providing at least one lower body component structured and arranged to provide elevated support of the at least one cabinet;

c) supportively stacking such at least one cabinet on such at least one lower body component;

d) providing at least one upper body component structured and arranged to be supportable by such at least one cabinet;

e) supportively stacking such at least one upper body component on such at least one cabinet;

f) providing at least two leg members structured and arranged to visually simulate the leg members of the at least one upright stringed-acoustic piano;

g) providing a plurality of mountable cover panels, each such mountable cover panel being structured and arranged to be repeatably demountable from at least one of such at least one cabinet, such at least one lower body component, and such at least one upper body component;

h) mounting such plurality of mountable cover panels to such at least one cabinet, such at least one lower body component, and such at least one upper body component to produce such at least one piano-simulating assembly simulating the outer appearance of the at least one upright stringed-acoustic piano.

43. A system related to reducing damage to at least one musical piano by at least one spilled liquid comprising:

a) at least one piano-type case structured and arranged to encase at least one sound-generating device;

b) wherein said at least one piano-type case comprises at least one music shelf and at least one cheek panel;

c) wherein said at least one music-shelf comprises at least one channel structured and arranged to collect the at least one spilled liquid;

d) wherein said at least one cheek panel comprises at least one passage structured and arranged to pass the at least one spilled liquid from said at least one channel to a location outside said at least one piano-type case; and e) wherein said at least one channel is further structured and arranged to assist in Transferring the at least one spilled liquid to said at least one passage.

* * * * *